US011745915B2

(12) United States Patent
Stammen et al.

(10) Patent No.: US 11,745,915 B2
(45) Date of Patent: Sep. 5, 2023

(54) PUSH BUTTON CLOSURE

(71) Applicant: Stolle Machinery Company, LLC, Centennial, CO (US)

(72) Inventors: Dennis C. Stammen, Brookville, OH (US); Patrick K. McCarty, Dayton, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 270 days.

(21) Appl. No.: 17/178,712

(22) Filed: Feb. 18, 2021

(65) Prior Publication Data

US 2021/0171236 A1 Jun. 10, 2021

Related U.S. Application Data

(63) Continuation of application No. 16/282,426, filed on Feb. 22, 2019, now Pat. No. 10,954,031.

(Continued)

(51) Int. Cl.
*B65D 17/28* (2006.01)
*B21D 51/38* (2006.01)

(Continued)

(52) U.S. Cl.
CPC ..... *B65D 17/4011* (2018.01); *B21D 51/383* (2013.01); *B21D 51/443* (2013.01); *B65D 17/404* (2018.01); *B65D 43/0202* (2013.01); *B65D 51/1677* (2013.01); *B65D 53/02* (2013.01); *B65D 2543/00277* (2013.01); *B65D 2543/00425* (2013.01)

(58) Field of Classification Search
CPC ..... B65D 17/4011; B65D 17/404; B65D 43/0202; B65D 53/02; B65D 2543/00277; B65D 2543/00425; B21D 51/383; B21D 51/443; B21D 51/1677; B21D 51/44; B21D 22/24; B21D 22/26
USPC ..... 413/8, 15, 17, 56, 67
See application file for complete search history.

(56) References Cited

U.S. PATENT DOCUMENTS 3,406,866 A 10/1968 Jasper
3,410,436 A 11/1968 Foss et al.

(Continued)

FOREIGN PATENT DOCUMENTS

CN 105473455 A 4/2016
JP 2016-204027 A 12/2016

(Continued)

OTHER PUBLICATIONS

China National Intellectual Property Administration, CN Patent Application No. 201980014629.2 first Office Action, dated Sep. 3, 2021, 8 pages and English translation.

(Continued)

*Primary Examiner* — Matthew Katcoff
*Assistant Examiner* — Mohammed S. Alawadi
(74) *Attorney, Agent, or Firm* — Eckert Seamans Cherin & Mellott LLC

(57) ABSTRACT

A container closure includes a generally planar body having a product side and a customer side. The container closure body defines a limited container opening and an actuation location. Further, the container body includes a force concentrating construction disposed adjacent the limited container opening.

10 Claims, 63 Drawing Sheets

Related U.S. Application Data

(60) Provisional application No. 62/633,841, filed on Feb. 22, 2018.

(51) Int. Cl.

| | |
|---|---|
| ***B21D 51/44*** | (2006.01) |
| ***B65D 43/02*** | (2006.01) |
| ***B65D 51/16*** | (2006.01) |
| ***B65D 53/02*** | (2006.01) |

(56) References Cited

U.S. PATENT DOCUMENTS

| | | | | |
|---|---|---|---|---|
| 3,938,455 | A | 2/1976 | Urmston | |
| 3,968,899 | A | 7/1976 | Jordon | |
| 3,982,657 | A * | 9/1976 | Keller | B65D 17/404 D9/438 |
| 4,031,836 | A | 6/1977 | Grise et al. | |
| 4,126,244 | A | 11/1978 | Elser | |
| 4,128,186 | A | 12/1978 | Gane | |
| 4,465,203 | A | 8/1984 | Lambert | |
| 4,723,684 | A * | 2/1988 | Lambert | B65D 17/401 220/268 |
| 4,909,407 | A | 3/1990 | Lambert et al. | |
| 5,535,911 | A | 7/1996 | Cortez | |
| 5,680,952 | A | 10/1997 | Chasteen | |
| 6,253,946 | B1 * | 7/2001 | Makinen | B65D 17/401 220/268 |
| 6,390,322 | B1 * | 5/2002 | Shin | B65D 17/401 220/268 |
| 9,701,447 | B2 | 7/2017 | Stodd | |
| 2003/0111469 | A1 | 6/2003 | Hartman et al. | |
| 2014/0103044 | A1 | 4/2014 | Ramsey et al. | |
| 2014/0263333 | A1 | 9/2014 | Keane et al. | |
| 2015/0129595 | A1 | 5/2015 | Kittler et al. | |
| 2016/0376071 | A1 | 12/2016 | Stodd | |
| 2017/0029165 | A1 * | 2/2017 | Gogola | B65D 17/404 |
| 2018/0339814 | A1 | 11/2018 | Stodd et al. | |

FOREIGN PATENT DOCUMENTS

| | | | |
|---|---|---|---|
| WO | 2014159208 | A1 | 10/2014 |
| WO | 2016209911 | A1 | 12/2016 |

OTHER PUBLICATIONS

European Patent Office, EP Patent Application No. 19757218.3 Extended European Search Report, dated Mar. 29, 2021, 7 pages.

Japanese Patent Office, JP Application No. 2020-544483 first Office Action and English translation, Apr. 26, 2022, 4 pages.

* cited by examiner

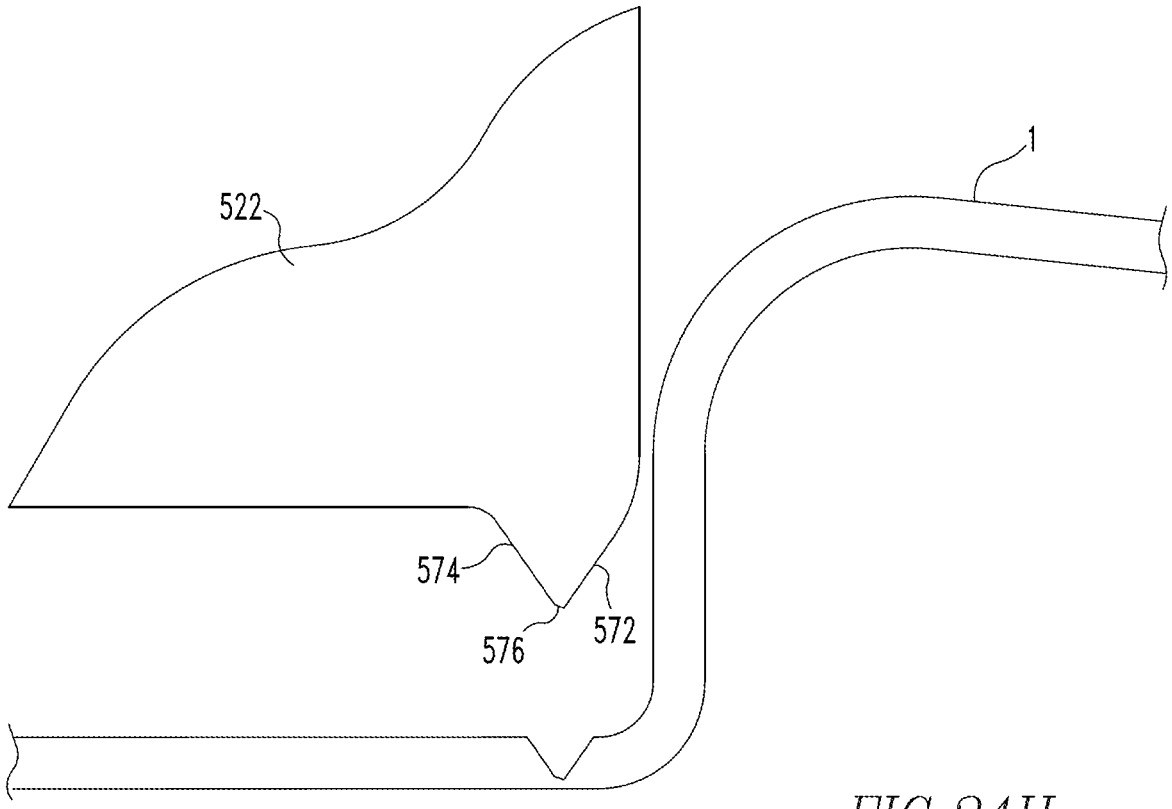
FIG.24H
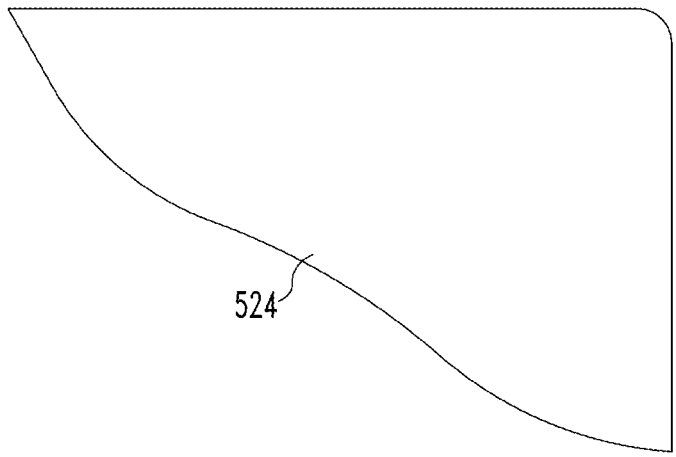

BUBBLE

2ND BUBBLE

1ST BUTTON

2ND BUTTON

3RD BUTTON

SCORE

HEM

EMBOSS PANEL

1400 PROVIDING A GENERALLY PLANAR METAL BLANK

1402 FORMING A SHIFTED MATERIAL LINE DEFINING A CONTAINER OPENING

1410 APPLYING A SEALING MATERIAL AT THE SHIFTED MATERIAL LINE

1420 FORMING ONE OF A RELIEF LINE, A SHEAR LINE, A LANCE LINE, OR A MINGLED LINE

1450 DEFINING A TEAR PANEL AND AN END PANEL IN THE BLANK

1452 MOVING THE TEAR PANEL TO ONE OF A POSITION, A NORMAL POSITION, A NEGATIVE POSITION, OR A MINGLED POSITION

*FIG.35D*

PUSH BUTTON CLOSURE

CROSS-REFERENCE TO RELATED APPLICATIONS

This application is a continuation application of and claims priority to U.S. patent application Ser. No. 16/282,426, filed Feb. 22, 2019, which application claims the benefit of U.S. Provisional Application No. 62/633,841, filed Feb. 22, 2018, both of which are incorporated by reference as if fully set forth herein.

BACKGROUND

Field

The disclosed and claimed concept relates to metal container closures and, more particularly, to container closures including a force concentrating construction disposed adjacent a limited container opening.

Background Information

Metal container closures, or can ends, are constructs structured to close a substantially enclosed space defined by a container body. In one embodiment, the container is a beverage container that includes a beverage can body and a beverage can container closure (or beverage can end). That is, the container body is a beverage can body, such as but not limited to, a can body for carbonated beverages, hereinafter, and as used herein, a beverage can body. The beverage can body includes a bottom, or base, with an upwardly depending sidewall. The base and sidewall define a substantially enclosed space. After the beverage can body is filled with a liquid, a beverage can end, which is a container closure, is coupled to the beverage can body. The can end includes a container opening. That is, the can end includes an end panel and a tear panel. The end panel comprises the bulk of the can end and is generally planar. The tear panel defines the container opening. That is, the tear panel is a small portion of the end panel defined by a score line. The score line weakens the material of the end panel. As is known, a lift tab is coupled to the end panel adjacent the tear panel. When the lift tab is actuated, i.e., lifted, a portion of the lift tab engages the tear panel and causes the tear panel to move relative to the end panel. As the tear panel moves relative to the end panel, the tear panel and the end panel separate at the score line. As is known, the score line does not extend entirely about the tear panel. In this configuration, there is a connection tab that links the tear panel to the end panel. Thus, the tear panel does not fall into the beverage can body, but rather flexes toward the beverage can body so that a consumer may drink the liquid via the container opening.

In another embodiment, the container is a food container that includes a food can body and a food can container closure (or food can end). That is, a container body is a food can body, such as but not limited to, a can body for sardines, hereinafter, and as used herein, a food can body. The food can body also includes a bottom, or base, with an upwardly depending sidewall. The base and sidewall define a substantially enclosed space. After the food can body is filled with a food, and in this instance, sardines, a food can end is coupled to the food can body. As before, in this embodiment, the food can end includes an end panel and a tear panel, wherein the tear panel is defined by a score line. In this embodiment, however, the end panel is substantially the perimeter portion of the food can end and the tear panel is a large central portion. A pull tab is coupled to the tear panel adjacent the score line. As is known, the pull tab is lifted to create an initial break at the score line, then pulled to separate the tear panel from the end panel.

In another embodiment, the container is a glass jar. That glass jar includes a base and an upwardly depending sidewall. The distal portion of the side wall includes external threads. In this embodiment, the container closure is a twist lug, or, as used herein, a "lid." That is, a "lid" means a closure structured to be removably coupled to a jar and which includes a generally planar top and a depending sidewall with internal threads. As is known, food stored in glass jars typically requires some process retort (heating/cooling) to sterilize/cook the contents. In the process, the product is exposed to a vacuum during the cooling process. This vacuum exposes the underside of the lid closure to a negative pressure, which makes the closure difficult to open/twist off the jar. One solution to this problem is to provide a push button on the lid. That is, a push button is a type of tear panel that is raised for access. As with the can ends described above, the lid defines an end panel and a tear panel. The tear panel includes a raised portion that is the push button. Further, an arcuate score line defines the tear panel. When a user opens the jar, the user engages the button causing the tear panel to tear at the score line allowing atmosphere to enter the enclosed space thus making removal of the lid easier.

In each of the container closures described above, the tear panel, and therefore the container opening, is defined by a score line. The score line is formed by a blade engaging a blank. The blade thins the metal at the score line. That is, in a tooling assembly, an upper tooling includes a blade and a lower tooling includes an anvil opposite the blade. A metal blank is disposed between the upper tooling and the lower tooling. When the upper tooling and the lower tooling are brought together, the blade engages the upper surface of the blank and deforms the metal. That is, the metal under the blade flows to either side of the blade thereby creating a thin portion which is the score line.

In some configurations, such as, but not limited to, the lid coupled to a jar, the substantial severing of the tear panel is not required. That is, a small opening is sufficient to allow the atmosphere to enter the enclosed space thus making removal of the lid easier. Known tear panels, however, are relatively large, i.e., approximately the same size as tear panels on a beverage can container closure. This is a disadvantage. Further, the button, or similar constructs, are configured to open the relatively large tear panel. This action requires a force sufficient to separate the entire tear panel from the end panel. This is also a disadvantage.

Each of these disadvantages is a problem with container closures. There is, therefore, a need for an improved container closer that addresses these problems.

SUMMARY

These problems, and others, are addressed by at least one embodiment of the disclosed and claimed concept which provides a container closure including a generally planar body having a product side and a customer side. The container closure body defines a limited container opening and an actuation location. Further, the container body includes a force concentrating construction disposed adjacent the limited container opening. As defined below, a "limited container opening" is an opening defined by a score line wherein the score line is structured to separate the portions of the body upon which the score line is disposed, but, wherein a portion of the body upon which the score line is disposed is moved a minor distance away from the other portion of the body upon which the score line is disposed. That is, generally, a "limited container opening" is relatively small. Further, as the limited container opening is relatively small, the force concentrating construction is structured to, and does, concentrate the force applied by a user to the score line. Thus, because the limited container opening is relatively small, and, because the force applied by the user is concentrated adjacent the limited container opening, a minimal amount of force is needed to open the limited container opening. Thus, this configuration solves the problems stated above.

BRIEF DESCRIPTION OF THE DRAWINGS

A full understanding of the invention can be gained from the following description of the preferred embodiments when read in conjunction with the accompanying drawings in which:

FIG. 24H is a detailed schematic view of a press assembly score station chisel nose score blade.

FIGS. 35A-35D are flowcharts of the disclosed method.

FIG. 38C is cross-sectional side view of the lid in FIG. 38A.

DESCRIPTION OF THE PREFERRED EMBODIMENTS

Figure 1:
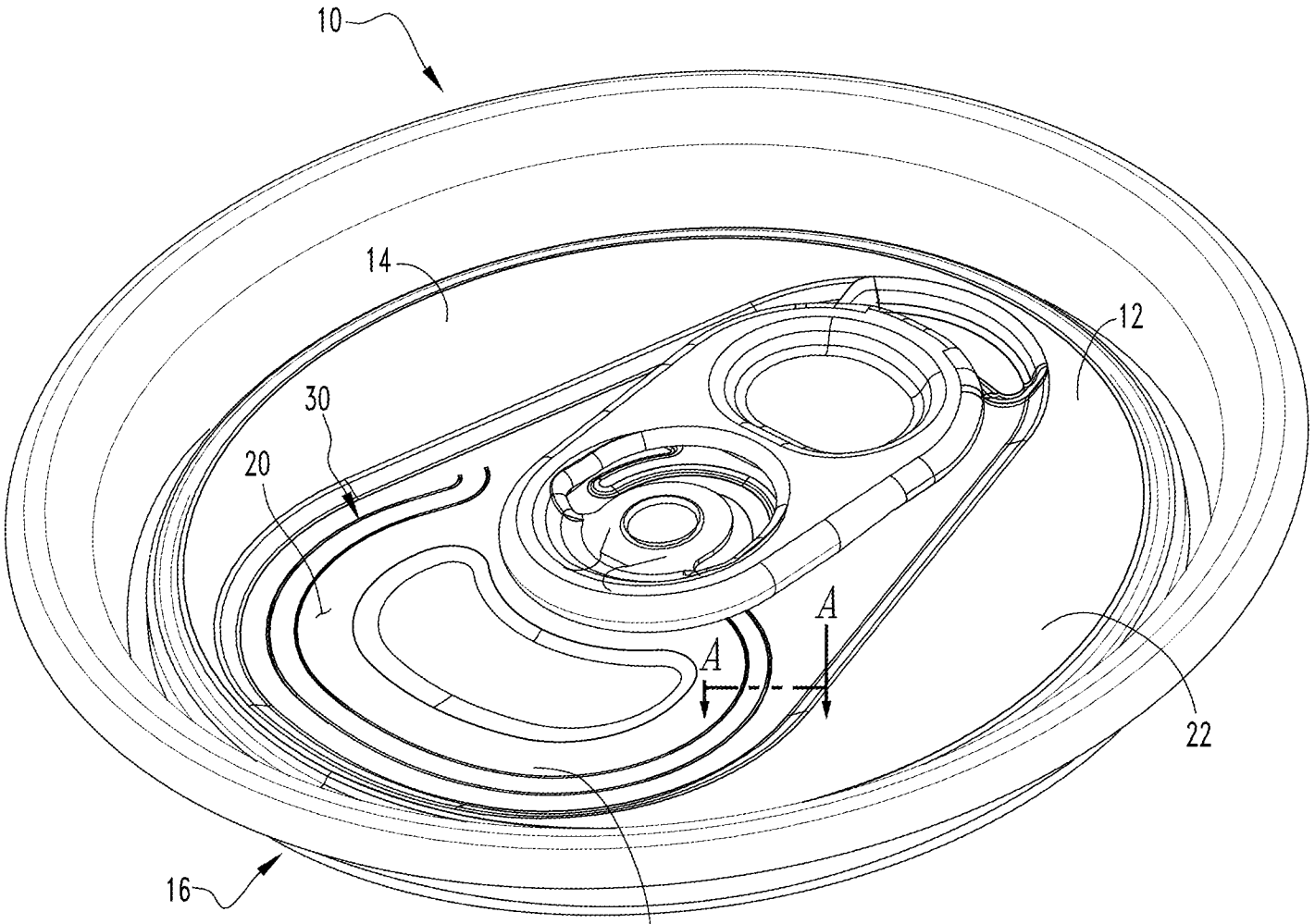
FIG. 1 is an isometric view of a container closure.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, "at" means on and/or near.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, an object resting on another object held in place only by gravity is not "coupled" to the lower object unless the upper object is otherwise maintained substantially in place. That is, for example, a book on a table is not coupled thereto, but a book glued to a table is coupled thereto.

As used herein, a "fastener" is a separate component structured to couple two or more elements. Thus, for example, a bolt is a "fastener" but a tongue-and-groove coupling is not a "fastener." That is, the tongue-and-groove elements are part of the elements being coupled and are not a separate component.

As used herein, the phrase "removably coupled" or "temporarily coupled" means that one component is coupled with another component in an essentially temporary manner. That is, the two components are coupled in such a way that the joining or separation of the components is easy and would not damage the components. For example, two components secured to each other with a limited number of readily accessible fasteners, i.e., fasteners that are not difficult to access, are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, "temporarily disposed" means that a first element(s) or assembly (ies) is coupled to a second element(s) or assembly(ies) in a manner that allows the first element/assembly to be moved without having to decouple or otherwise manipulate the first element. For example, a book simply resting on a table, i.e., the book is not glued or fastened to the table, is "temporarily disposed" on the table.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening is made from a deformable or compressible material, the opening may even be slightly smaller than the component being inserted into the opening. With regard to surfaces, shapes, and lines, two, or more, "corresponding" surfaces, shapes, or lines have generally the same size, shape, and contours.

As used herein, "curvilinear" means elements having multiple curved portions, combinations of curved portions and planar portions, and a plurality of planar portions or segments disposed at angles relative to each other thereby forming a curve. As used herein, "arcuate" means a curve that is substantially circular, i.e., part of a circle.

As used herein, a "planar body" or "planar member" is a generally thin element including opposed, wide, generally parallel surfaces, i.e., the planar surfaces of the planar member, as well as a thinner edge surface extending between the wide parallel surfaces. That is, as used herein, it is inherent that a "planar" element has two opposed planar surfaces. The perimeter, and therefore the edge surface, may include generally straight portions, e.g., as on a rectangular planar member, or be curved, as on a disk, or have any other shape.

As used herein, a "path of travel" or "path," when used in association with an element that moves, includes the space an element moves through when in motion. As such, any element that moves inherently has a "path of travel" or "path." When used in association with an electrical current, a "path" includes the elements through which the current travels.

As used herein, the statement that two or more parts or components "engage" one another shall mean that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A engages element B while in element A first position.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "coupled" to the screw. If an axial force is applied to the screwdriver, the screwdriver is pressed against the screw and "engages" the screw. However, when a rotational force is applied to the screwdriver, the screwdriver "operatively engages" the screw and causes the screw to rotate. Further, with electronic components, "operatively engage" means that one component controls another component by a control signal or current.

As used herein, the word "unitary" means a component that is created as a single piece or unit. That is, a component that includes pieces that are created separately and then coupled together as a unit is not a "unitary" component or body.

As used herein, the term "number" shall mean one or an integer greater than one (i.e., a plurality).

As used herein, for any adjacent ranges that share a limit, e.g., 0%-5% and 5%-10, or, 0.05 inch-0.10 inch and 0.001 inch-0.05 inch, the upper limit of the lower range, i.e., 5% and 0.05 inch in the examples above, means "less than" the identified limit. That is, in the example above, the range 0%-5% means 0%-4.999999%.

As employed herein, the terms "can" and "container" are used substantially interchangeably to refer to any known or suitable container, which is structured to contain a substance (e.g., without limitation, liquid; food; any other suitable substance), and expressly includes, but is not limited to, beverage cans, such as beer and beverage cans, as well as food cans. As used herein, in the phrase "[x] moves between its first position and second position," or, "[y] is structured to move [x] between its first position and second position," "[x]" is the name of an element or assembly. Further, when [x] is an element or assembly that moves between a number of positions, the pronoun "its" means "[x]," i.e., the named element or assembly that precedes the pronoun "its."

As used herein, "about" in a phrase such as "disposed about [an element, point or axis]" or "extend about [an element, point or axis]" or "[X] degrees about an [an element, point or axis]," means encircle, extend around, or measured around. When used in reference to a measurement or in a similar manner, "about" means "approximately," i.e., in an approximate range relevant to the measurement as would be understood by one of ordinary skill in the art.

As used herein, "generally" means "in a general manner" relevant to the term being modified as would be understood by one of ordinary skill in the art.

As used herein, "substantially" means "for the most part" relevant to the term being modified as would be understood by one of ordinary skill in the art.

As used herein, a "flattened" button is a construct that, when viewed in cross-section, includes a sidewall with a tall end relative to a base plane and a short end relative to a base line and a generally planar top wall extending between the sidewall tall end and the sidewall short end. Further, a "flattened" button sidewall at the tall end extends at an angle to the base plane. Further, as used herein, a "cylindrical flattened" button is a "flattened" button that, when viewed from a position normal to the cross-section has a generally circular perimeter.

As used herein, an "angled" button is a construct that, when viewed in cross-section, includes a sidewall with a tall end relative to a base plane and a short end relative to a base line and a generally planar top wall extending between the sidewall tall end and the sidewall short end. Further, an "angled" button sidewall at the tall end extends generally normal to the base plane. Further, as used herein, a "cylindrical angled" button is an "angled" button that, when viewed from a position normal to the cross-section has a generally circular perimeter.

As used herein, an angled button with a "limited height" is an angled button wherein the height of the tall end is between about 0.060 and 0.080 relative to the surface from which it extends. Further, as used herein, an angled button with a "very limited height" is an angled button wherein the height of the tall end is about 0.070 relative to the surface from which it extends. Further, as used herein, a "limited height" and a "very limited height" are related to an angled button; that is, a dome-like button cannot have a "limited height" or a "very limited height" as defined herein.

As used herein, "forming a bubble" means forming a dome in a generally planar construct. That is, after "forming a bubble," the resulting construct is identified alternatively as a "bubble" or a "dome."

As used herein, a bubble or dome has both a "dome radius" and a "base radius." A "dome radius" is the radius of the arc that defines the protrusion of the dome from a generally planar surface, i.e., the radius that defines the dome height. The dome "base radius" is the radius of curvature between the button sidewall and the surface from which the bubble or dome extends. The "base radius" is measured at the bottom of the dome, i.e., where the cross-sectional area is the greatest.

As used herein, a cylindrical angled button has a "top radius" and "base radius" wherein both are the radius of the cylindrical angled button when viewed normal to the plane of the generally planar surface from which the cylindrical angled button protrudes. The "top radius" is the radius of the cylindrical angled button at the top thereof, and the "base radius" is the radius of the cylindrical angled button at the bottom thereof. It is understood that the cylindrical angled button top wall may not be a perfect circle and the "radius" is the measurement that approximates a "radius" as would be understood by one of ordinary skill in the art. The "radius" is measured at the bottom of the cylindrical angled button, i.e., where the cross-sectional area is the greatest.

As used herein, a cylindrical angled button with a "sharp top radius" means that the radius of curvature between the button sidewall and the button top side, is between about 0.020 and 0.060 inch. Further, a "very sharp top radius" means that the radius of curvature between the button sidewall and the button top side is about 0.040 inch.

As used herein, a cylindrical angled button with a "sharp base radius" means that the radius curvature between the button sidewall and the surface from which it extends, is between about 0.005 inch and 0.020 inch. Further, a "very sharp base radius" means that the radius of curvature between the button sidewall and the surface from which the button extends is about 0.008 inch.

As used herein, a "limited distance," when that term is used relative to the distance between a cylindrical angled button radius and a score, means a distance between about 0.0 inch (coincident or overlapping) and 0.008 inch. As used herein, a "very limited distance," when that term is used relative to the distance between a cylindrical angled button radius and a score means a distance of about 0.0 inch.

As used herein, a "limited spacing," when that term is used relative to the distance between a main score and an anti-fracture score, means a distance between about 0.030 inch and 0.050 inch. As used herein, a "very limited spacing," when that term is used relative to the distance between a main score and an anti-fracture score, means a distance about 0.040 inch.

As used herein, a "limited arc," when that term is used relative to the distance between a cylindrical angled button radius and a score, means an arc of between about 20 and 200 degrees. As used herein, a "substantially limited arc," when that term is used relative to the distance between a cylindrical angled button radius and a score, means an arc of between about 30 and 180 degrees. As used herein, a "very limited arc," when that term is used relative to the distance between a cylindrical angled button radius and a score, means an arc of about 80 degrees.

As used herein, a "second bubble" is a bubble (or dome) formed from a prior bubble (or dome). As such, a bubble (or dome) formed from a generally planar material cannot be a "second bubble." Further, as used herein, a bubble (or dome) formed from a generally planar material without first being formed into a first bubble, or similar construct, is not capable of being a "second bubble."

As used herein, a "minimal score residual" means a score residual of between about to 0.0005 inch to 0.0025 inch. As used herein, a "limited score residual" is about 0.0010 inch.

As used herein, "hemming" means to flatten a protrusion so as to form a tab or flange structured to prevent, or resist, movement of the protrusion through an opening.

As used herein, a "line" does not mean a two-dimensional construct made by moving a point along a path. Rather, as used herein, a "line" means something that is distinct, elongated, and narrow.

As used herein, "generally planar" means a body or member is broadly "planar." That is, a "generally planar" body or member includes planar bodies with recesses, rivets, and protrusions that are generally in the same plane as other portions of the body or member. Further, a "generally planar" body includes bodies or members that are generally convex or concave, such as, but not limited to, some beverage can container closures (or beverage can ends)

exclusive of elements such as a chuck wall and curl. That is, the portion of a closure body 12 defining an end panel 22 and a tear panel 24 are, as used herein, "generally planar."

As used herein, "a portion of material on one side of the, or a line that is, or at one time was, in a first plane, and, another portion of material on the other side of the line that is, or at one time was, in a second plane" means that the two portions of material were at one time generally planar, i.e., were portions of a generally planar member, and can be identified by a line between the portions that extends generally perpendicular to the plane of the generally planar member. The portions of material do not have to be in a planar configuration at, or after, the time a "shifted material line" is formed.

As used herein, a "product side" means the side of a construct used in a container that contacts, or could contact, a product such as, but not limited to, a food or beverage. That is, the "product side" of the construct is the side of the construct that, eventually, defines the interior of a container.

As used herein, a "customer side" means the side of a construct used in a container that does not contact, or could not contact, a product such as, but not limited to, a food or beverage. That is, the "customer side" of the construct is the side of the construct that, eventually, defines the exterior of a container.

As used herein, a "limited container opening" is an opening defined by a score line wherein the score line is structured to separate the portions of the body upon which the score line is disposed, but, wherein a portion of the body upon which the score line is disposed is moved a minor distance away from the other portion of the body upon which the score line is disposed. As used herein, a "minor distance" means a distance sufficient to allow gas to pass through the opening created when the two portions of the body are separated. Stated alternately, a "limited container opening" is a passage resulting from the separation of, or a portion of, a generally linear, or an overall generally straight curvilinear, score line on a closure body sufficient to allow gas to pass through the passage.

As used herein, an "overall generally straight curvilinear" score line or opening means a generally straight line which includes a number of curvilinear portions. For example, a score line shaped like a parentheses, or a "(," is an "overall generally straight curvilinear" score line. Conversely, a score line shaped like a "U" is not an "overall generally straight curvilinear" score line. Stated alternately, for an "overall generally straight curvilinear" score line or opening, the offset between a straight line drawn between the tips of the "overall generally straight curvilinear" score line and the "overall generally straight curvilinear" score line is no more than about 25% of the length of the straight line drawn between the tips of the "overall generally straight curvilinear" score line.

As used herein, a "force concentrating construction" means a configuration of score lines that includes, consists essentially of, or consists of, a "force directing score pattern" and/or a force focusing score.

As used herein, a "force directing score pattern" means a number of score lines that define a number of "links" and which is structured to reduce the ability of metal in an area to carry/transfer a load applied within the area and to force the load to be transferred via a "link." Thus, a "force directing score pattern" inherently includes a number of links.

As used herein, and in connection with a "force directing score pattern," a "link" means a narrow, unscored portion of metal between adjacent scores defining an enclosed area or a substantially enclosed area, and, wherein the scores defining an enclosed area or a substantially enclosed area are disposed about an actuation location. The term "link" as defined in this paragraph is not limiting upon the term "link" as used in the definition of the term "coupled," above.

As used herein, an "actuation location" means a location on a metal closure wherein pressure is applied for the purpose of making an opening in the metal closure. For example, in a traditional aluminum container for carbonated beverages, a tab is lifted thereby applying pressure to a tear panel; in this configuration, the location wherein the tab contacts the tear panel is the "actuation location." In a container closure having a button, the button is the "actuation location."

As used herein, a "force focusing score line" means a score line that includes an incongruous medial portion. That is, non-"force focusing score lines" are generally disposed in straight lines, curvilinear lines, or geometric shapes such as, but not limited to, a rounded triangle. A "force focusing score" includes portions that are disposed in a straight line or an overall generally straight curvilinear line as well as a pointed or curvilinear incongruous medial portion that is not disposed along the straight line or is incongruent with the broad curves of an overall generally straight curvilinear line. Further, a "force focusing score" is convex relative to an "actuation location." That is, a pointed or curved incongruous medial portion points generally toward, or arcs toward, an "actuation location." Thus, a rounded triangular tear panel, for example, does not define a "force focusing score" because the "actuation location" for a tear panel is on the tear panel and, as such, the corners of a rounded triangular tear panel are not convex relative to, i.e., arced toward, the "actuation location." As used herein, the pointed or curved incongruous medial portion points generally toward, or arcs toward, an "actuation location" is also identified as a "nose." As used herein, a "force focusing score line" inherently includes a "nose."

As used herein, a "circular trapezoid" is a shape with, and which inherently includes, two generally curvilinear and generally parallel sides and two generally straight, radial sides. A "circular trapezoid" is a substantially closed shape defining a substantially enclosed space. In one embodiment, the perimeter defining a "circular trapezoid" includes a number of gaps wherein the shape of the "circular trapezoid" is visually discernable, i.e., identifiable as a "circular trapezoid" by one of ordinary skill in art despite the lack of a contiguous perimeter. In another embodiment, a "circular trapezoid" includes a contiguous perimeter.

Figure 2:
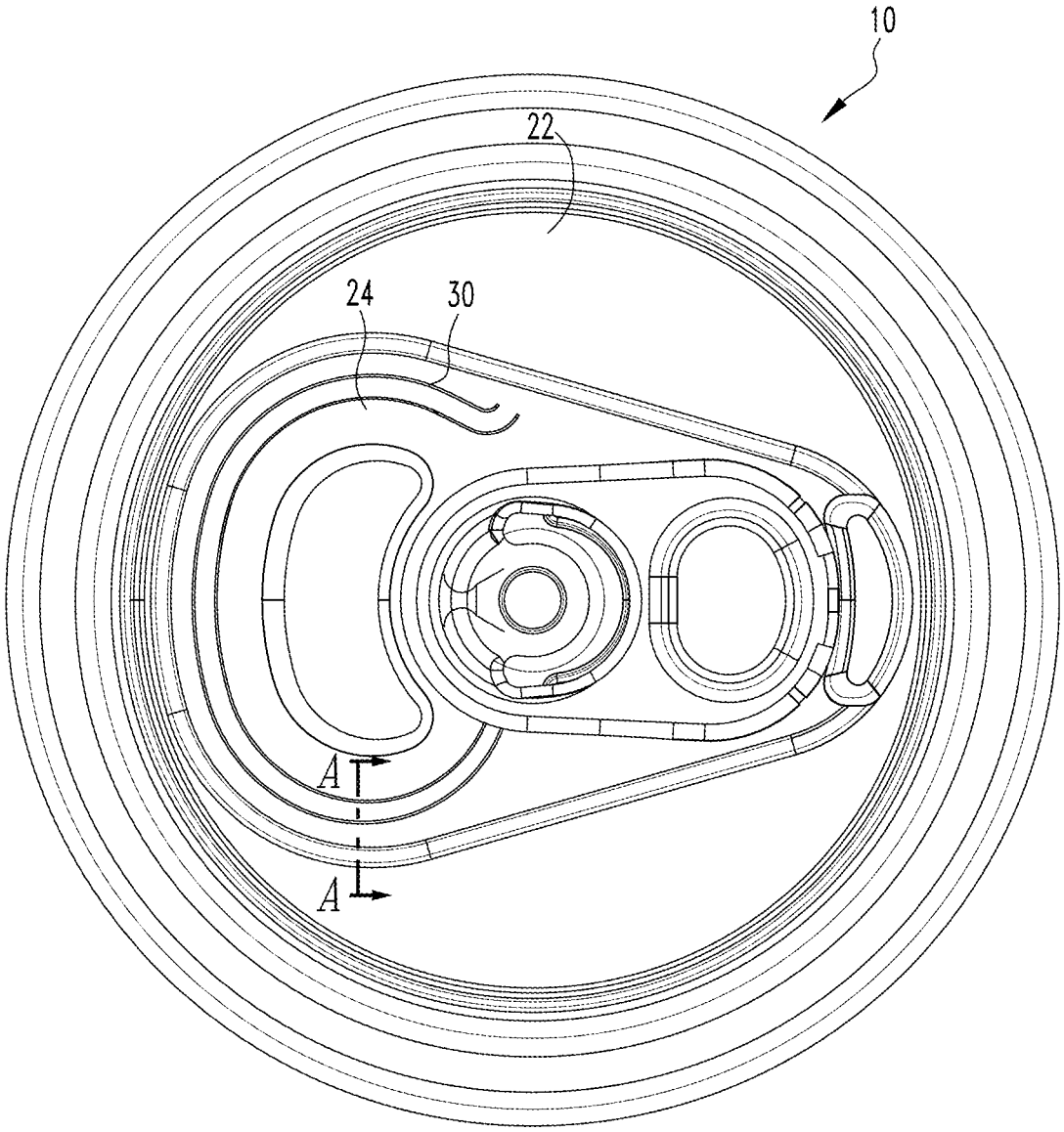
FIG. 2 is a top view of a container closure.
Figure 19:
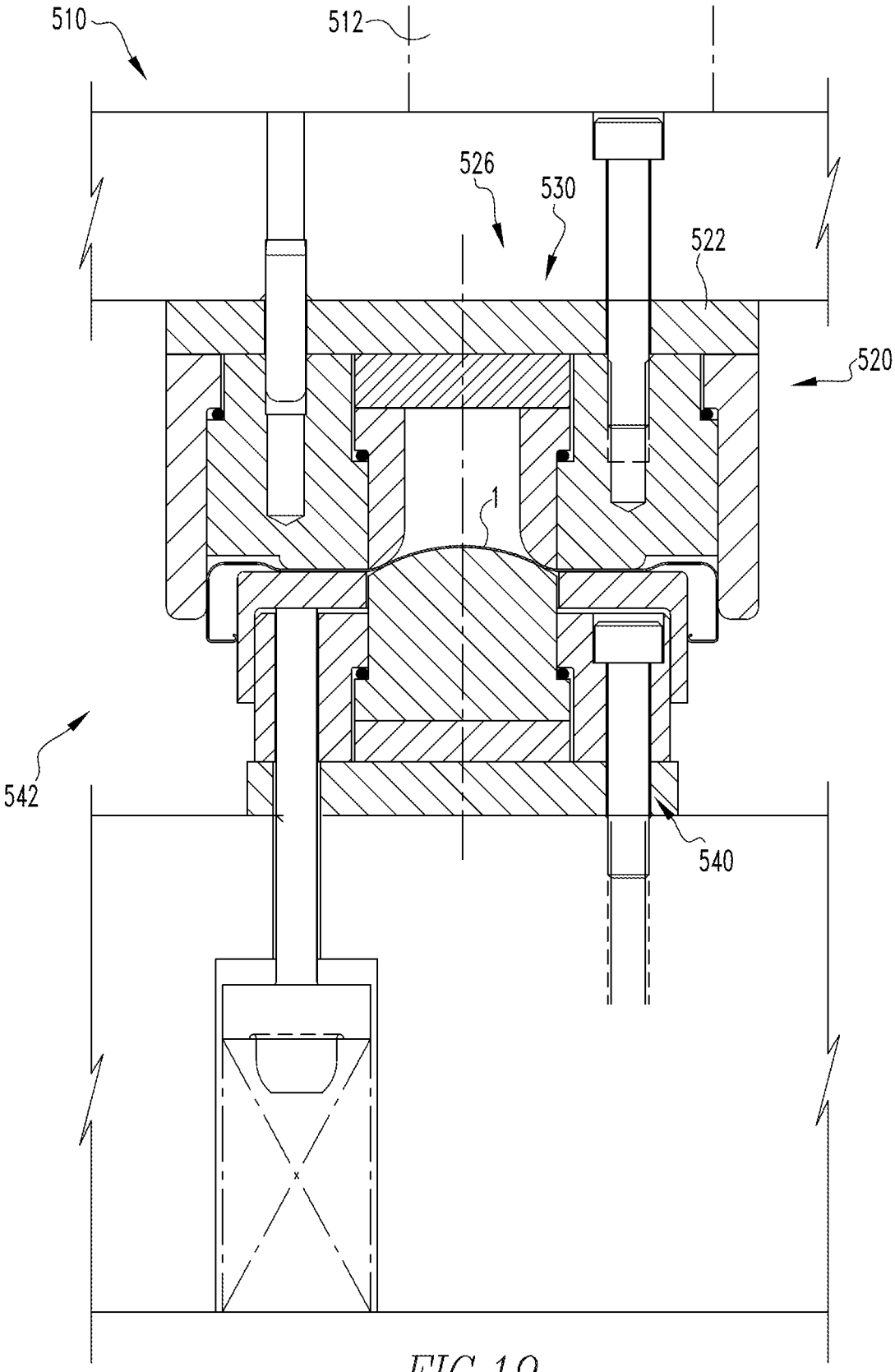
FIG. 19 is a schematic cross-sectional view of a press assembly first stage bubble station.
Figure 19A:
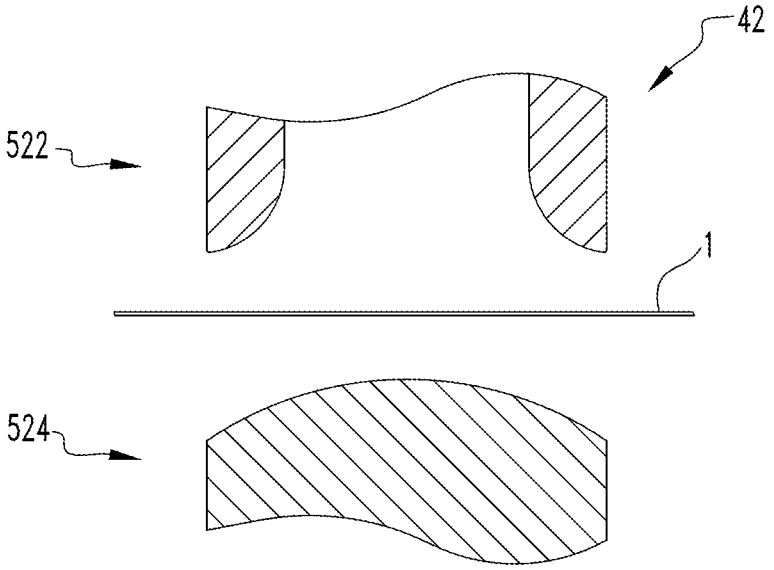
FIG. 19A is a detailed schematic view of the press assembly first stage bubble station about to act on a blank.
Figure 19B:
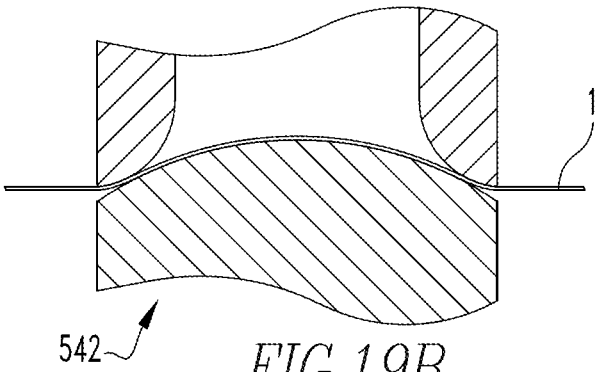
FIG. 19B is a detailed schematic view of the press assembly first stage bubble station forming a bubble in the blank.

As shown in FIGS. 1 and 2, a container closure 10 includes a generally planar body 12 having a product side 14 and a customer side 16. It is understood that the terms "product side" 14 and "customer side" 16 apply to all portions and/or elements of the container closure 10. That is, as described below, the container closure body 12 includes a tear panel 24; thus, the tear panel 24 has a "product side" 14 and "customer side" 16 as well. The container closure 10 is shown schematically and does not include additional features associated with specific container closures 10. For example, a container closure that is intended to be coupled to a beverage can body or a food can body (neither shown) includes elements such as, but not limited to, a curl, a chuck wall, or a bead; none of these elements are shown. Similarly, a container closure 10, or lid, that is intended to be coupled to ajar includes a generally planar portion and a depending sidewall with interior threads. None of these elements are shown. Thus, the container closure 10 is shown schematically and represents a portion of a complete container closure. Further, the portion of the container closure 10 may be part of any of a beverage can container closure (or beverage can end), a food can container closure (or food can end) or a lid, none shown. The container closure body 12 includes, i.e., defines, a container opening 20. That is, the container opening 20 is defined by a shifted material line 30. Stated alternately, the container closure body 12 and/or the container opening 20 includes a shifted material line 30. Further, the container closure body 12 includes an end panel 22 and a tear panel 24. Generally, and as described above, the end panel 22 is the portion of the container closure 10 that is coupled, directly coupled, fixed, or temporarily coupled to a can body or jar (either shown). The tear panel 24 is a portion of the container closure 10 that moves relative to the end panel 22. Thus, the tear panel 24 defines the container opening 20. That is, when the tear panel 24 has been moved relative to the end panel 22, the tear panel 24 is decoupled, or partially decoupled, from the end panel 22 and defines the container opening 20. The tear panel 24 is decoupled from the end panel 22 at the shifted material line 30. Thus, the shifted material line 30 defines the tear panel 24. The tear panel 24 may be in any shape such as, but not limited to, a generally oval shape and a relatively small portion (when compared to the end panel 22) of a container closure 10 associated with a beverage can container closure (or beverage can end), a generally rectangular or circular shape and a relatively large portion (when compared to the end panel 22) of a container closure 10 associated with a food can container closure (or food can end), or a button 600 having a generally curvilinear or arcuate shifted material line 30 extending partially about the button 600, discussed below. Further, it is understood that the container closure 10 is part of a unitary metal body that is initially, i.e., before substantive forming operations, a generally planar blank 1 (FIG. 19A).

Figure 3:
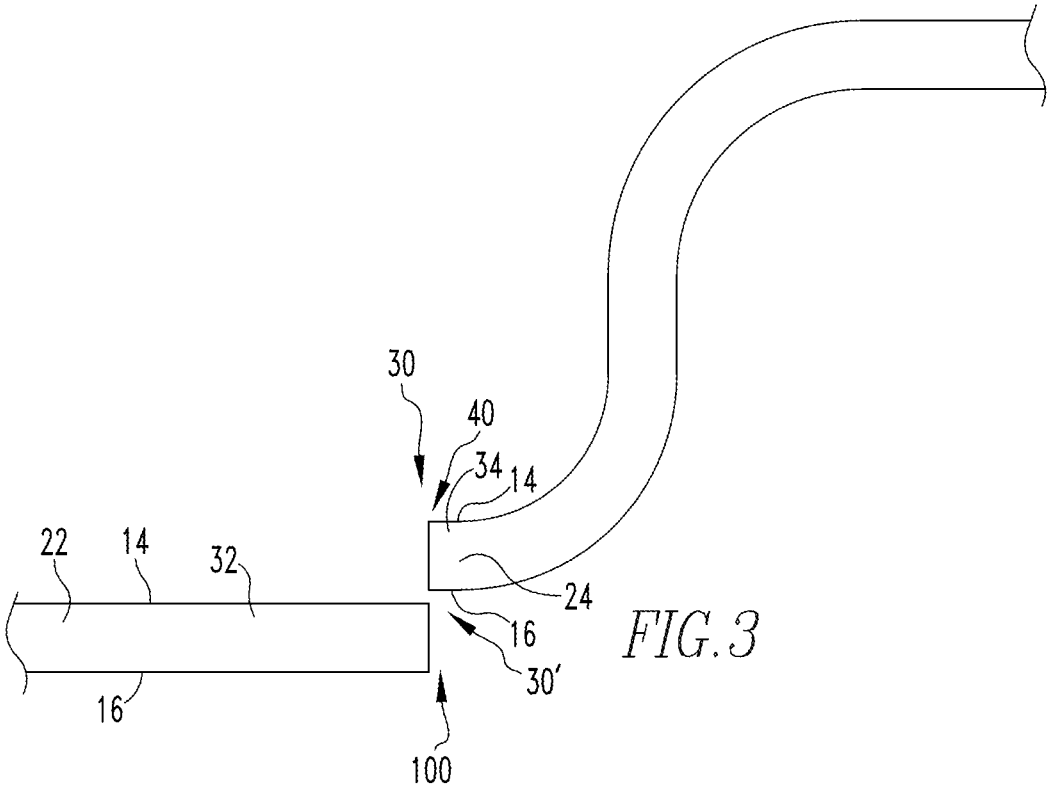
FIG. 3 is a schematic cross-sectional view of a shifted material line.

The shifted material line 30 includes, and/or is defined by, a first portion 32 and a second portion 34. That is, the first portion 32 is disposed on a first side of the shifted material line 30 and the second portion 34 is disposed on a second side of the shifted material line 30. A shifted material line 30 is one of a "wide line," a "medium line" or a "narrow line." As used herein, a "wide line" has width between 0.015 inch and about 0.100 inch. As used herein, a "medium line" has width between 0.005 inch and 0.015 inch. As used herein, a "narrow line" has width between 0.0 inch and 0.005 inch. As used herein, a line with a width of 0.0 inch is a shifted material line 30 wherein material defining the line has separated, i.e., a "lance line" as defined above. In an exemplary embodiment, and as shown, the first portion 32 is part of the end panel 22 and the second portion 34 is part of the tear panel 24. In an exemplary embodiment, the first portion 32 and second portion 34 are each a generally planar portion. FIG. 3 shows a lance line 100.

In an embodiment wherein the shifted material line 30 is a lance line 100, the first portion 32 is separated from the second portion 34. Further, as shown, the first portion 32 is offset toward the product side 14 relative to the second portion 34. When the first portion 32, i.e., the end panel 22, is offset toward the product side 14 relative to the second portion 34, i.e., the tear panel 24, the second portion 34 (or the tear panel 24) has, as used herein, a "positive shift." That is, when the second portion 34, i.e., the tear panel 24, is offset generally toward the customer side 16, the tear panel 24 has a "positive shift." In this embodiment, the separation defines the shifted material line 30. In an exemplary embodiment, as discussed below, the separation is created when a tooling assembly 520 acts on the blank and fractures the material of the blank causing the separation. As used herein, a separated shifted material line 30 is a "fractured shifted material line" 30'.

Figure 8:
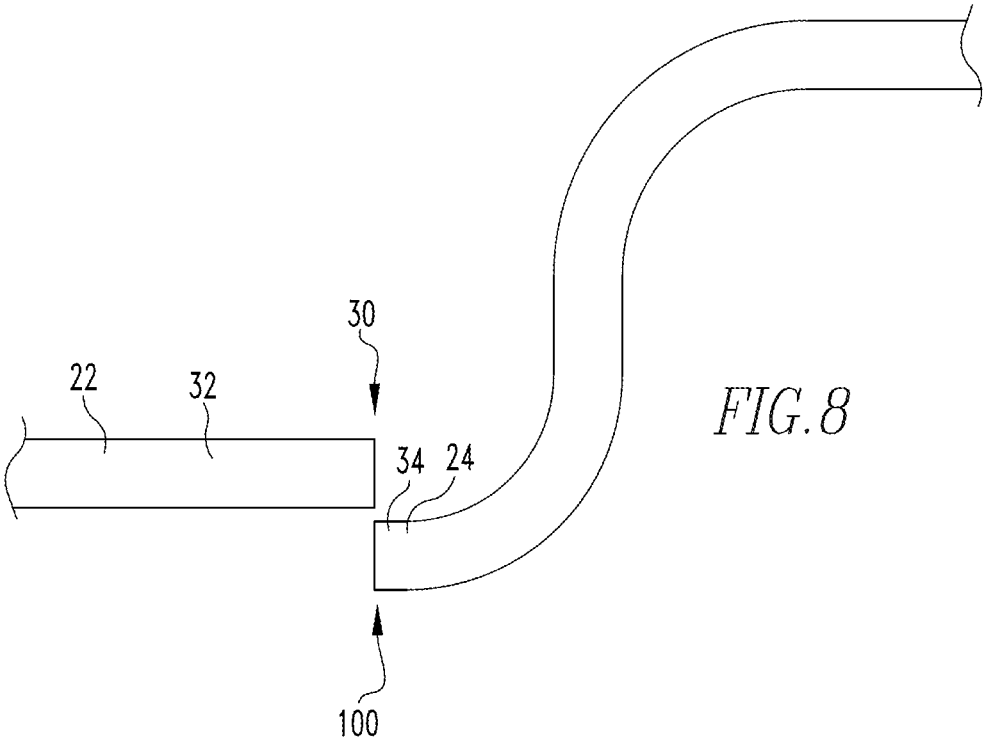
FIG. 8 is another schematic cross-sectional view of a shifted material line.
Figure 9:
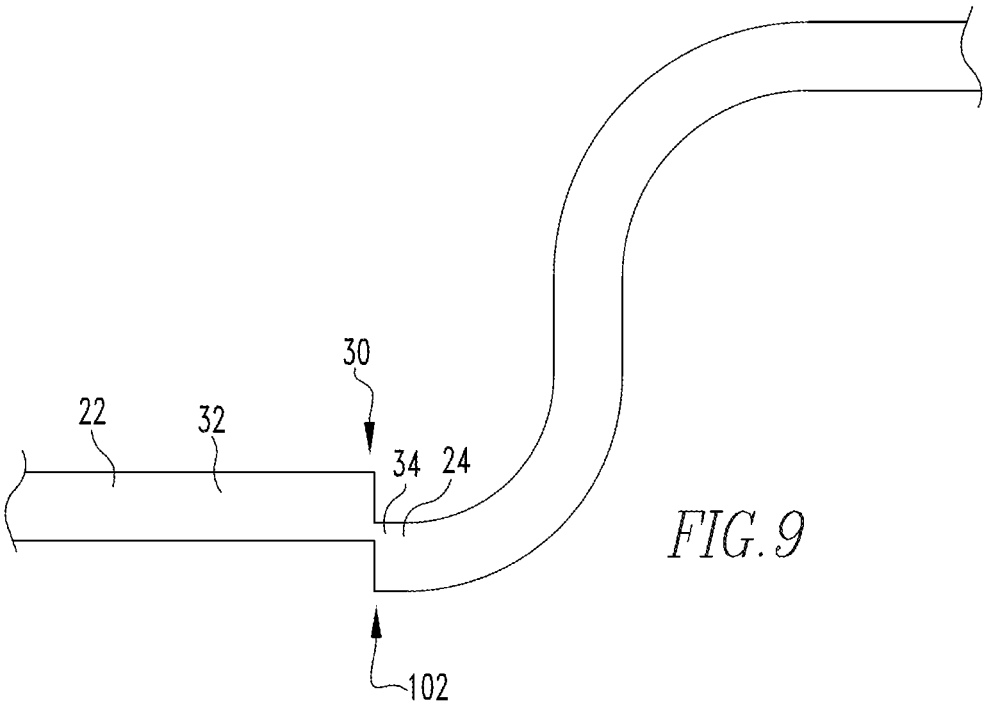
FIG. 9 is another schematic cross-sectional view of a shifted material line.

In another embodiment, the shifted material line 30 is a shear line 102. In this embodiment as shown, the first portion 32 and the second portion 34 are each a generally planar portion. Further, as shown, the first portion 32 is offset toward the customer side 16 relative to the second portion 34. When the first portion 32, i.e., the end panel 22, is offset toward the customer side 16 relative to the second portion 34, i.e., the tear panel 24, the second portion 34 (or the tear panel 24) has, as used herein, a "negative shift," as shown in FIGS. 8 and 9. That is, when the second portion 34, i.e., the tear panel 24, is offset generally toward the product side 14, the tear panel 24 has a "positive shift." In this embodiment, the first portion 32 and second portion 34 are not separated. Thus, the shifted material line 30 is defined by transitional area 40 between the first portion 32 and the second portion 34. The transitional area 40 has width of between about 0.0 inch and 0.100, about 0.005 inch and 0.015 inch, or about 0.010 inch. If the transitional area 40 is wider than the widest range noted above, the offset portions do not define a "shifted material line 30" or a "shear line" as used herein. Further, as noted above, the transitional area 40 is stretched, or otherwise deformed, so as to allow the material on different sides of the shifted material line 30 or shear line 102 to be in different planes.

Figure 4:
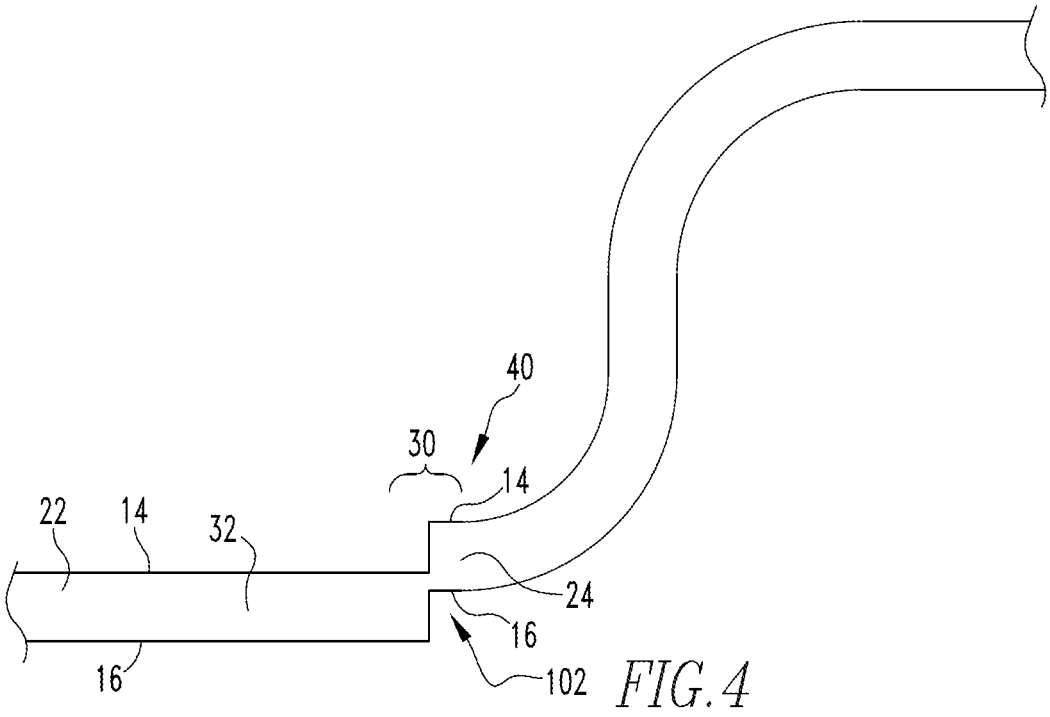
FIG. 4 is another schematic cross-sectional view of a shifted material line.
Figure 5:
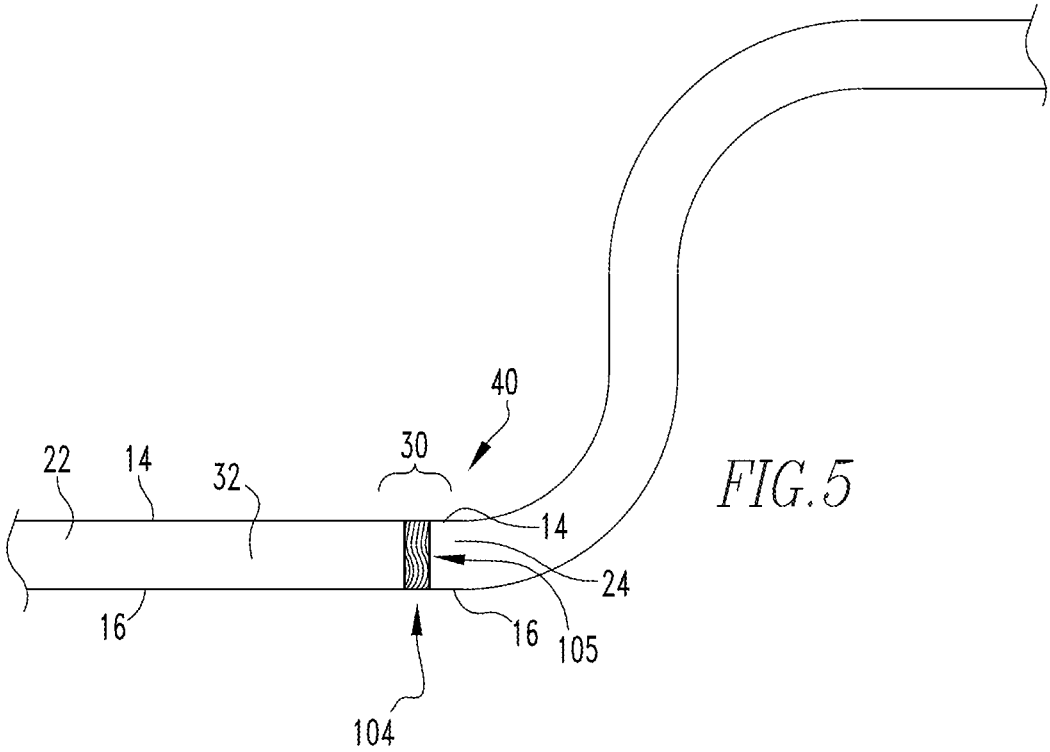
FIG. 5 is another schematic cross-sectional view of a shifted material line.

In another embodiment, shown in FIG. 4, the tooling assembly 520 initially deforms the metal at the shifted material line 30 so as to form a shear line 102, as described above. The tooling assembly 520, in an exemplary embodiment, further moves the first portion 32 and the second portion 34 between a positive shift and a negative shift a number of times, each time deforming the material at the shear line 102. The tooling assembly 520 then deforms the shear line 102 so that the first portion 32 and the second portion 34 are generally in the same plane. In this embodiment, the offset between the first portion 32 and the second portion 34 is not visible, but the material is weaker than un-deformed material. As used herein, a shifted material line 30 wherein the first portion 32 and the second portion 34 are generally in the same plane have a "neutral shift." Further, a shifted material line 30 wherein the first portion 32 and the second portion 34 are generally in the same plane following the formation of a shear line 102 is, as used herein, a "hidden shear line" 104 (FIG. 5). To represent the hidden shear line 104, FIG. 5 schematically shows exaggerated micro-fractures 105. It is understood that the micro-fractures 105 are not visible to the naked eye.

Figure 6:
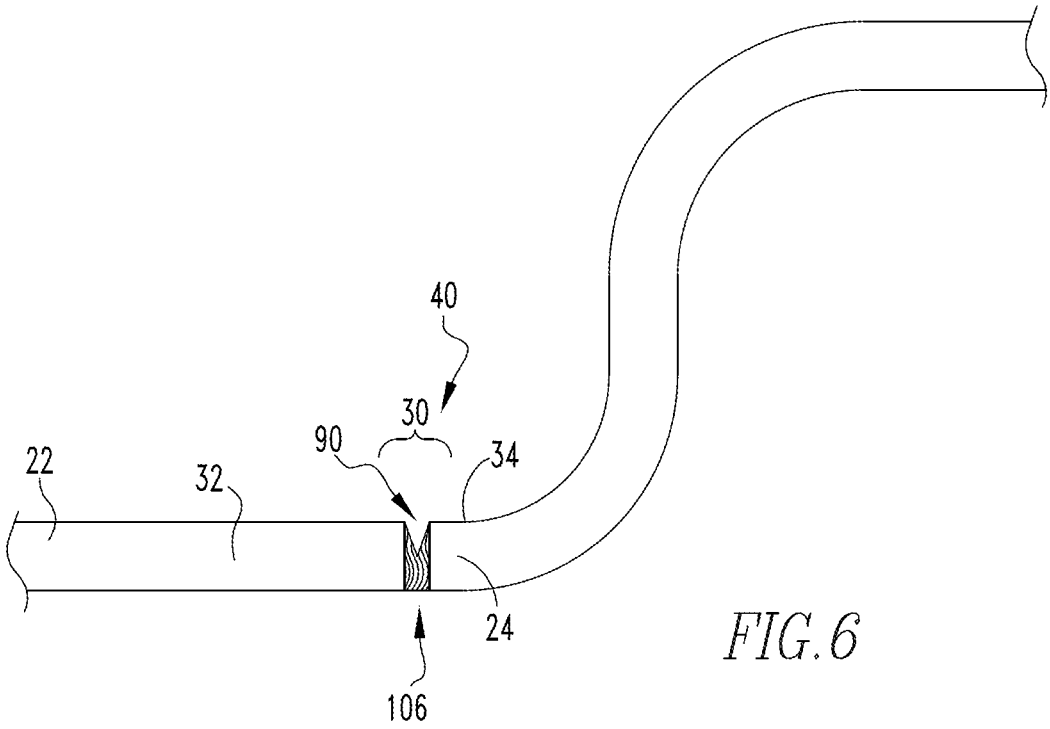
FIG. 6 is another schematic cross-sectional view of a shifted material line.

In another embodiment, shown in FIG. 6, the shifted material line 30 is a relief line 106. In this embodiment as shown, the first portion 32 and second portion 34 are each a generally planar portion. The shifted material line 30 is formed as a hidden shear line 104, as described above. The "relief line" 106 further includes a shifted material score line 90 formed by a blade in the tooling assembly 520. The shifted material score line 90 is disposed on, or immediately adjacent the shifted material line 30, i.e., the hidden shear line 104. As shown, the shifted material score line 90 is disposed on the customer side 16 of the container closure body 12. It is understood, however, that a relief line 106 includes a shifted material score line 90 disposed on either, or both, the product side 14 and the customer side 16 of the container closure body 12.

Figure 7:
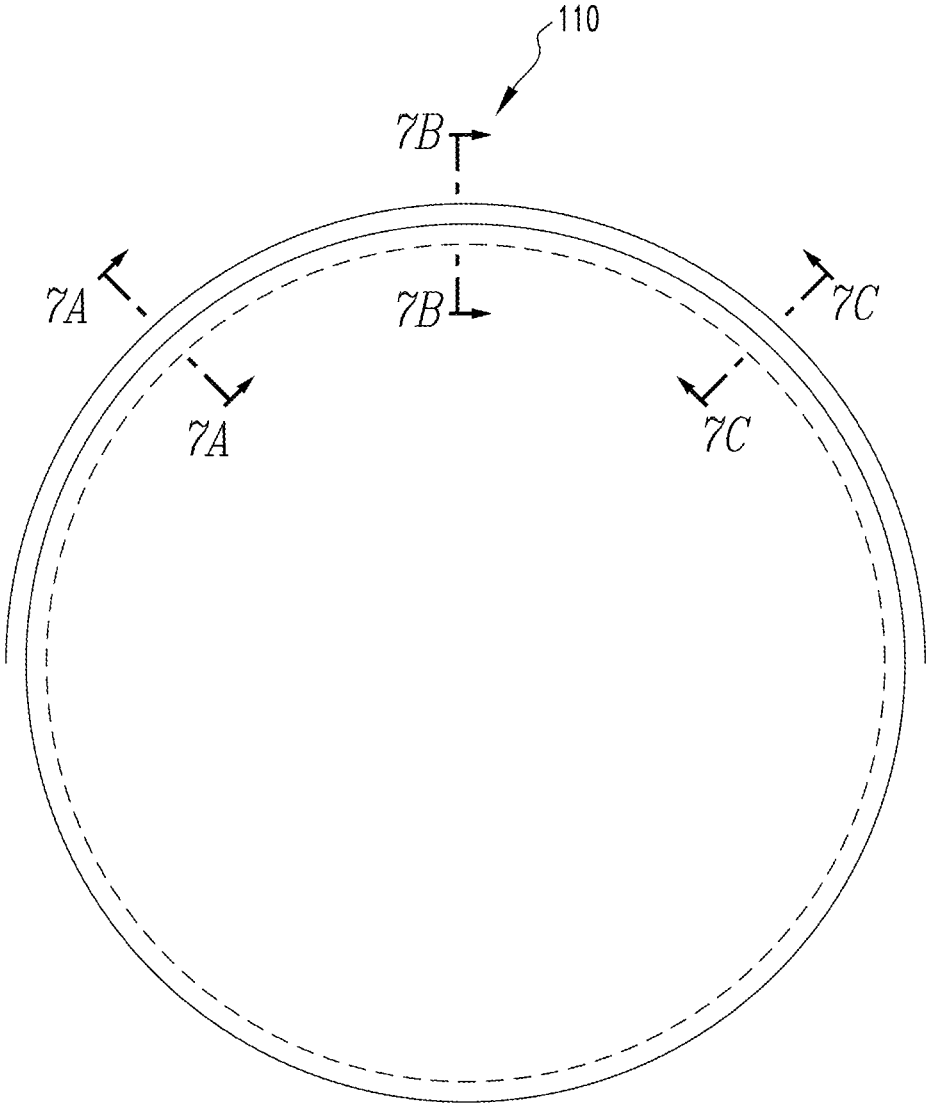
FIG. 7 is a schematic side view of a shifted material line with a mingled shift.
Figure 7A:
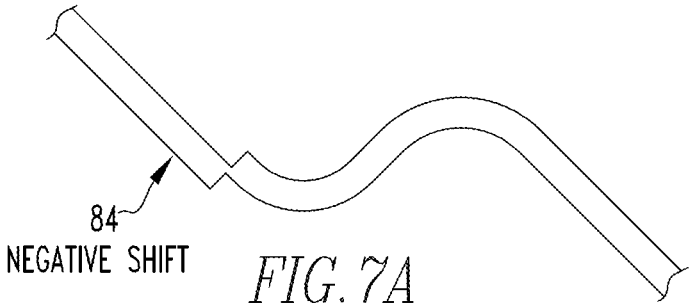
FIG. 7A is a schematic cross-sectional view of a shifted material line as shown in FIG. 7.
Figure 7B:
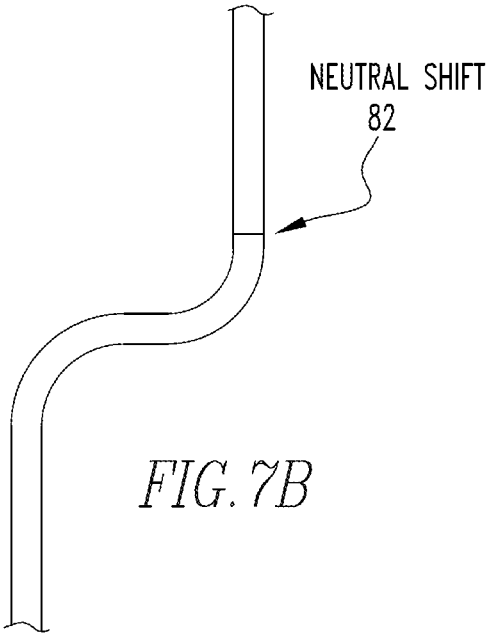
FIG. 7B is another schematic cross-sectional view of a shifted material line as shown in FIG. 7.
Figure 7C:
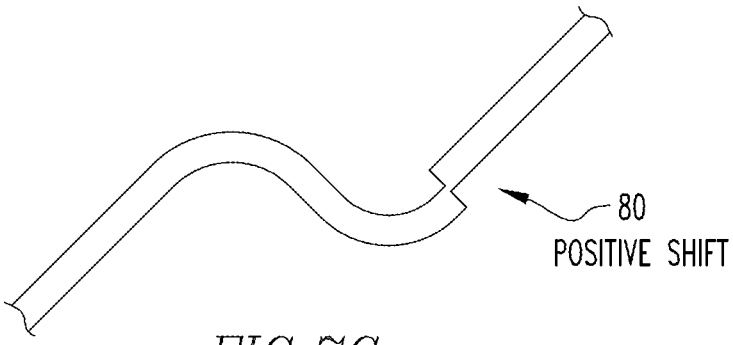
FIG. 7C is another schematic cross-sectional view of a shifted material line as shown in FIG. 7.

In another embodiment, shown in FIG. 7, the shifted material line 30 has a "mingled shift." As used herein, a "mingled shift" is when a shifted material line 30 has a first section 80, a transition section 82 and a second section 84, as shown in FIGS. 7A-7C. The first section 80 has a "positive shift," as described above. The second section 84 has a "negative shift," as described above. The transition section 82 is the section between the first section 80 and the second section 84 wherein there is a "neutral shift," as described above.

Thus, the shifted material line 30 is any one of a relief line 106, a shear line 102, a hidden shear line 104, or a lance line 100. Further, the shifted material line 30 is, in an exemplary embodiment, a combination of two or more of a relief line 106, a shear line 102, a hidden shear line 104, and a lance line 100. As used herein, a shifted material line 30 that includes two or more of a relief line 106, a shear line 102, a hidden shear line 104, and a lance line 100 is a "mingled line" 110.

Figure 10:
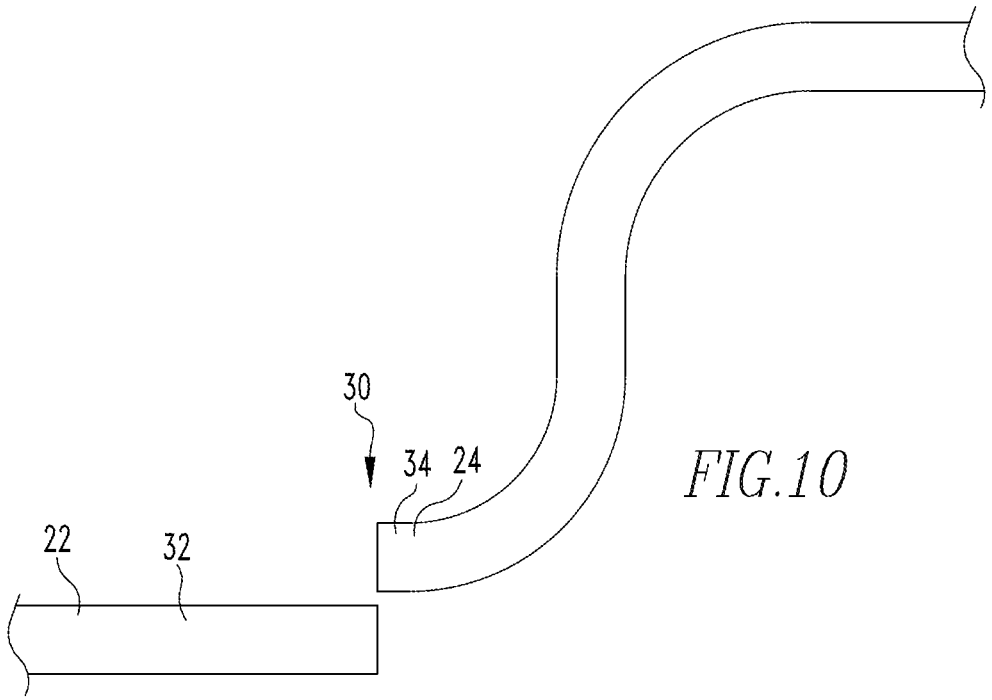
FIG. 10 is another schematic cross-sectional view of a shifted material line.
Figure 11:
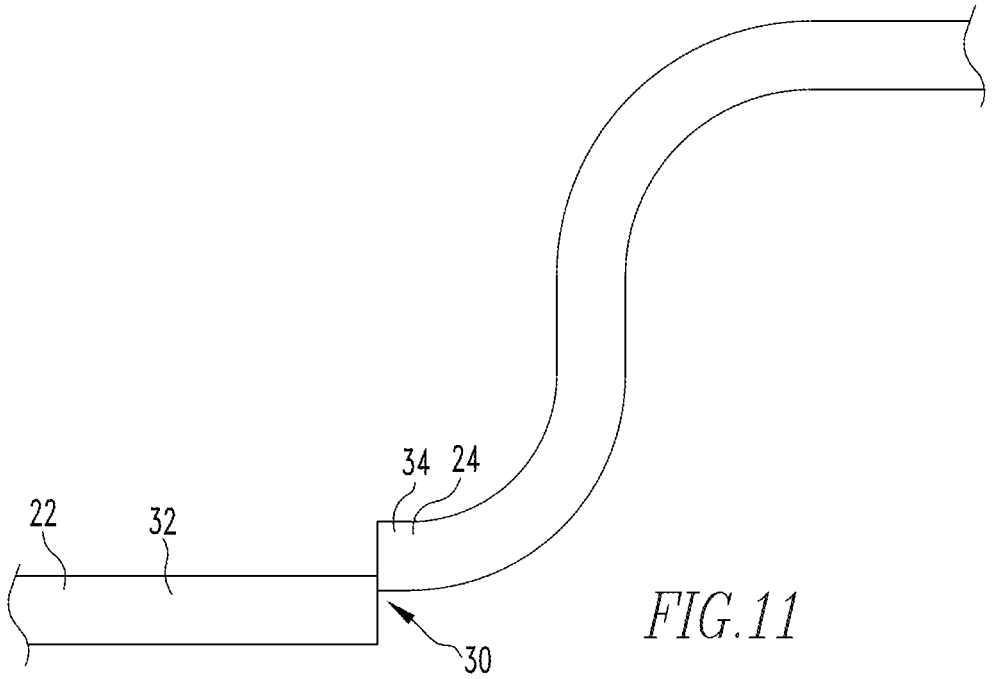
FIG. 11 is another schematic cross-sectional view of a shifted material line.
Figure 12:
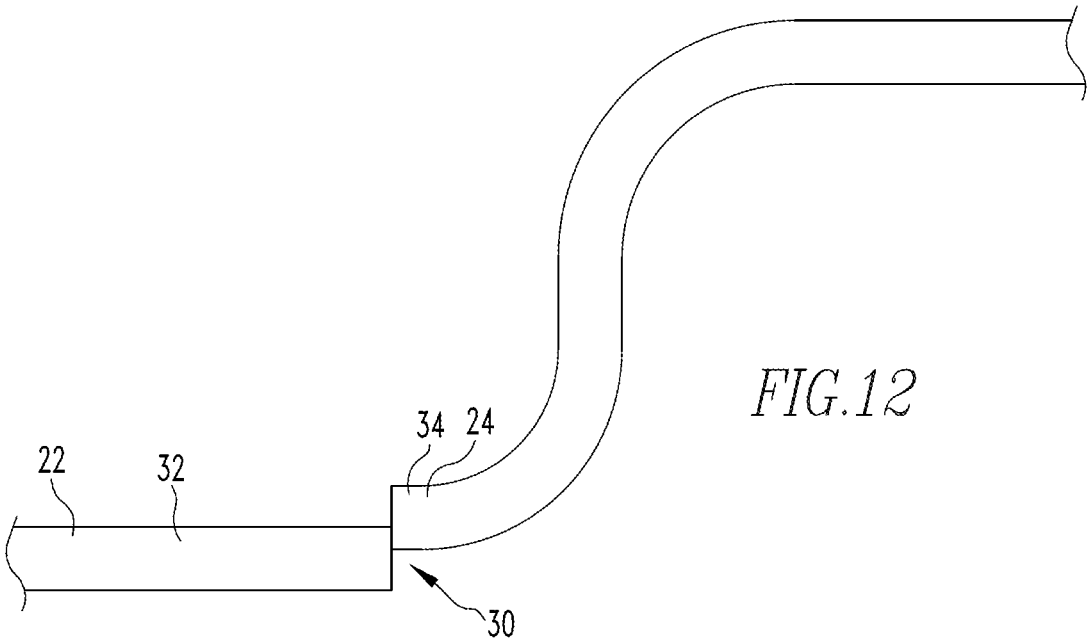
FIG. 12 is another schematic cross-sectional view of a shifted material line.
Figure 13:
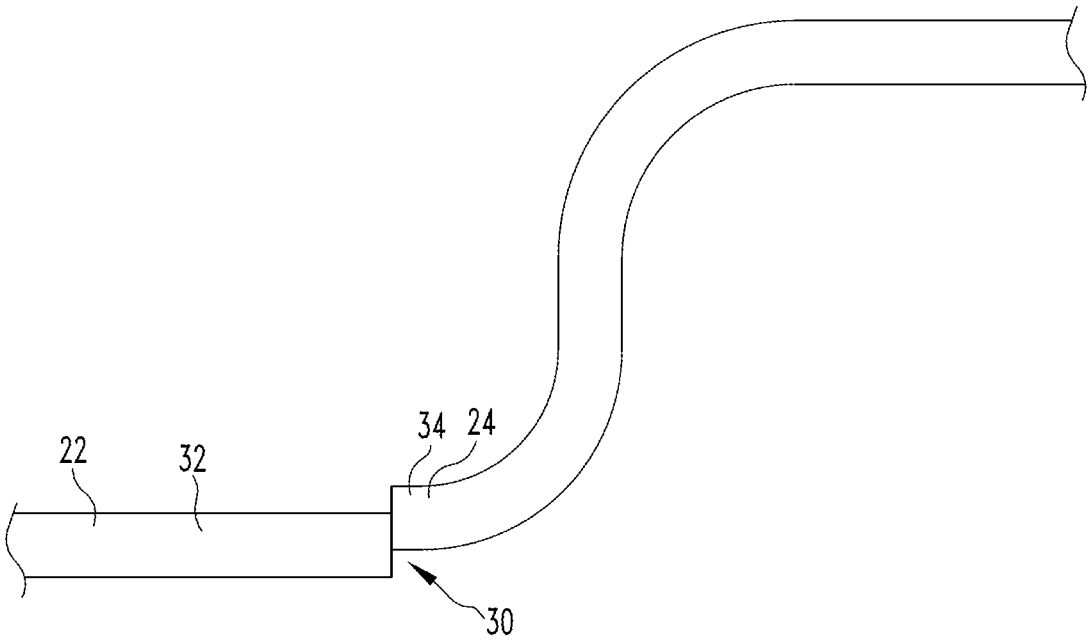
FIG. 13 is another schematic cross-sectional view of a shifted material line.

The shifted material line 30, or alternately the first portion 32 and the second portion 34, have one of a negligible shift (FIG. 14), a minimal shift (FIG. 13), a moderate shift (FIG. 12), a maximum shift (FIG. 11), or a spaced shift (FIG. 10). The "shift," for the purpose of measuring the offset, is measured at the customer side 16 of each of the first portion 32 and the second portion 34. As used herein, a "negligible shift" means that the first portion 32 and the second portion 34 have an offset of between 0% and 10%, or about 5% of the thickness of the container closure body 12 at the shifted material line 30. In an exemplary embodiment, a relief line 106 has a "negligible shift" between the first portion 32 and the second portion 34. As used herein, a "minimal shift" means that the first portion 32 and the second portion 34 have an offset of between 10% and 20%, or about 15% of the thickness of the container closure body 12 at the shifted material line 30. As used herein, a "moderate shift" means that the first portion 32 and the second portion 34 have an offset of between 20% and 40%, or about 30% of the thickness of the container closure body 12 at the shifted material line 30. As used herein, a "maximum shift" means that the first portion 32 and the second portion 34 have an offset of between 40% and 250%, or about 100% of the thickness of the container closure body 12 at the shifted material line 30. As used herein, a "spaced shift" means that the first portion 32 and the second portion 34, at the interface thereof, are not in the same plane and are separated.

Figure 14:
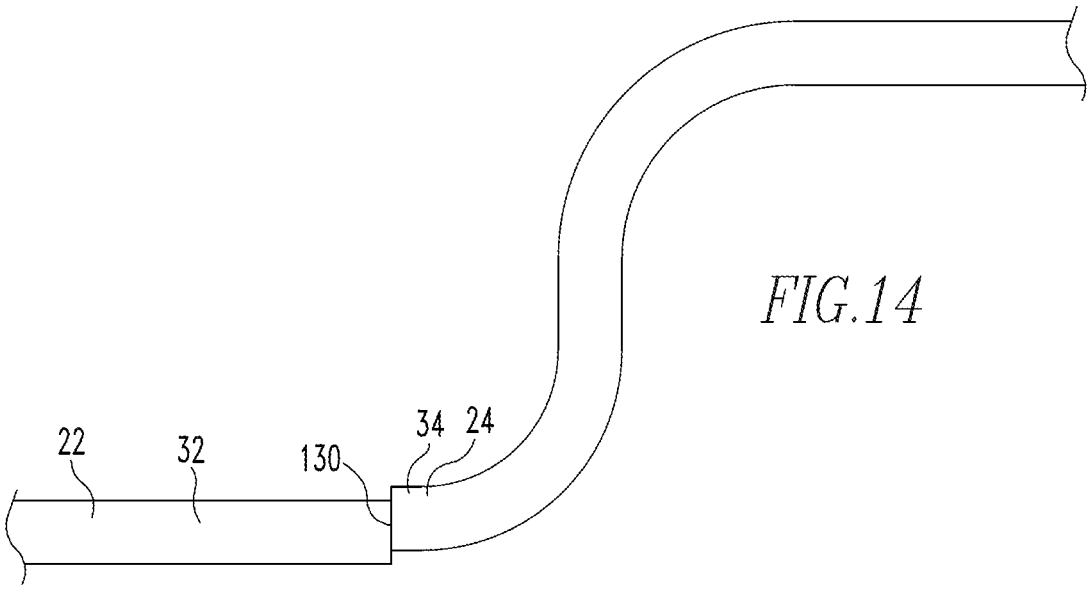
FIG. 14 is another schematic cross-sectional view of a shifted material line.

As defined above, the shifted material line 30 defines a plane that separates the first portion 32 and the second portion 34. That is, the thickness of the container closure body 12 at the shifted material line 30 defines a plane which, as used herein, is the "plane of separation" 130. That is, the plane of separation 130 is the plane passing through the container closure body 12 at the shifted material line 30, i.e., the plane visible when the when container closure body 12 is viewed in cross-section, as shown in FIG. 14. Further, in the examples above, the first portion 32 and the second portion 34 are each shown as generally planar portions. In this configuration, the plane of separation 130 is generally perpendicular to the plane of the container closure body 12. As used herein, when the plane of separation 130 is generally perpendicular to the plane of the container closure body 12 it is, as used herein, a "normal plane."

Figure 15:
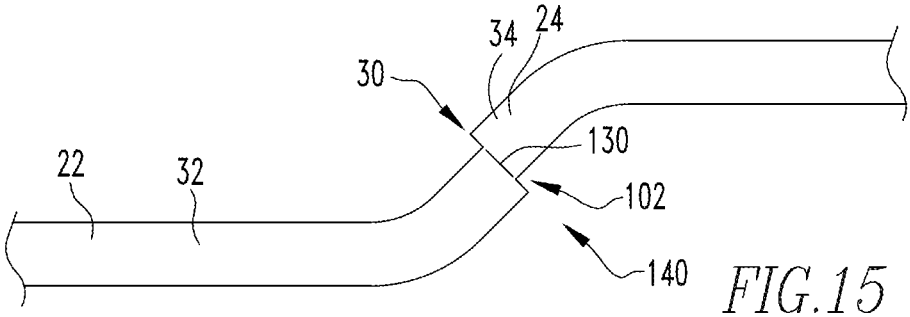
FIG. 15 is another schematic cross-sectional view of a shifted material line.
Figure 16:
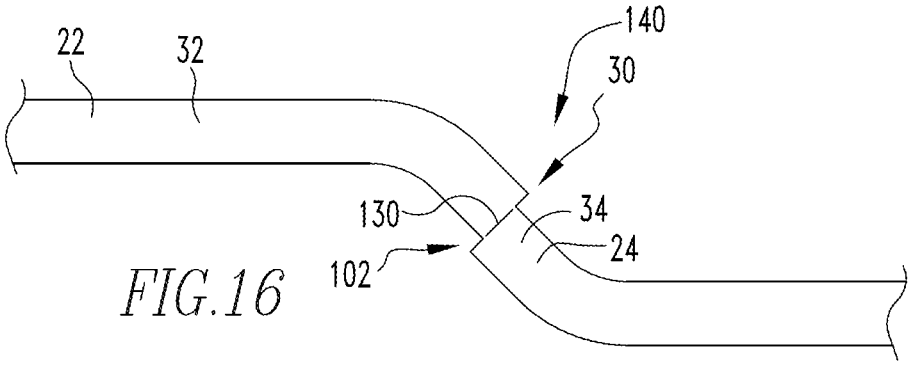
FIG. 16 is another schematic cross-sectional view of a shifted material line.

In another exemplary embodiment, shown in FIGS. 15 and 16, the container closure body 12 includes, i.e., is formed with, an angled portion 140. That is, the angled portion 140 is angled relative to the plane of the generally planar container closure body 12. In an exemplary embodiment, the shifted material line 30 is disposed on the angled portion 140. The shifted material line 30 may be formed before, during, or after, the deformation that angles the angled portion 140 relative to the plane of the generally planar container closure body 12. When the shifted material line 30 is disposed on the angled portion 140 and when the tear panel 24 has a positive shift, the plane of separation 130 is, as used herein, a "positive plane." When the shifted material line 30 is disposed on the angled portion 140 and when the tear panel 24 has a negative shift, the plane of separation 130 is, as used herein, a "negative plane." When the plane of separation 130 includes portions that are both a positive plane and a negative plane, the plane is, as used herein, a "mingled plane."

Figure 17:
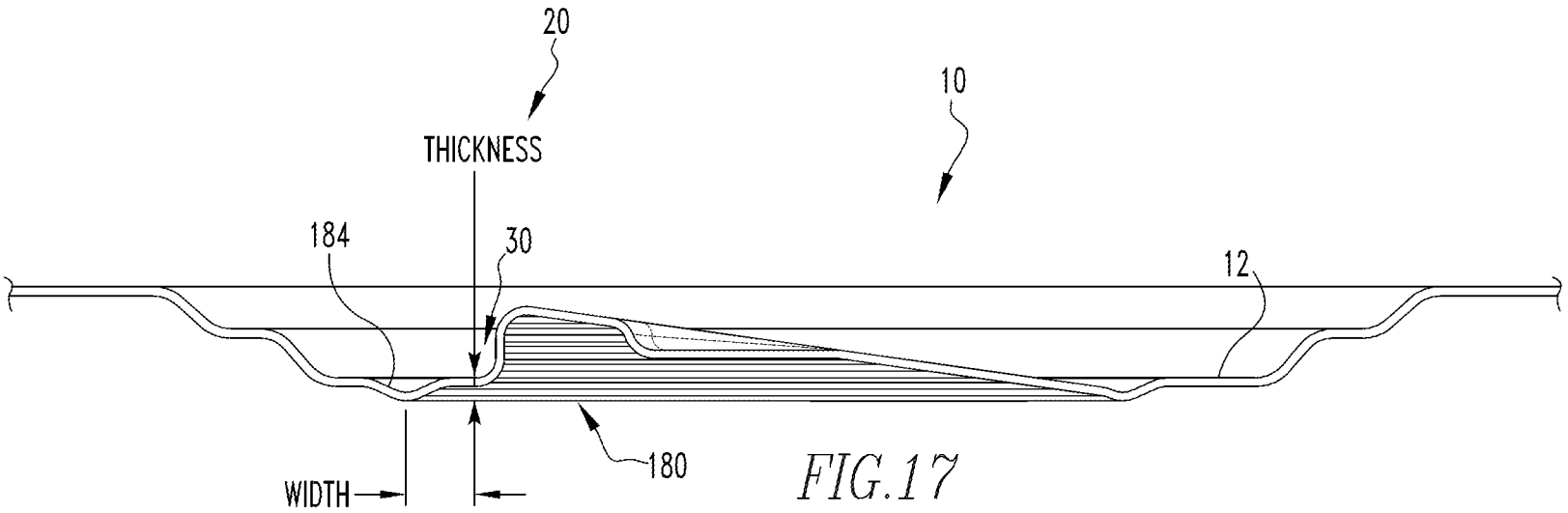
FIG. 17 is a schematic cross-sectional view of a lid with a button defined by a shifted material line with sealant.
Figure 18:
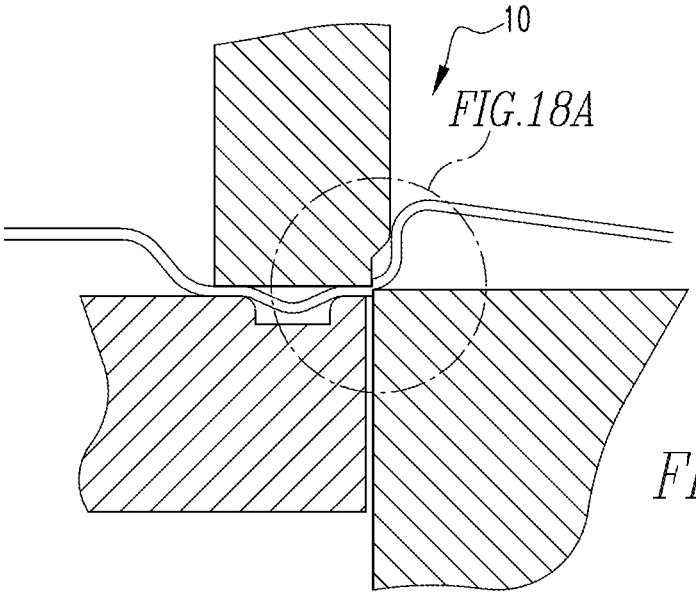
FIG. 18 is a schematic cross-sectional view of a tooling assembly that forms a shifted material line.
Figure 18A:
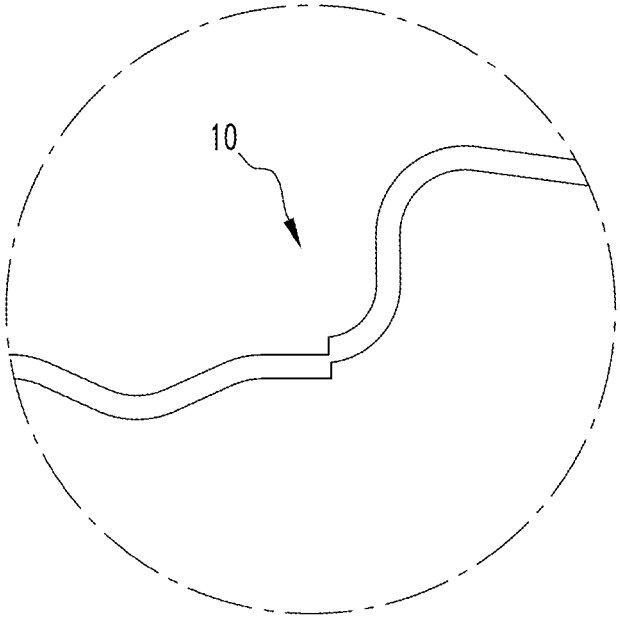
FIG. 18A is a detailed view of the shifted material line in FIG. 18.

In the exemplary embodiments shown in FIG. 17, the first portion 32 and the second portion 34 are shown as being generally planar, and, as defined above, the first portion 32 and the second portion 34 must have been at some time, generally planar with each other. In another exemplary embodiment, either of the first portion 32 and/or the second portion 34 are not generally planer. For example, as shown in FIG. 17, the second portion 34, that is, the tear panel 24 has been formed into a button 600. That is, the second portion 34 is generally curvilinear, or generally arcuate, when viewed in cross-section as shown in FIG. 17.

Further, it is noted that the shifted material line 30 in one exemplary embodiment extends completely about the tear panel 24, such as, but not limited to, a container closure for a food can. In another exemplary embodiment, the shifted material line 30 does not extend completely about the tear panel 24, such as, but not limited to, a container closure for a beverage can or on a lid. In the latter embodiment, it is understood that the shift between the first portion 32 and the second portion 34 diminishes to no shift at the ends of the shifted material line 30.

In an exemplary embodiment, the container opening 20 is sealed by a sealant 180 (or sealing material 180). Thus, as used herein, the sealant 180 is identified as part of the container opening 20. The sealant 180 is structured to, and does, create a substantially fluid proof barrier. As used herein, a "substantially fluid proof barrier" means that the barrier does not include any passages through which a fluid passes. A "substantially fluid proof barrier" does not mean that the fluid cannot penetrate the barrier at a molecular level. In an exemplary embodiment, and as shown in FIG. 17, the sealant 180 is applied to the product side 14 of the container closure body 12 at the container opening 20. It is understood that, in other exemplary embodiments, not shown, the sealant 180 is applied to the customer side 16, or both the product side 14 and the customer side 16, of the closure body 12 at the container opening 20. In an exemplary embodiment, the sealant 180 has a thickness of between about 0.010 inch and 0.030 inch, or between about 0.015 inch and 0.025 inch, or about 0.020 inch. The sealant 180 "thickness" is, as used herein, measured in a direction generally perpendicular to the plane of the container closure body 12 and at a location adjacent the shifted material line 30, as shown in FIG. 17, but not at a location defined by the button 600, i.e., a location wherein the button 600 defines a recess into which sealant 180 is disposed. Further, the sealant has a minimum width of about 0.020 inch, or about 0.010 inch, or about 0.005 inch. As used herein, the sealant 180 "width" is measured in a direction generally parallel to the plane of the container closure body 12 and from the shifted material line 30. It is understood that the sealant 180 may extend further in one direction from the shifted material line 30 than in the other; thus, the "minimum" width is measured toward the side of the shifted material line 30 having the lesser amount of sealant 180.

Further, in an exemplary embodiment, the container closure body 12 defines a sealant recess 182 adjacent the shifted material line 30. That is, the container closure body 12 includes a protrusion 184 extending from, i.e., away from, the side of the container closure body 12 to which the sealant 180 is applied. Thus, in an exemplary embodiment, wherein the sealant 180 is applied to the product side 14 of the container closure body 12, the protrusion 184 extends from the product side 14 of the container closure body 12. The sealant recess 182 extends generally about the shifted material line 30.

The following describes a press assembly 510 structured to form a lid with a button 600 as well as a shifted material line 30. It is understood that this is an example and other presses, not shown, are structured to form beverage can closures or food can closures. Further, in this example, the elements of the forming elements of the tooling assembly 520, discussed below, are generally circular and each station 526, discussed below, has a centerline.

In an exemplary embodiment, a press assembly 510, shown schematically in FIGS. 19-27, includes a reciprocating ram assembly 512 and a tooling assembly 520. The tooling assembly 520 includes an upper tooling 522 and a lower tooling 524. The upper tooling 522 is coupled to the ram assembly 512 and reciprocates between a first position, wherein the upper tooling 522 is spaced from the lower tooling 524, and a second position, wherein the upper tooling 522 is adjacent or immediately adjacent the lower tooling 524. It is understood that sub-components of the upper tooling 522 and the lower tooling 524 can move independently of other portions thereof, but when the upper tooling 522 is in the first position, the tooling assembly 520 does not engage the blank so as to form the blank. As used herein, to "form" means to alter the shape of the blank. The tooling assembly 520, or elements thereof, engage the blank to move the blank between stations 526.

As is known, a feed assembly (not shown) moves a blank through the tooling assembly 520 in a series on intermittent steps which is also known as indexing. In an exemplary embodiment, the blank is a generally circular, metal lid. The tooling assembly 520 includes a number of stations 526. Each time the blank stops moving, the blank is disposed at a new station or an idle station (not shown) wherein no forming operations occur. In an exemplary embodiment, and as the example provided herein, the blanks are jar lids structured to be threadably coupled (screwed onto) jars. As is known, the blanks include a generally planar top wall with a depending sidewall. The depending sidewall includes a curled lip. The height of the depending sidewall defines the height of the blank. The plane defined by the intersection of the top wall and the sidewall is, as used herein, the chime line. As is further known, in an exemplary embodiment, the blank is formed with a generally planar center panel which is downwardly offset relative to the chime line. That is, the offset distance between the distal end of the sidewall and the chime line is greater than the offset distance between the distal end of the sidewall and the plane of the center panel. In an exemplary embodiment, the blank center panel has an initial thickness of between about 0.770 inch and 0.790 or about 0.180 inch. As is known, the area, or a portion of the area, between the center panel and the sidewall may be filled with a resilient and/or sealing material. Further, as is known, the blank includes a product side (which is generally exposed to the product in the jar) and a consumer side (which is generally exposed to the atmosphere). In an exemplary embodiment, the blank is steel.

In an exemplary embodiment, the blank is a generally circular and includes a center. In this embodiment, the center of the bubble (or first and second bubble) is offset from the center of the blank. Thus, when the bubble is formed into the button, the center of the button is disposed at, or substantially at, the center of the blank. In another embodiment, the center of the button 600, i.e., a cylindrical angled button 600, is aligned with or directly on the center of the blank. It is noted that, in this configuration, the high point of the angled button is disposed substantially at the same location as the corresponding surface of the dome.

In an exemplary embodiment, and as shown in FIGS. 29-33, the tooling assembly 520 is structured to form a lid 596 with a venting assembly 598, wherein the venting assembly 598 includes an angled button 600. That is, in an exemplary embodiment, the tooling assembly 520 includes a number of forming stations 530 including a number of bubble forming stations 540, a number of button forming stations 550, as well as a number of scoring stations 560 and/or shifted material line stations 700. The scoring stations 560 or shifted material line stations 700 define the tear panel 24 which includes the angled button 600. The number of button forming stations 550 includes a station structured to form an angled button 600.

Figure 19C:
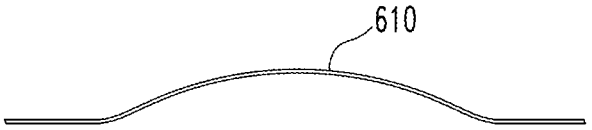
FIG. 19C is a cross-sectional side view of a blank following forming in a first stage bubble station.
Figure 20:
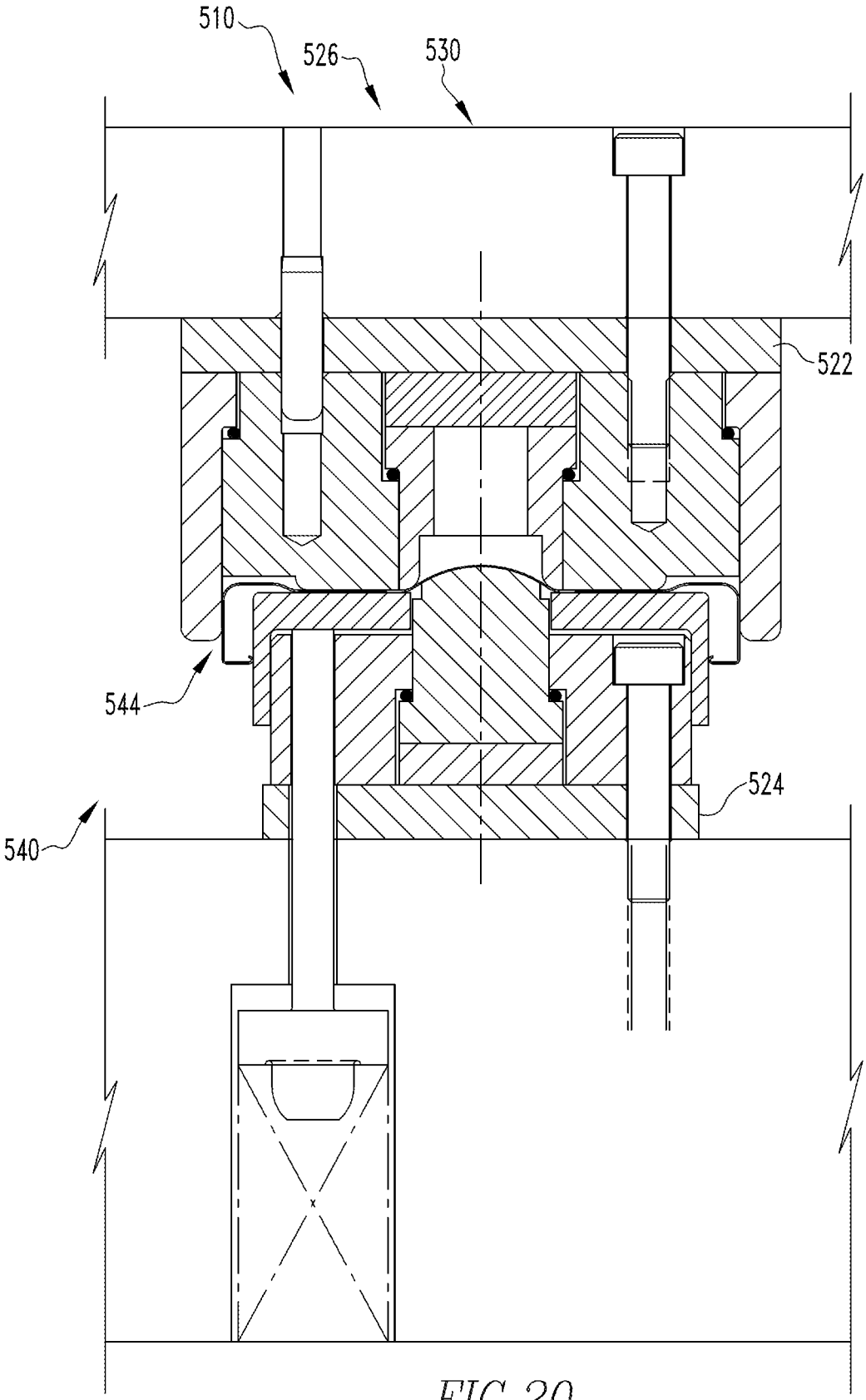
FIG. 20 is a cross-sectional view of a press assembly second stage bubble station.
Figure 20A:
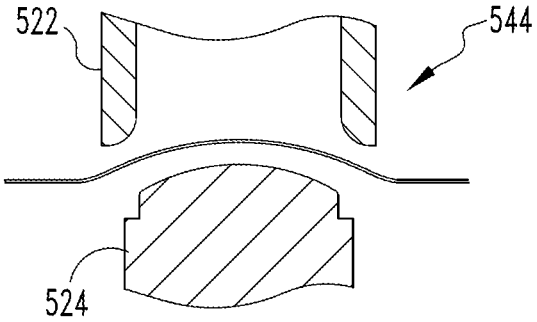
FIG. 20A is a detailed schematic view of the press assembly second stage bubble station about to act on a blank.
Figure 20B:
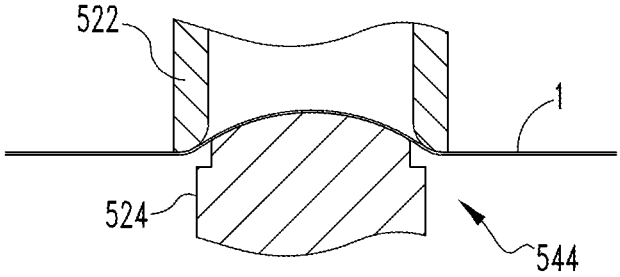
FIG. 20B is a detailed schematic view of the press assembly second stage bubble station forming a second stage bubble in the blank.
Figure 20C:
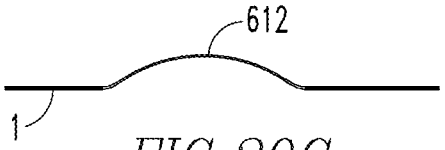
FIG. 20C is a cross-sectional side view of a blank following forming in a second stage bubble station.
Figure 20D:
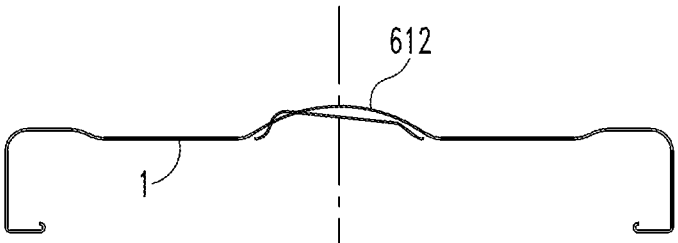
FIG. 20D is a cross-sectional side view of a blank with a centered bubble following forming in a second stage bubble station.
Figure 20E:
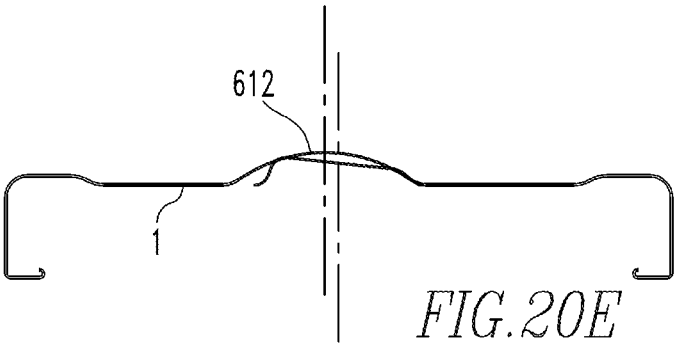
FIG. 20E is a cross-sectional side view of a blank with an offset bubble following forming in a second stage bubble station.
Figure 21:
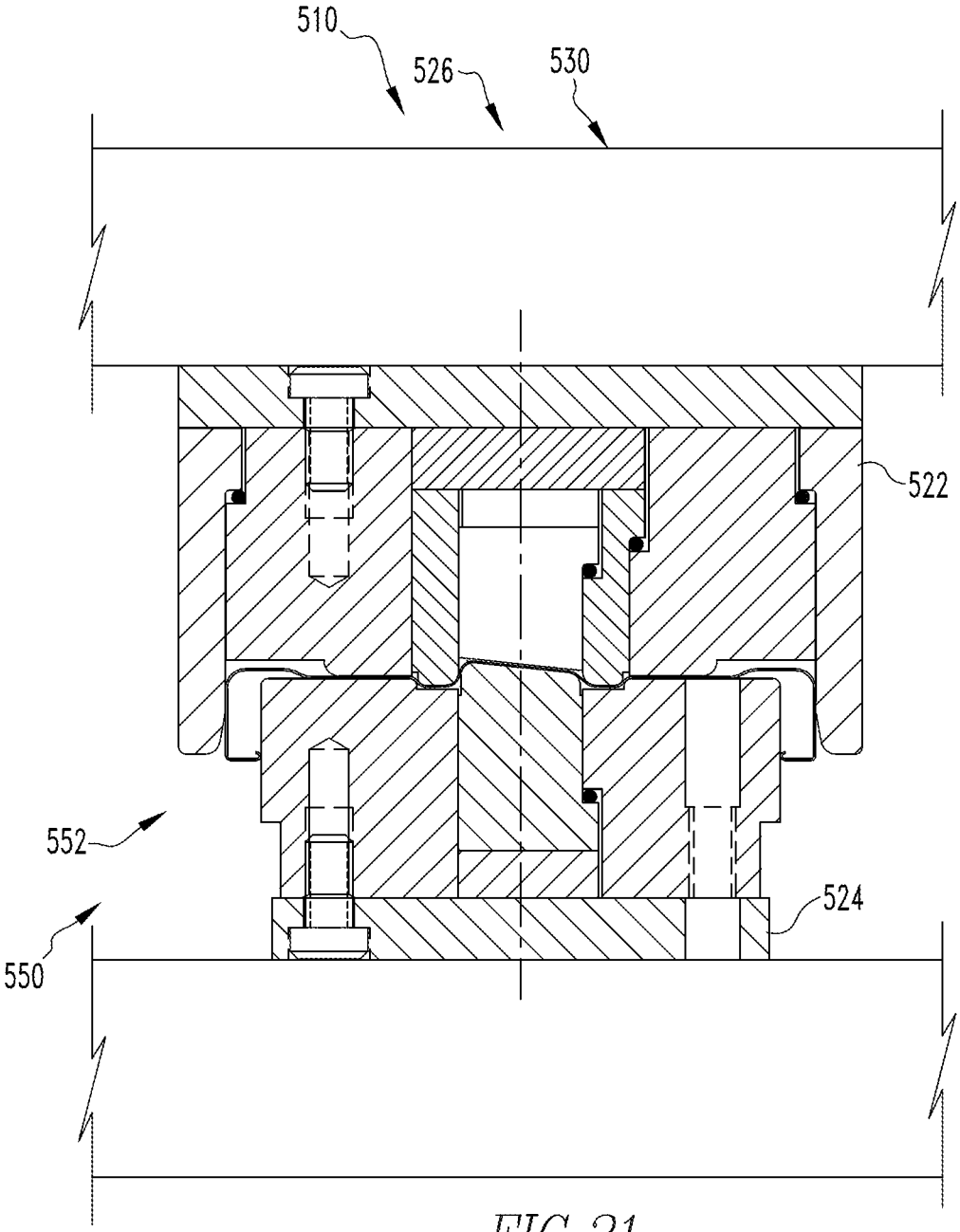
FIG. 21 is a cross-sectional view of a press assembly first stage button station.
Figure 21A:
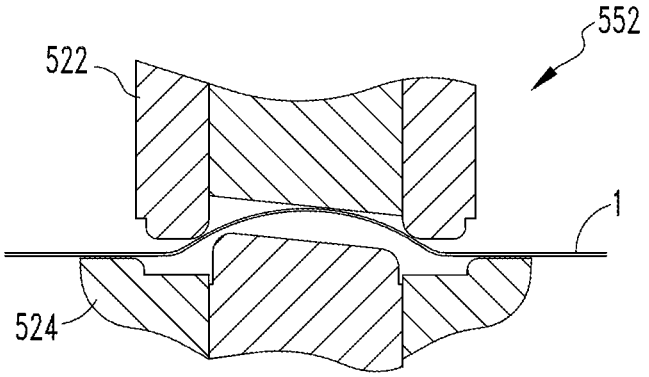
FIG. 21A is a detailed schematic view of the press assembly first stage button station about to act on a blank.
Figure 21B:
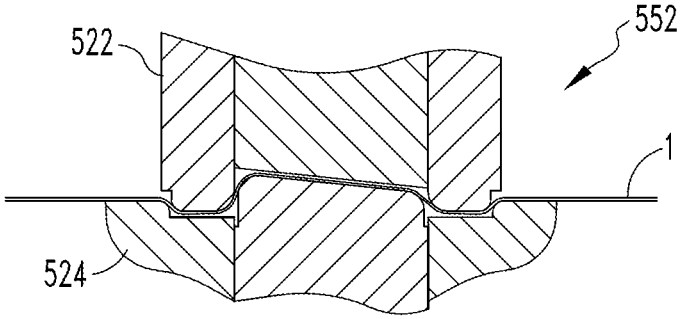
FIG. 21B is a detailed schematic view of the press assembly first stage button station forming a first stage button in the blank.
Figure 21C:
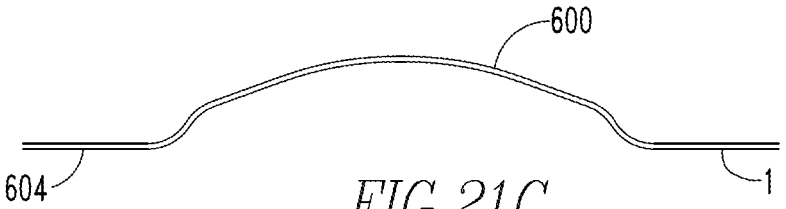
FIG. 21C is a first cross-sectional side view of a blank following forming in a first stage button station.
Figure 21D:
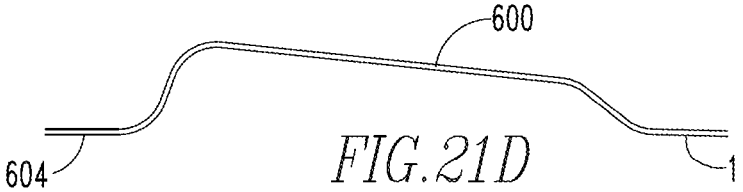
FIG. 21D is a second cross-sectional side view of a blank with a first stage button following forming in a first stage button station.
Figure 22:
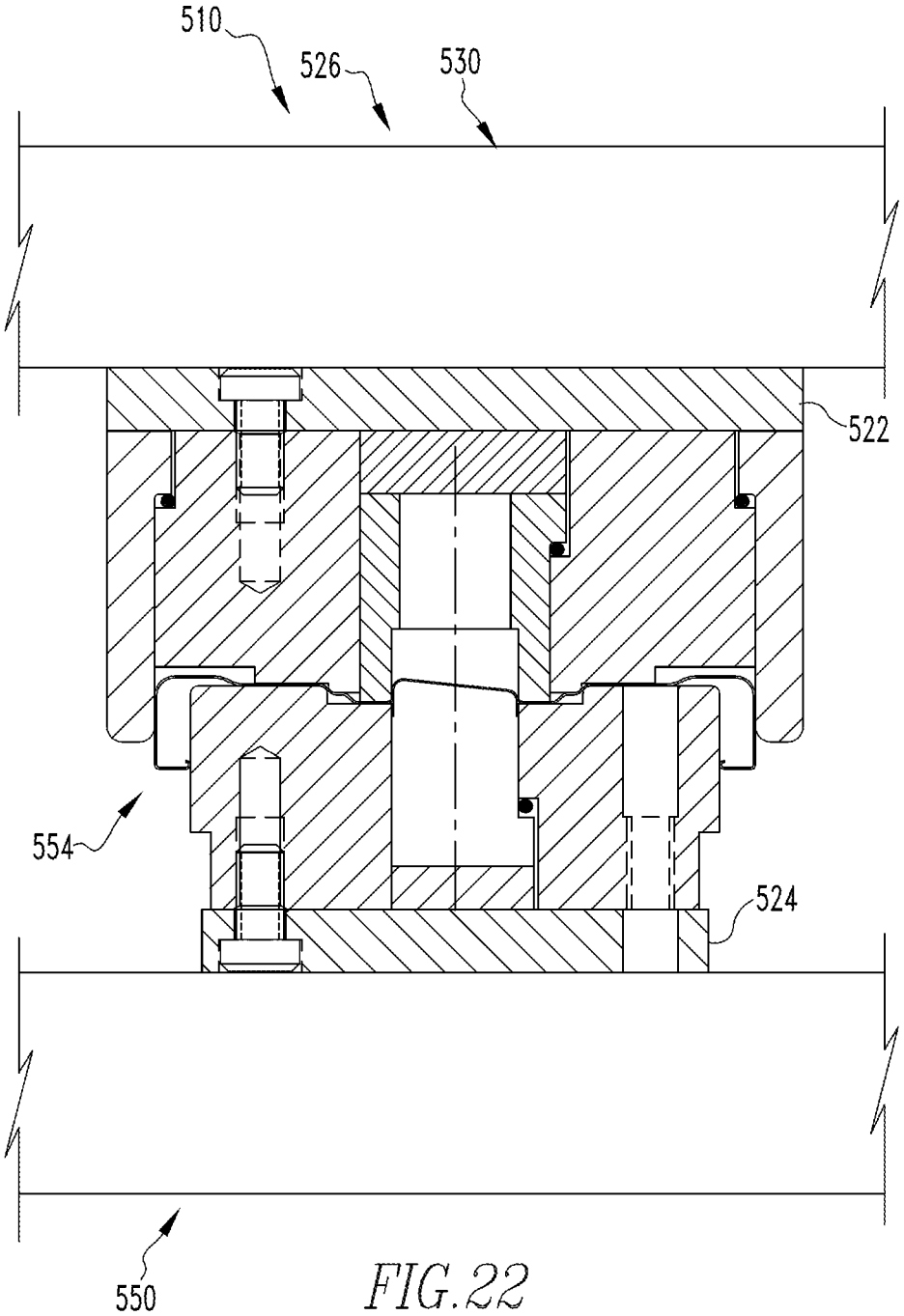
FIG. 22 is a cross-sectional view of a press assembly second stage button station.
Figure 22A:
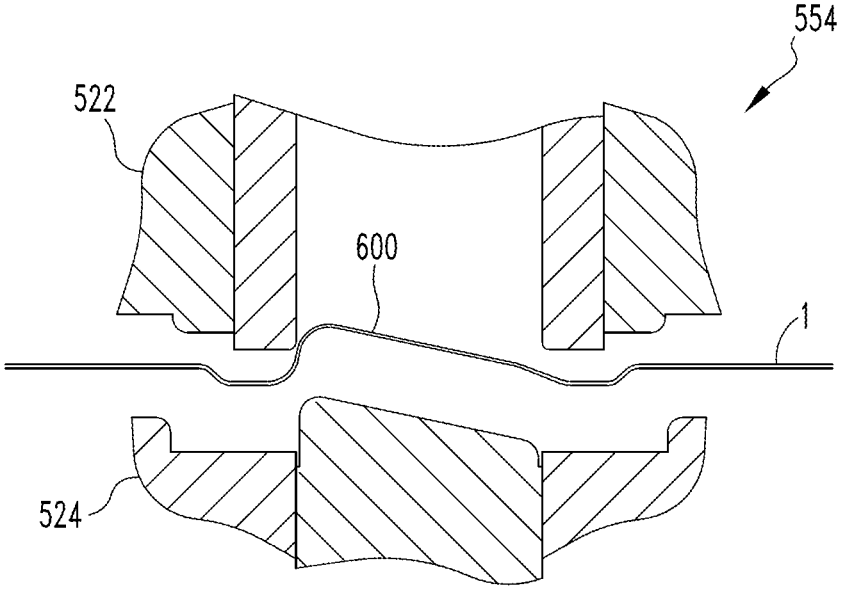
FIG. 22A is a detailed schematic view of the press assembly second stage button station about to act on a blank.
Figure 22B:
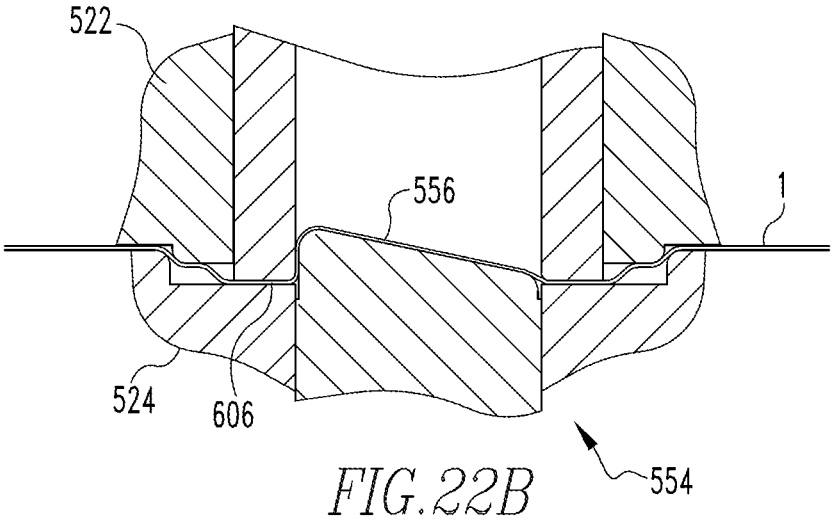
FIG. 22B is a detailed schematic view of the press assembly second stage button station forming a second stage button in the blank.
Figure 23:
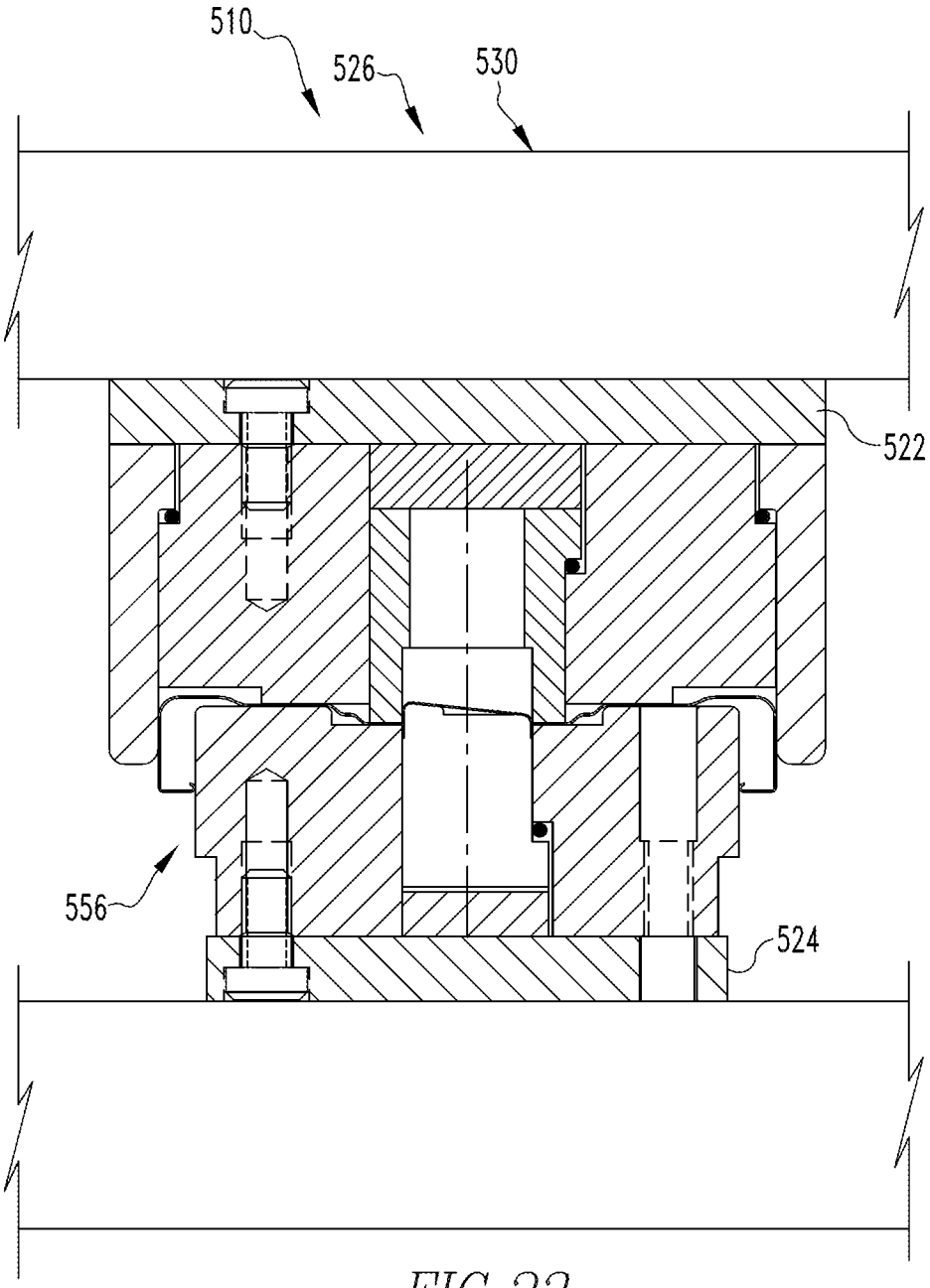
FIG. 23 is a cross-sectional view of a press assembly third stage button station.
Figure 23A:
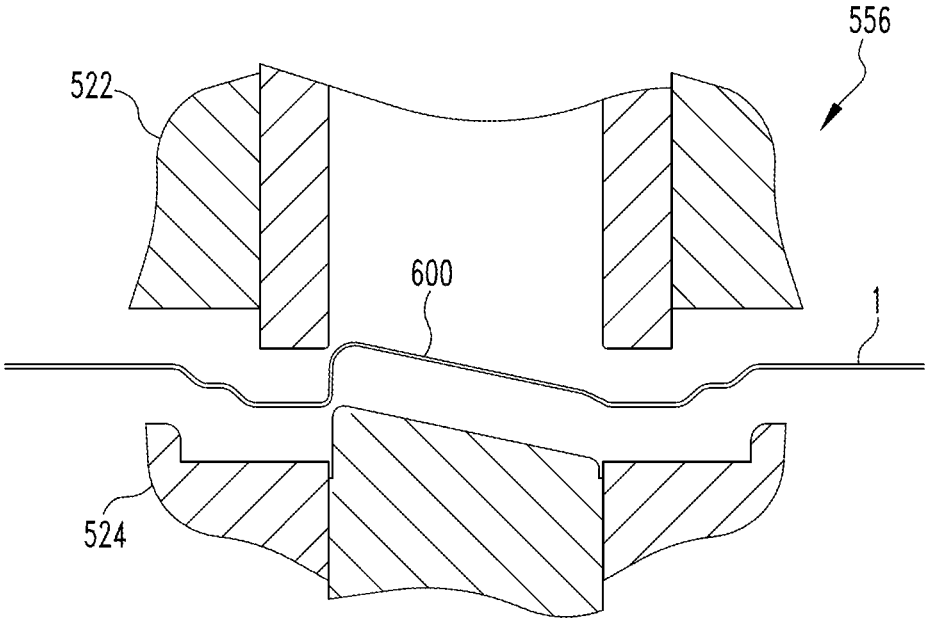
FIG. 23A is a detailed schematic view of the press assembly third stage button station about to act on a blank.
Figure 23B:
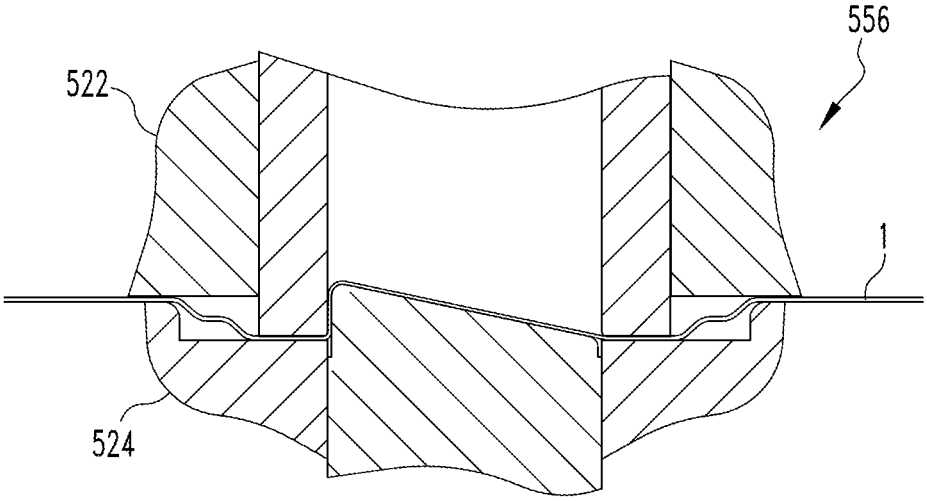
FIG. 23B is a detailed schematic view of the press assembly third stage button station forming a third stage button in the blank.

In an exemplary embodiment, the number of bubble forming stations 540 includes a first bubble forming station 542 and a second bubble forming station 544. The first bubble forming station 542 is structured to form a first bubble 610 (FIG. 19C) wherein the first bubble 610 has a dome radius between about 0.770 and 0.790 inch, and, a base radius between 0.180 and 0.200 inch. Further, in an exemplary embodiment, the first bubble forming station 542 is structured to form a first bubble wherein the first bubble has a dome radius of about 0.780 inch and, a base radius of about 1.190 inch. The second bubble forming station 544 is structured to form a first bubble into a second bubble 612, FIG. 20C, wherein the second bubble has a dome radius between about 0.520 and 0.540 inch and, a base radius between about 0.070 and 0.090 inch. In an exemplary embodiment, the second bubble forming station 544 is structured to form a first bubble into a second bubble, wherein the second bubble has a dome radius of about 0.530 inch and, a radius of about 0.080 inch. It is noted that each bubble has a center.

In an exemplary embodiment, the number of button forming stations 550 includes a first button station 552, a second button station 554, and a third button station 556. The first button station 552 is structured to form a bubble, or dome, into a flattened button. Further, in an exemplary embodiment, the first button station 552 is structured to form a bubble, or dome, into a cylindrical flattened button which has a center. Further, the first button station 552 is structured to form the cylindrical flattened button 602 so that the center of the cylindrical flattened button is offset relative to the position of the second bubble. Further, the first button station 552 is structured to form a generally planar inner panel 604 disposed about the flattened button 602. The inner panel 604 is downwardly offset relative to the blank center panel.

In an exemplary embodiment, and as shown in FIGS. 19-23B, the second button station 554 is structured to form a step, i.e., a downwardly offset tier 606, in the inner panel 604 as well as form the flattened button 602 into an angled button 600. The third button station 556 is structured to increase the height of the angled button 600 relative to the offset tier 606. In an exemplary embodiment, the angled button 600 has one of a "limited height" or a "very limited height" relative to the offset tier 606. Further, the number of button forming stations 550 are structured to form a cylindrical angled button 600 with one of a sharp radius or a very sharp radius.

Figure 24:
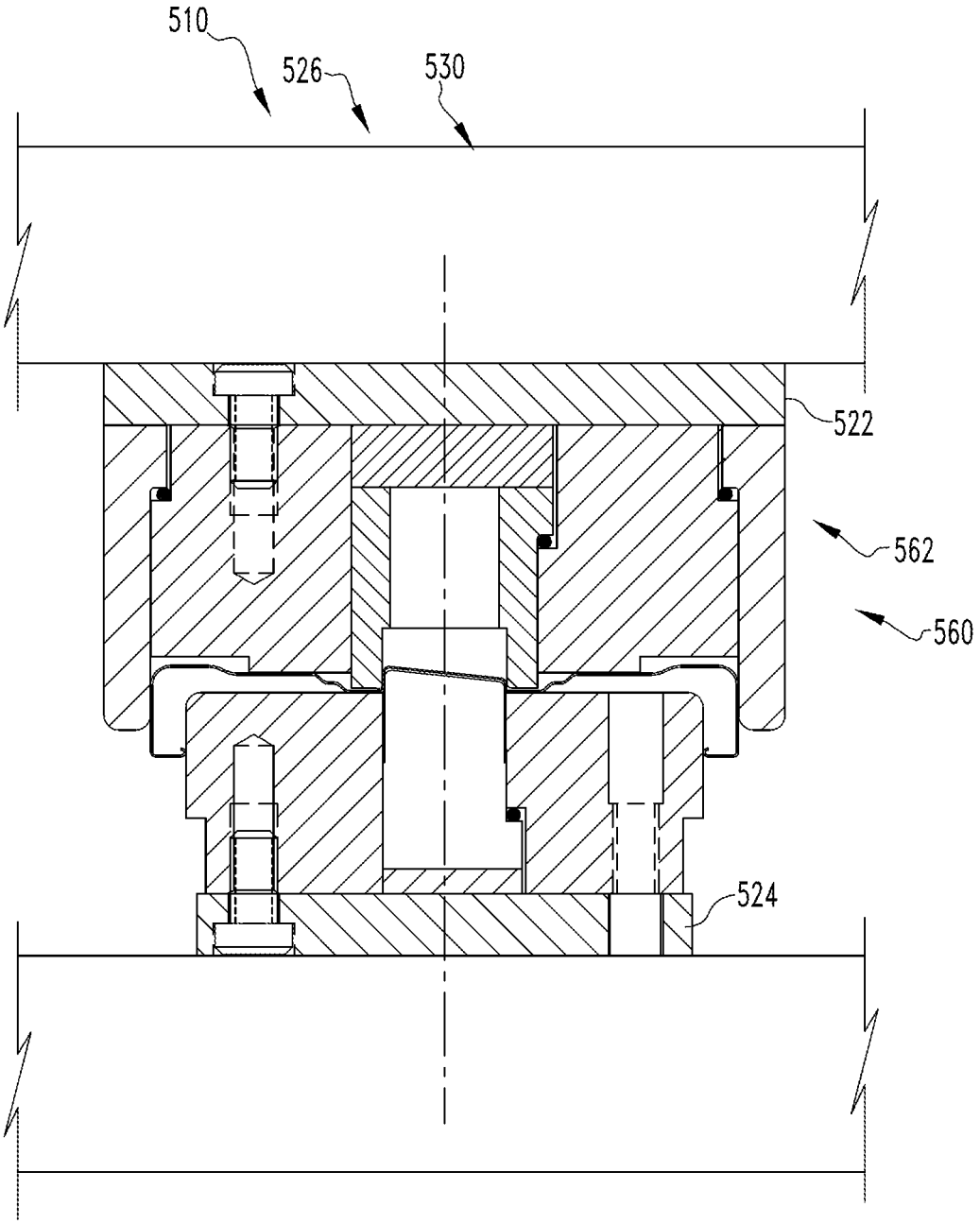
FIG. 24 is a cross-sectional view of a press assembly score station.
Figure 24A:
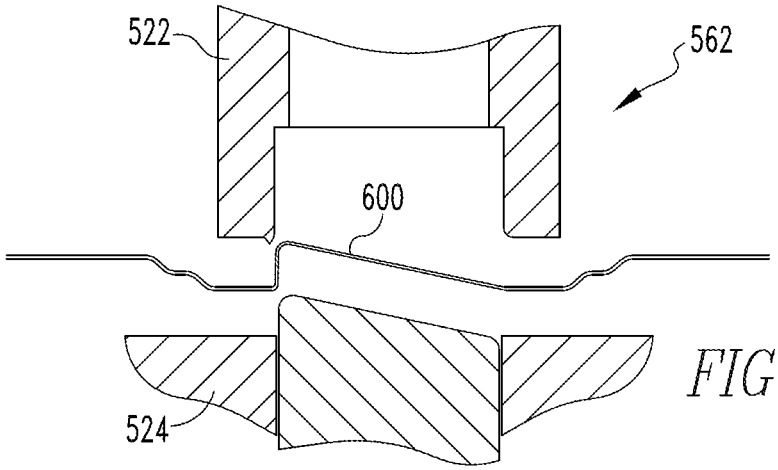
FIG. 24A is a detailed schematic view of the press assembly score station about to act on a blank.
Figure 24B:
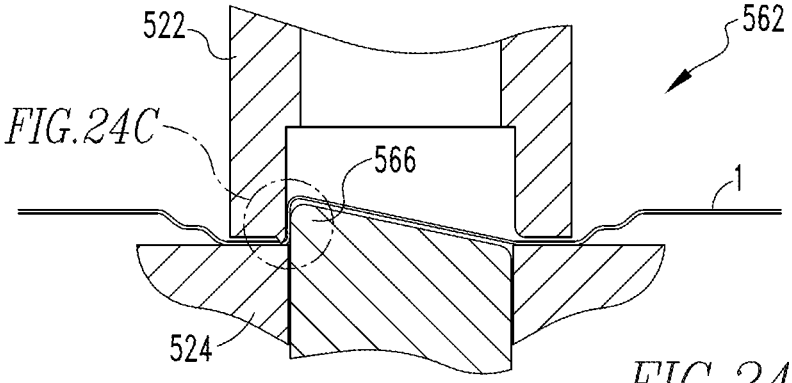
FIG. 24B is a detailed schematic view of the press assembly score station forming a score in the blank.
Figure 24C:
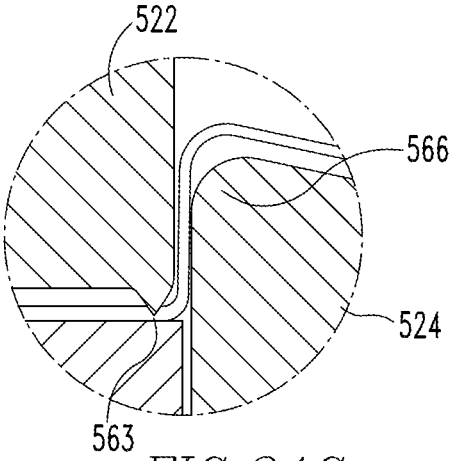
FIG. 24C is a detailed schematic view of the press assembly score station score blade.

In one exemplary embodiment, and as shown in FIGS. 24-24, the number of scoring stations 560 includes a first score station 562. The first score station 562 includes a first score blade 563 (or main score blade 563) with an angle of between about 40°-70°, or in an exemplary embodiment, about 50°. In an exemplary embodiment, the first score blade 563 is coupled, directly coupled, or fixed, to the upper tooling 522. In an exemplary embodiment, at least one of the number of scoring stations 560 includes a raised anvil 566. As used herein, a "raised anvil" is an anvil with a convex surface structured to be disposed immediately adjacent a score blade when the tooling assembly 520 is in the second position. A raised anvil 566 is schematically shown in FIG. 24E.

In an exemplary embodiment, the raised anvil 566 is coupled to the lower tooling 524. The first score blade 563 is structured to make a main score 568 in the blank. The raised anvil 566 solves the problems of shearing of metal, i.e., fracturing at the score.

Figure 25:
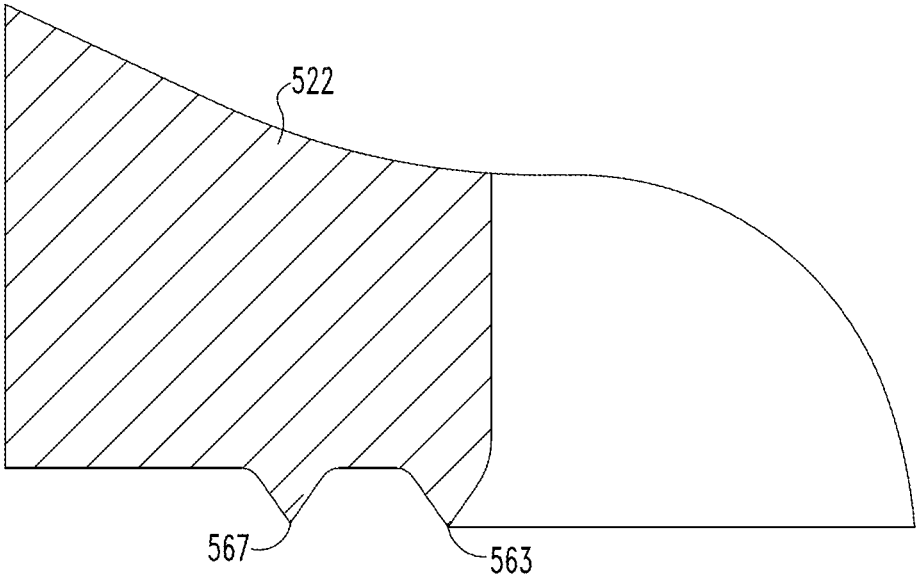
FIG. 25 is a cross-sectional side view of a score station tooling.

The number of scoring stations 560 also includes an anti-fracture score blade 567, as shown in FIG. 25. In an exemplary embodiment, the anti-fracture score blade 567 is also at the first score station 562. In an exemplary embodiment, the anti-fracture score blade 567 is a chisel nose score blade. As used herein, a "chisel nose" score blade, when viewed in cross-section, includes a long side 572, a short side 574, and a transverse side 576 extending between the first and second sides. A score produced by a "chisel nose" score blade is shown in FIG. 24H. The anti-fracture score blade 567 is structured to form an anti-fracture score 569 in the blank. The anti-fracture score 569 is less deep than the main score 568.

Figure 24D:
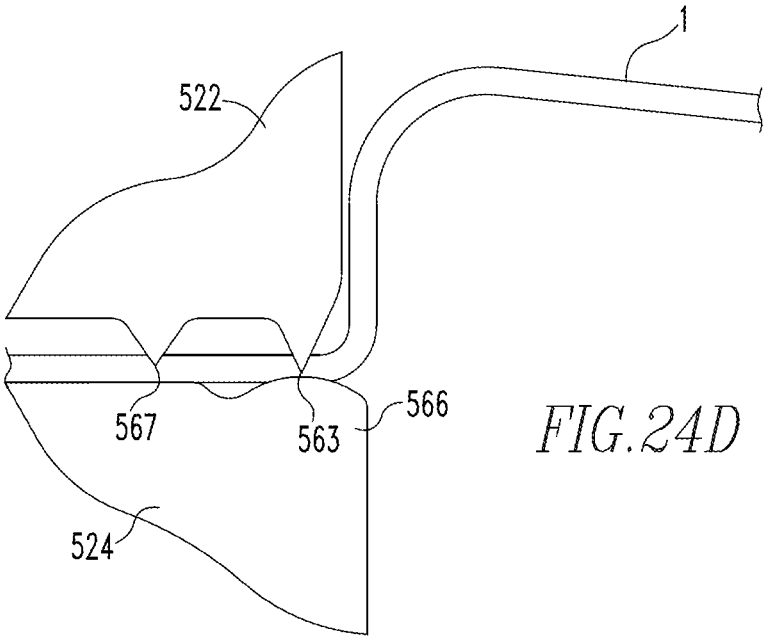
FIG. 24D is a detailed schematic view of the press assembly score station score blade and anti-fracture score blade forming the score and anti-fracture score.
Figure 24E:
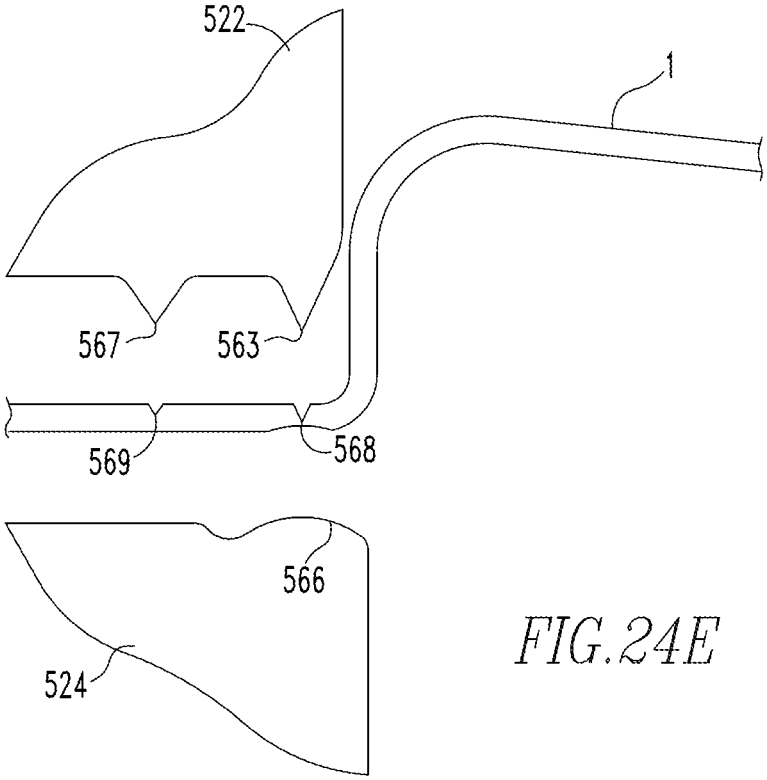
FIG. 24E is a detailed schematic view of the press assembly score station score blade and anti-fracture score blade after forming the score and anti-fracture score.
Figure 24F:
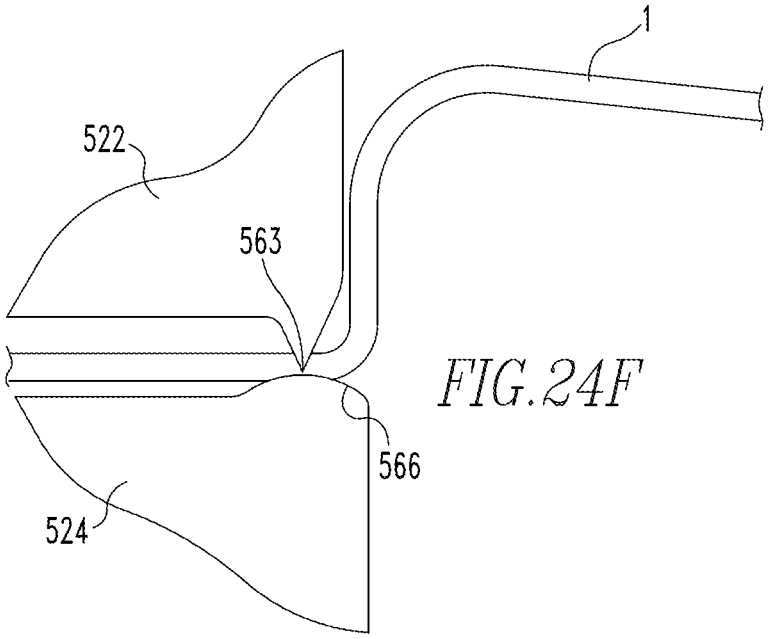
FIG. 24F is a detailed schematic view of the press assembly score station score blade forming the score.
Figure 24G:
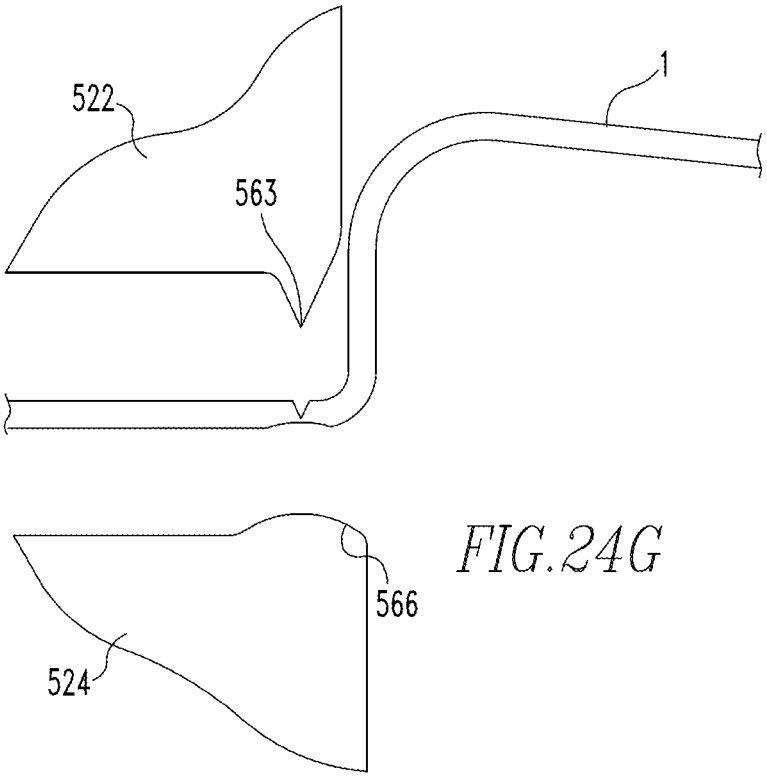
FIG. 24G is a detailed schematic view of the press assembly score station score blade after forming the score.
Figure 24I:
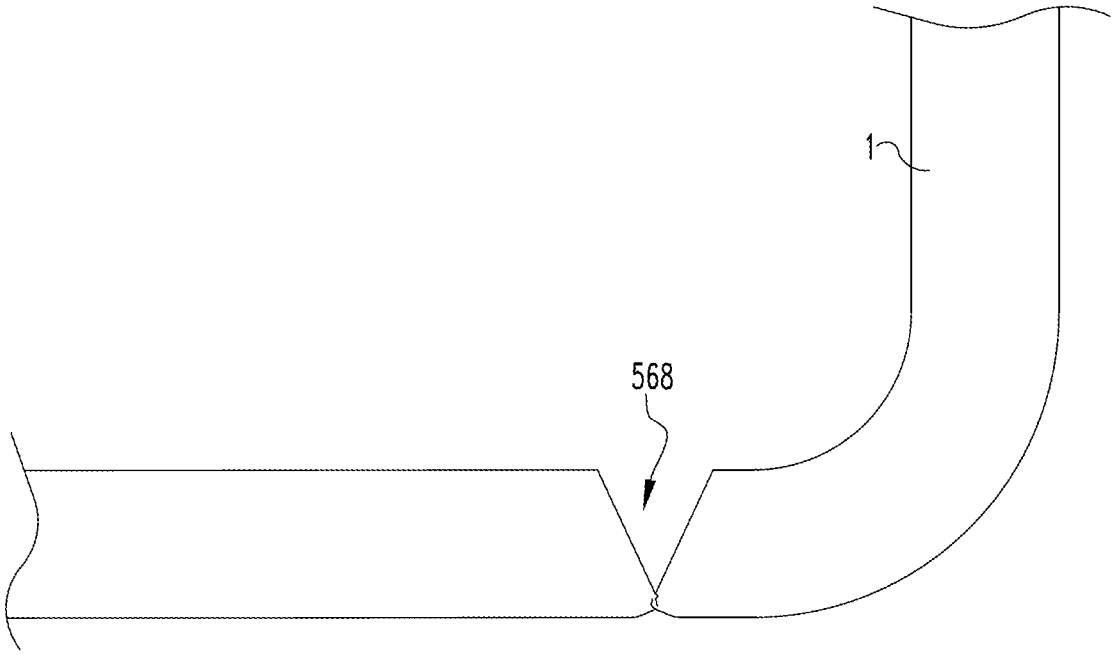
FIG. 24I is a detailed cross-section showing "necking."

Another embodiment of the anti-fracture score blade 567 is shown in FIG. 24D wherein the anti-fracture score blade 567 is disposed between about 0.030 to 0.050 inch from the first score blade 563, or about 0.040 inch as shown below, or a limited spacing as defined above.

In an exemplary embodiment, the main score 568 extends over one of a limited arc, a substantially limited arc, or a very limited arc. Further, in an exemplary embodiment, the main score 568 is disposed over one of a limited distance or a very limited distance from the angled button 600 radius. Further, in an exemplary embodiment, main score 568 and the anti-fracture score 569 are spaced apart by one of limited spacing or a very limited spacing.

Figure 26:
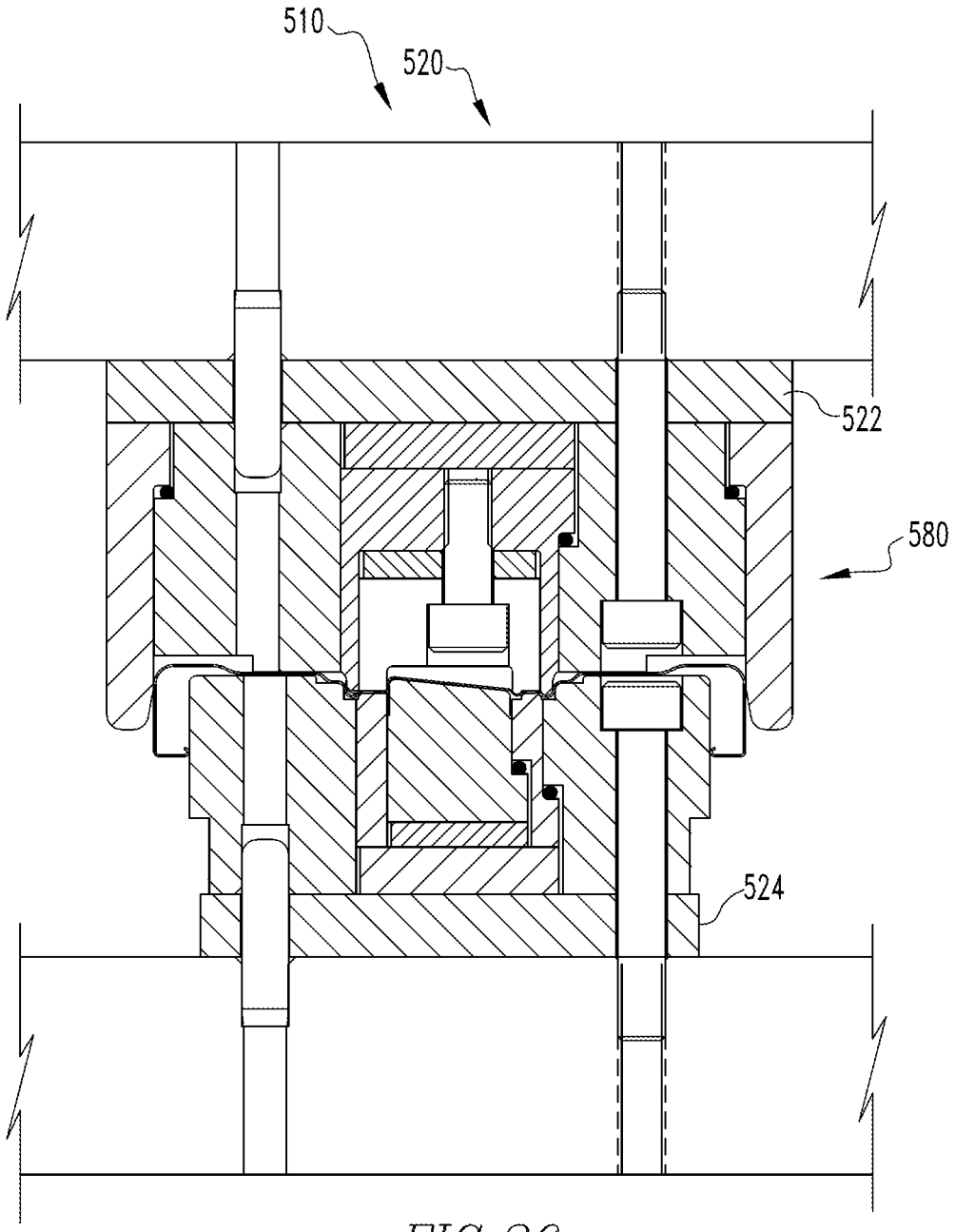
FIG. 26 is a cross-sectional view of a press assembly embossing station.
Figure 26A:
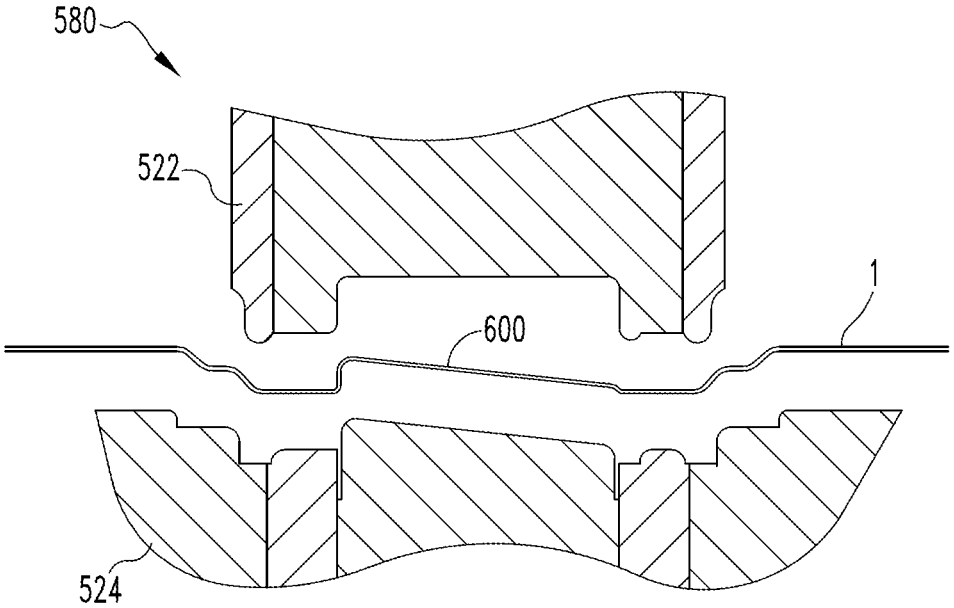
FIG. 26A is a detailed schematic view of the press assembly embossing station about to act on a blank.
Figure 26B:
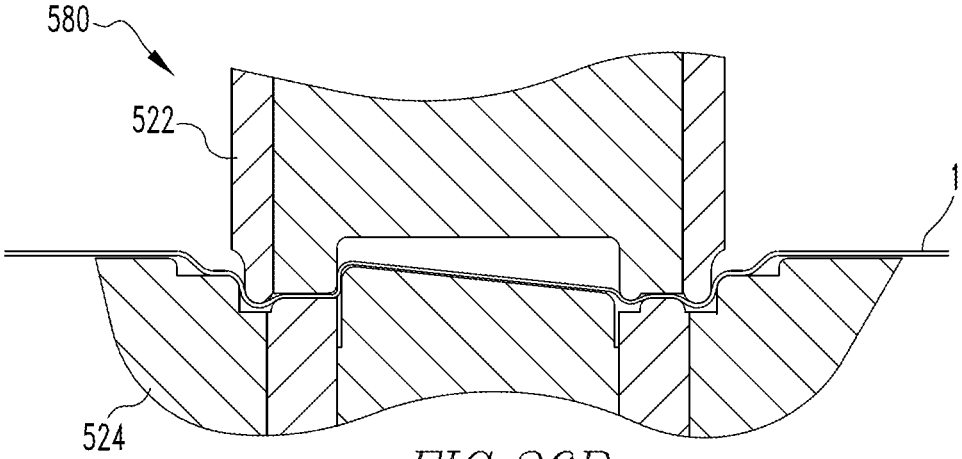
FIG. 26B is a detailed schematic view of the press assembly embossing station embossing the blank.
Figure 27:
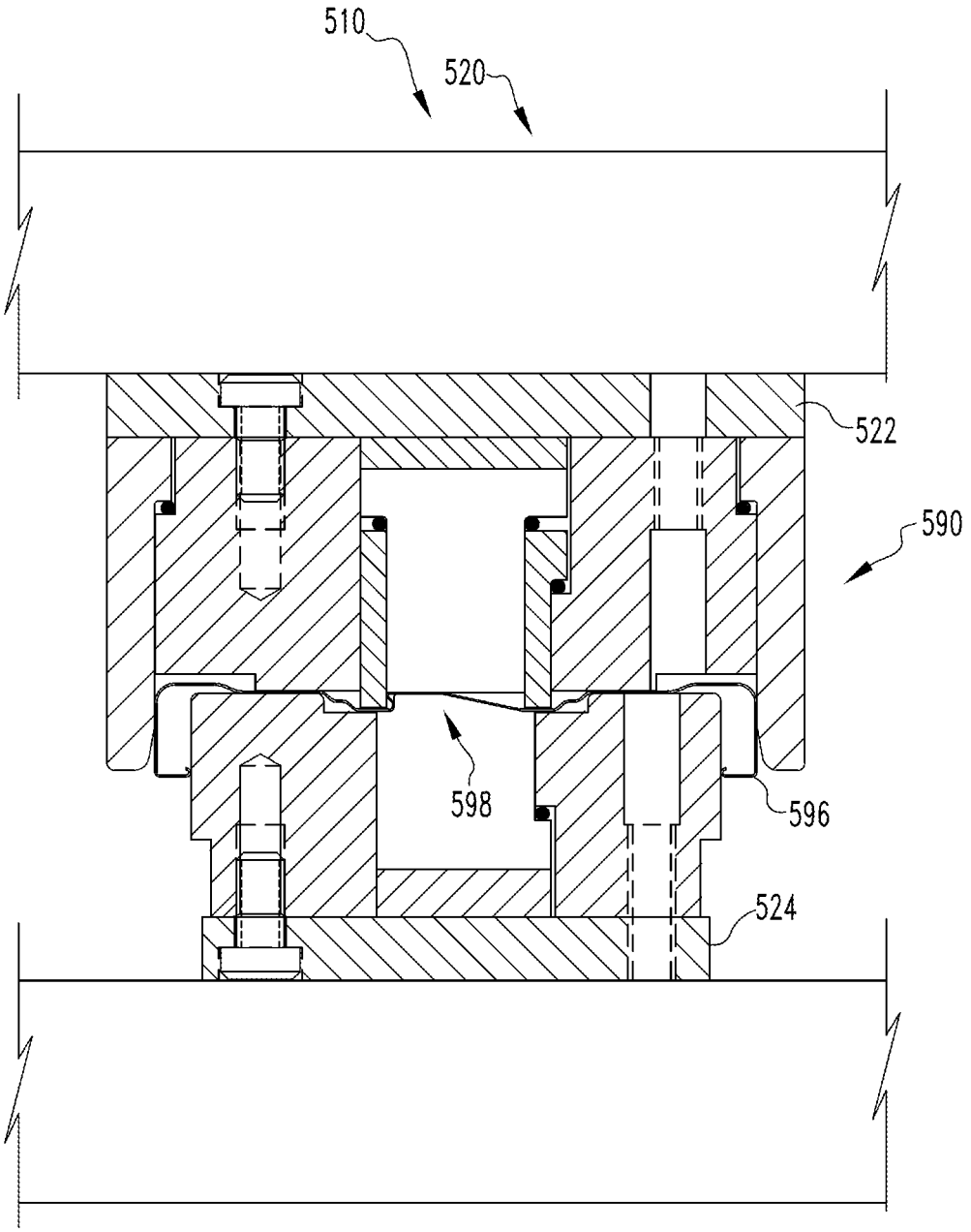
FIG. 27 is a cross-sectional view of a press assembly hemming station.
Figure 27A:
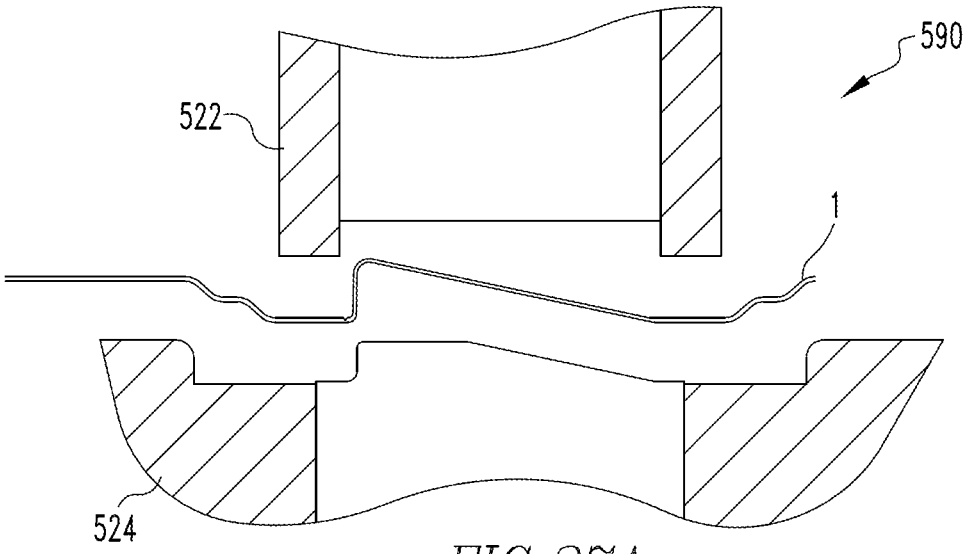
FIG. 27A is a detailed schematic view of the press assembly hemming station about to act on a blank.
Figure 27B:
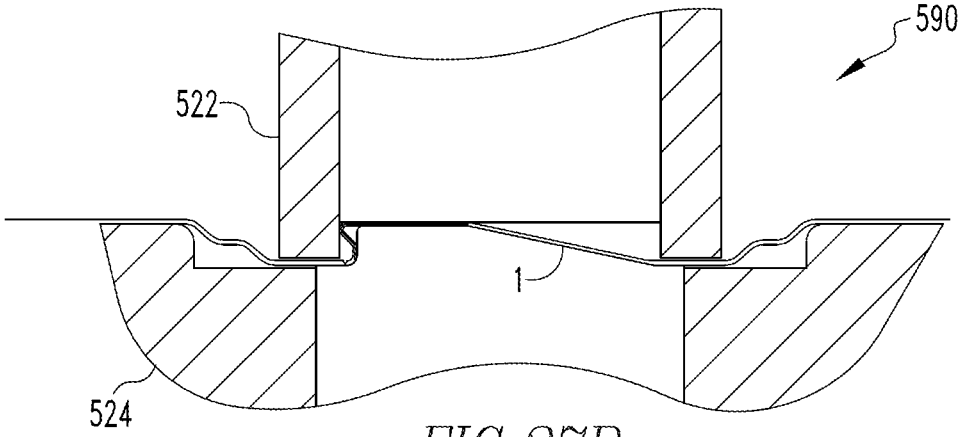
FIG. 27B is a detailed schematic view of the press assembly hemming station hemming the blank.
Figure 28A:
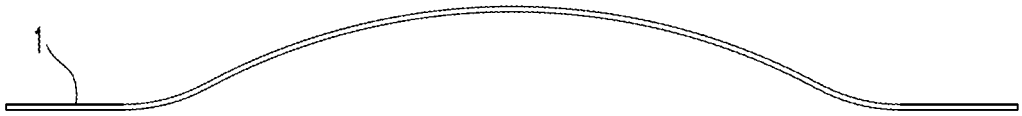
FIG. 28A is a cross-sectional side view of a blank having a first stage bubble.
Figure 28B:
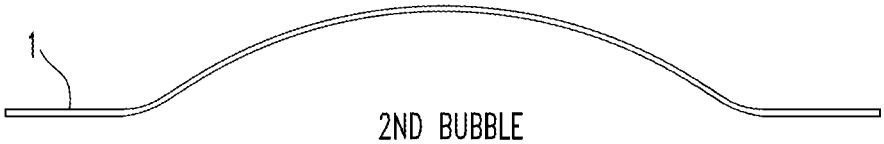
FIG. 28B is a cross-sectional side view of a blank having a second stage bubble.
Figure 28C:
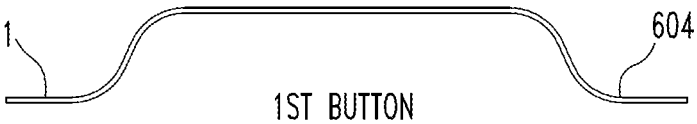
FIG. 28C is a cross-sectional side view of a blank having a first stage button.
Figure 28D:
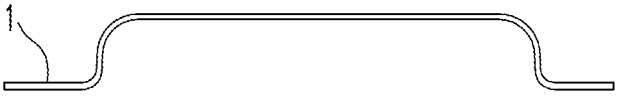
FIG. 28D is a cross-sectional side view of a blank having a second stage button.
Figure 28E:
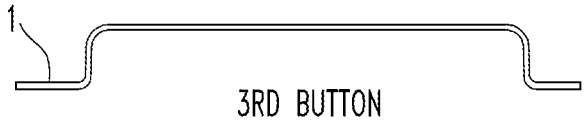
FIG. 28E is a cross-sectional side view of a blank having a third stage button.
Figure 28F:
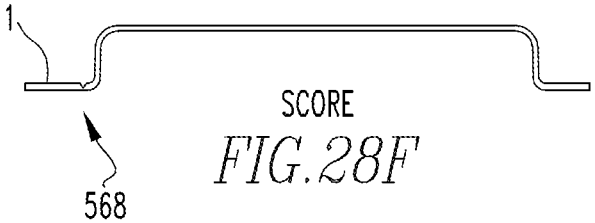
FIG. 28F is a cross-sectional side view of a blank having a score.
Figure 28G:
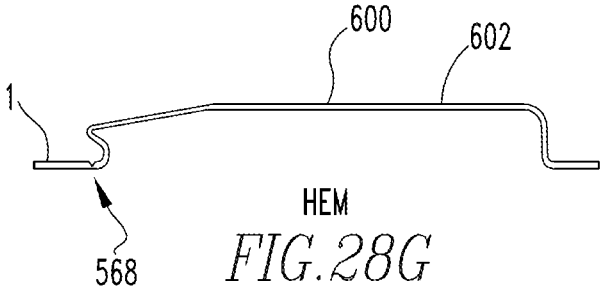
FIG. 28G is a cross-sectional side view of a blank that has been hemmed.
Figure 28H:
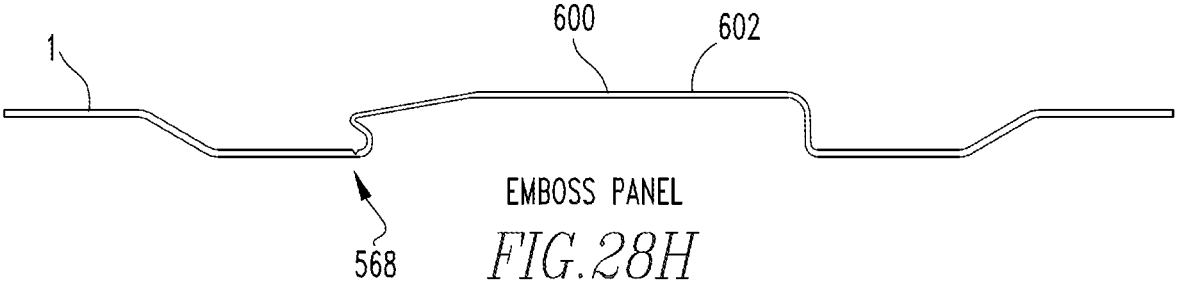
FIG. 28H is a cross-sectional side view of a blank that has been embossed.
Figure 29:
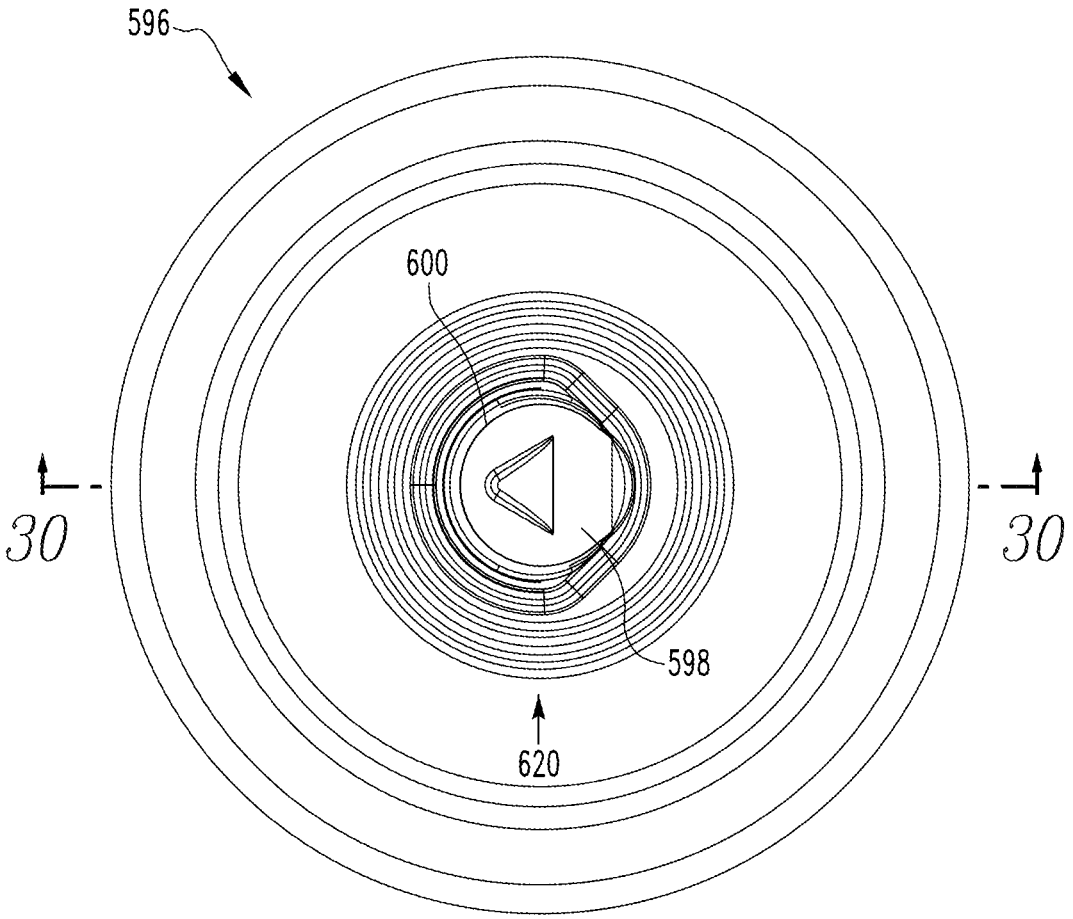
FIG. 29 is a top view of a lid having a venting assembly.
Figure 30:
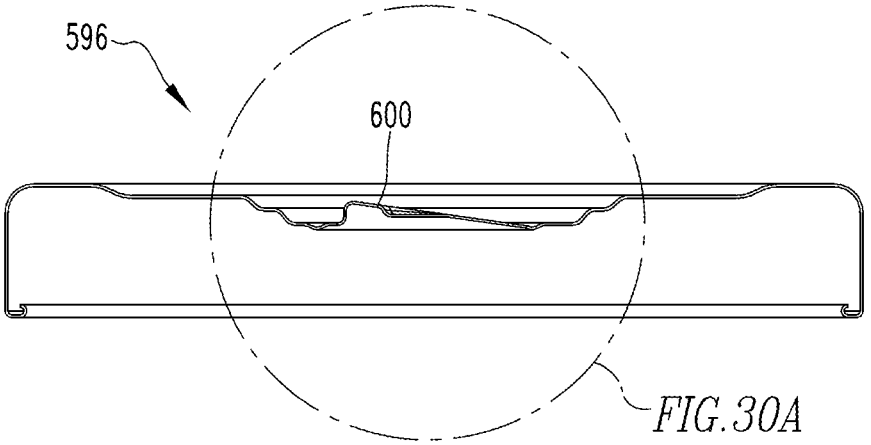
FIG. 30 is a cross-sectional side view of a lid having a venting assembly.
Figure 30A:
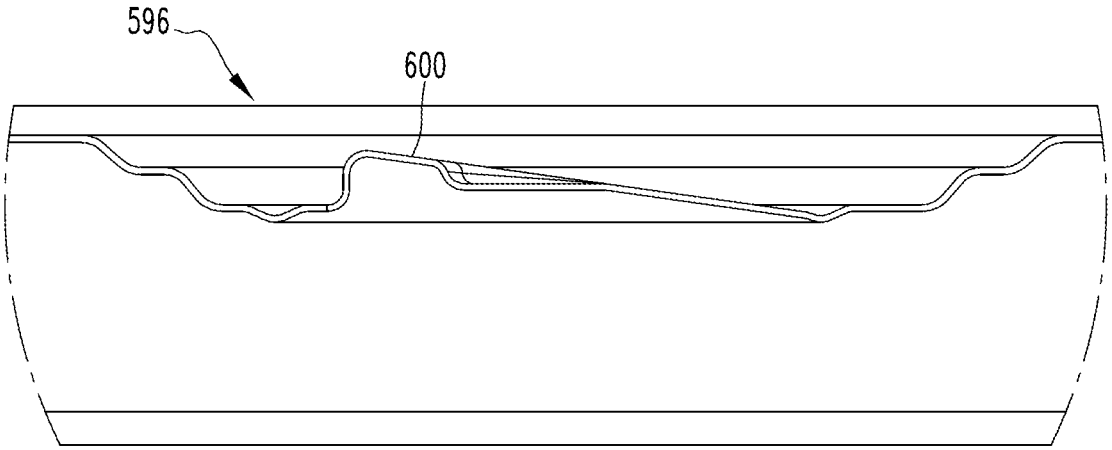
FIG. 30A is a detailed cross-sectional side view of a venting assembly.
Figure 31:
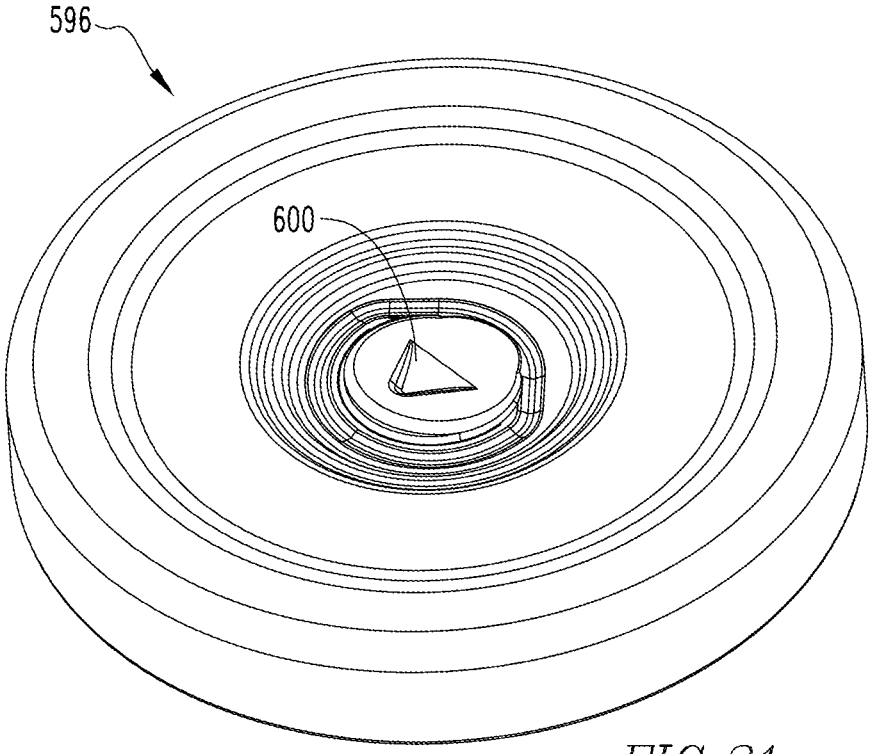
FIG. 31 is a first isometric view of a lid having a venting assembly.
Figure 32:
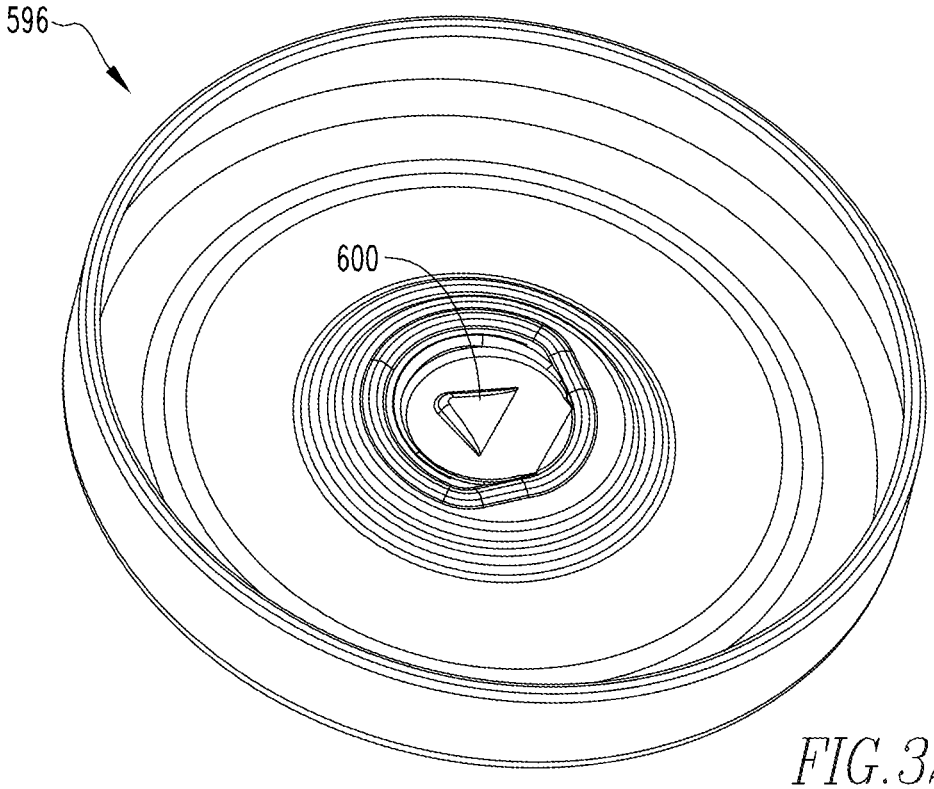
FIG. 32 is a second isometric view of a lid having a venting assembly.
Figure 33:
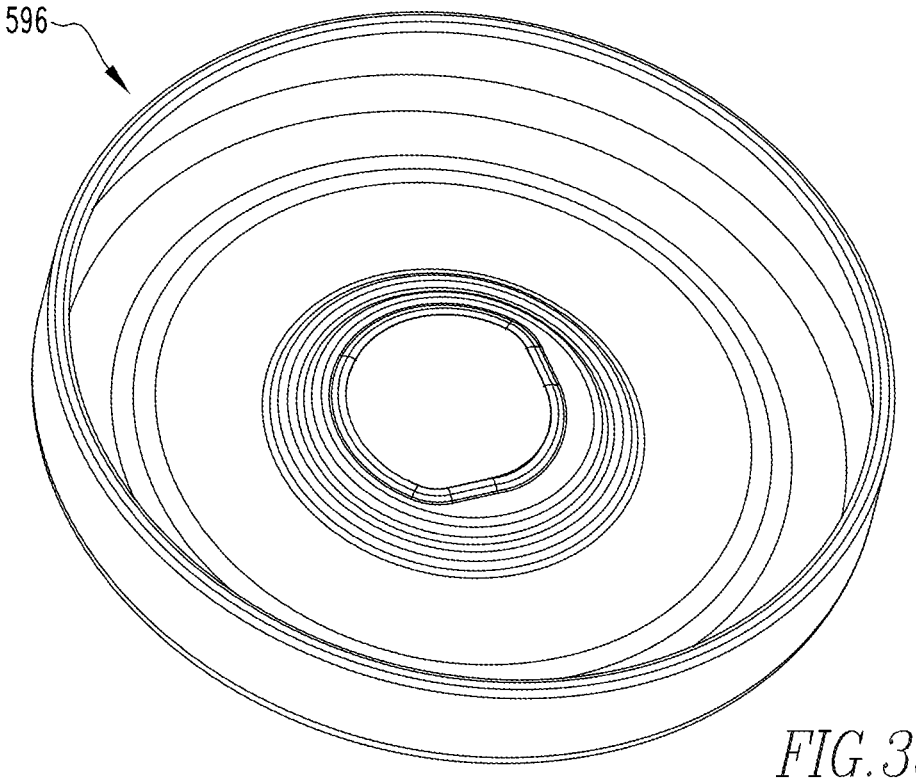
FIG. 33 is another isometric view of an alternate lid having a venting assembly.

In an exemplary embodiment, as shown in FIGS. 26-26B, the tooling assembly 520 also includes a number of embossing stations 580 and a number of hemming stations 590. In one embodiment, there is a single embossing station 580 and hemming station 590 (shown in FIGS. 27-27B). The embossing station 580 is structured to raise the angled button 600 relative to the offset tier 606. The top of the angled button 600 is not raised above the chime line. Further, in an exemplary embodiment, the top of the angled button 600 is not raised above the center panel. In another exemplary embodiment, there is no hemming station 590 and the button 600 is not hemmed.

In an exemplary embodiment, the tooling assembly stations 526 are disposed in the order identified above. That is, the blank moves through the stations in the following order: bubble forming stations 540, button forming stations 550, and scoring station 560. Further, if included, the scoring station 560 is followed by the embossing station 580 and the hemming station 590 and is formed as shown in FIGS. 28A-28H.

In another embodiment, the tooling assembly 520 includes a number of shifted material line stations 700 rather than, or in addition to, scoring stations 560. Each shifted material line forming station 700 is structured to, and does, form a shifted material line 30. In the exemplary embodiment, a first shifted material line station 702 is structured to, and does, form a lance line 100. That is, in an exemplary embodiment, the first shifted material line station 702 is a lance station 704. It is understood that, as defined above, a lance line 100 is when the material of the lid 596 is separated at the shifted material line 30. Thus, as described below, the elements of the first shifted material line station 702 move a distance sufficient to separate the material of the lid 596. It is further understood that a shifted material line station 700 is structured to form another type of shifted material line 30, for example a shear line 102, the elements of such a shifted material line station 700 move a distance sufficient to form the identified type of shifted material line 30. Further, to form a hidden shear line 104, the elements of such a shifted material line station 700 are structured to reciprocate multiple times so as to form the hidden shear line 104.

Further, in the embodiment shown, the first shifted material line station 702 is structured to make a first section 80 or tear panel 24 with a positive shift. As used herein, "inner" means relative to an axis passing through the center of the blank and generally normal to the surface of the unformed blank. Thus, the first shifted material line station 702 includes inner components 710 and outer components 712. In the embodiment shown, an upper tooling outer punch 723 and a lower tooling outer anvil 725, discussed below, are the outer components 712. The inner components 710 include a lower tooling inner anvil 726 and an inner punch (not shown). The inner components 710 and outer components 712, if used, generally face, or oppose, each other and are structured to engage, clamp, or progressively clamp the blank as well as otherwise form the blank. It is understood that, depending upon the type of shifted material line 30 being formed, not all the inner components 710 or outer components 712 identified above are required. For example, in the embodiment shown, an inner punch is not required.

That is, the disclosed lower tooling 524 includes an inner anvil 726. It is understood that a first shifted material line station 702 structured to make a first section 80 or tear panel 24 with a negative shift would include an inner punch (not shown) as part of the upper tooling 522. Further, a first shifted material line station 702 structured to make a hidden shear line 104 would include both an inner punch (not shown) and an inner anvil 726.

Figure 34:
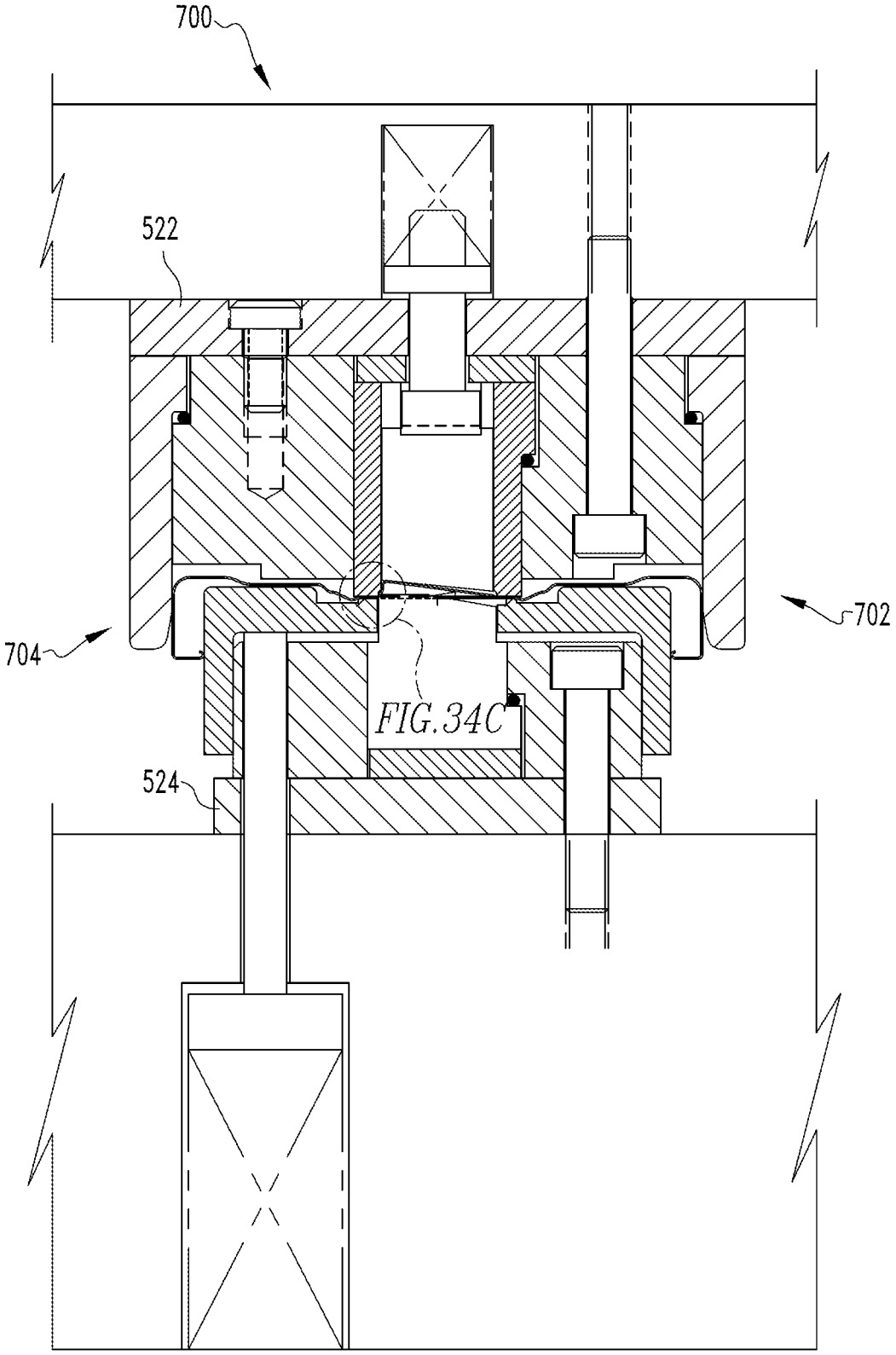
FIG. 34 is a schematic cross-sectional view of a press assembly lance station.
Figure 34A:
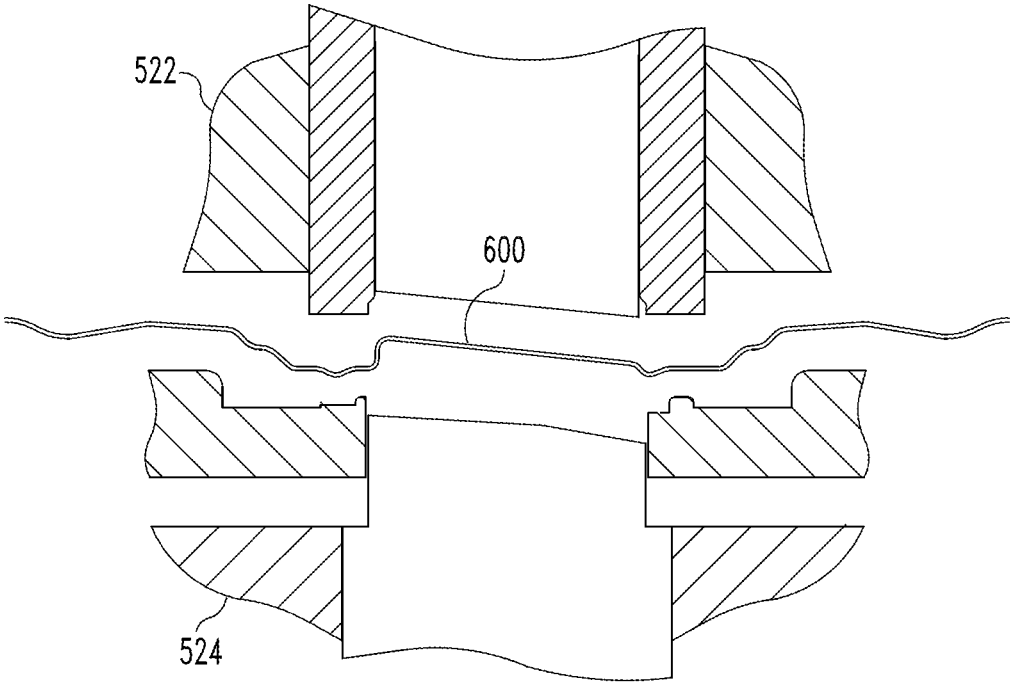
FIG. 34A is a detailed schematic view of the press assembly lance station about to act on a blank.
Figure 34B:
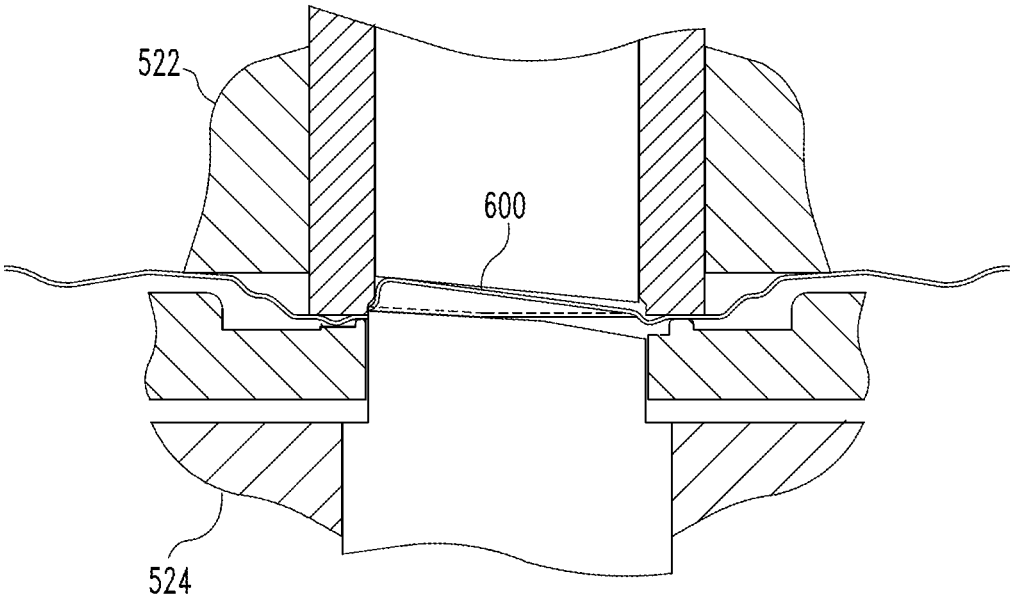
FIG. 34B is a detailed schematic view of the press assembly lance station forming a bubble in the blank.
Figure 34C:
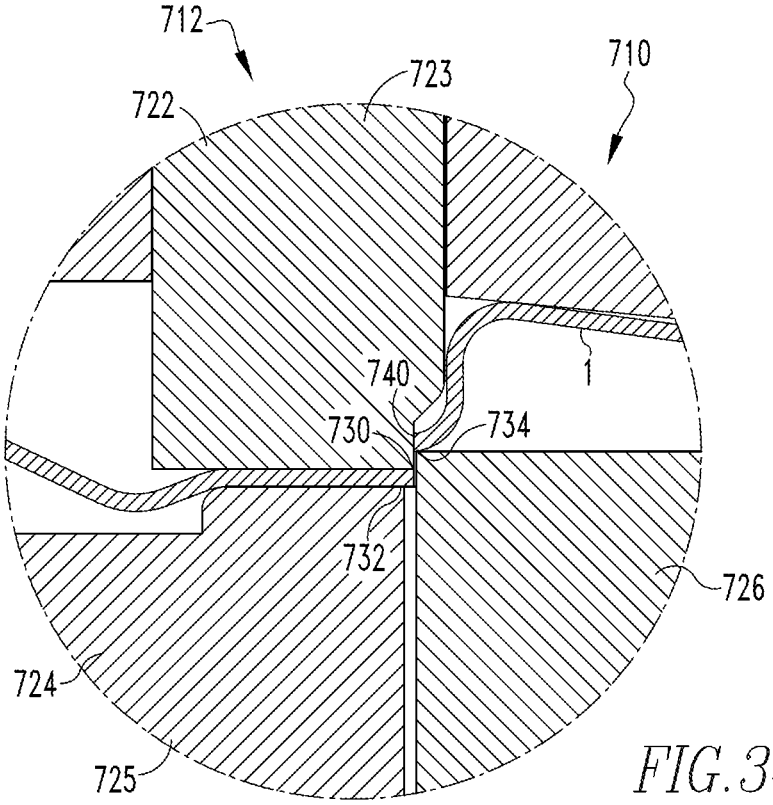
FIG. 34C is a cross-sectional side view of a lance station forming a lance line in a blank.
Figure 34D:
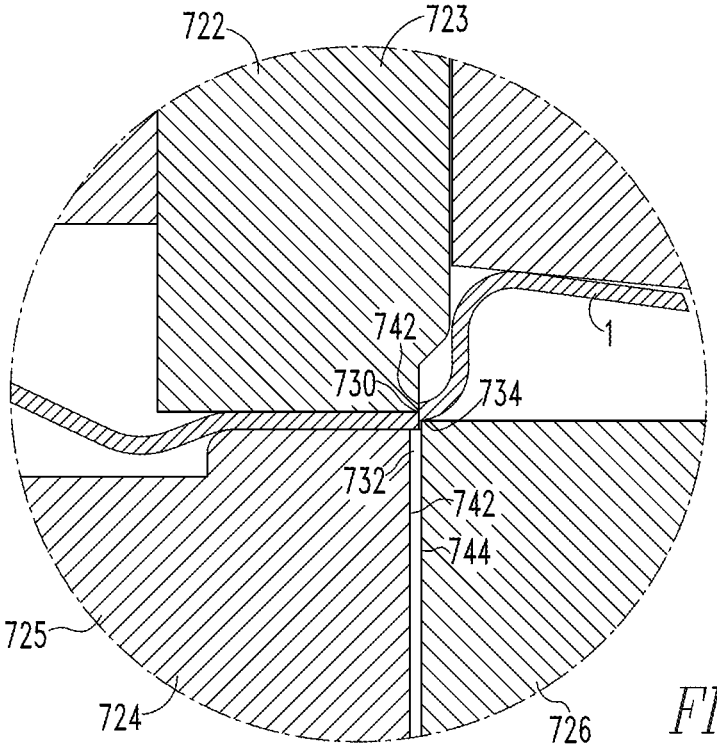
FIG. 34D is a cross-sectional side view of a lance station forming a shear line in a blank.
Figure 35A:
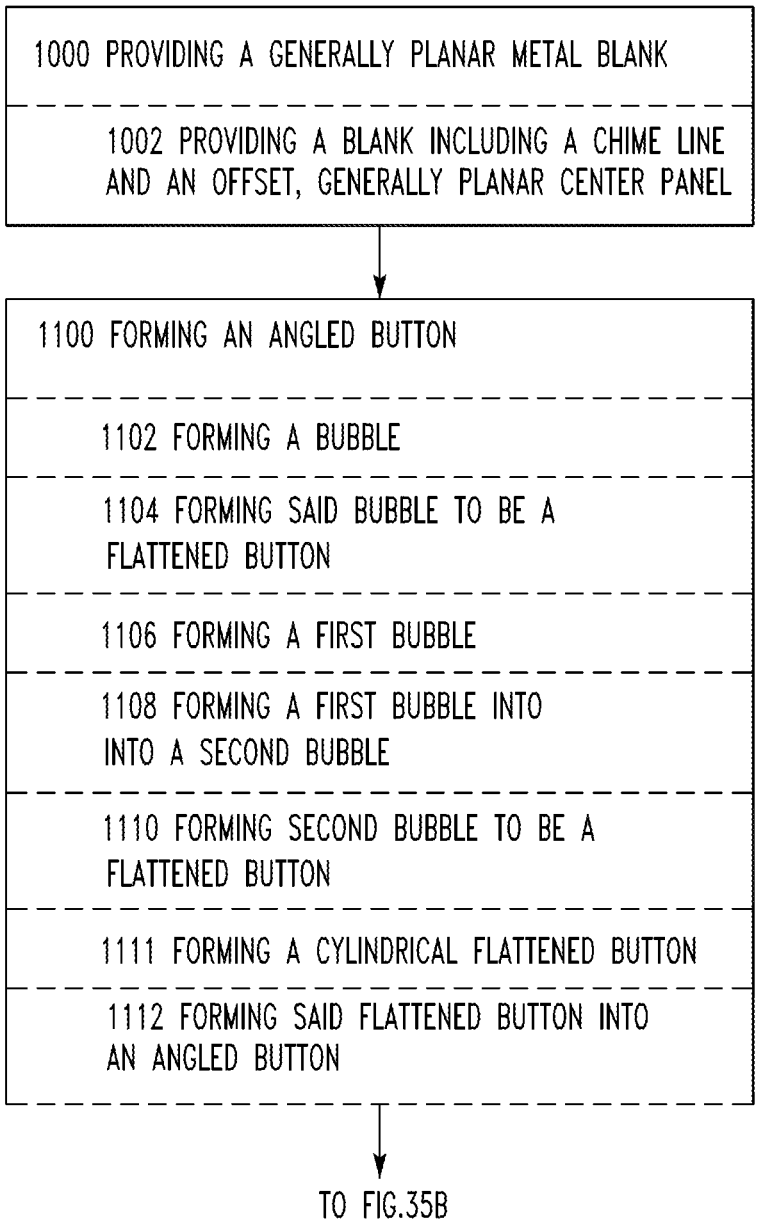
Figure 35B:
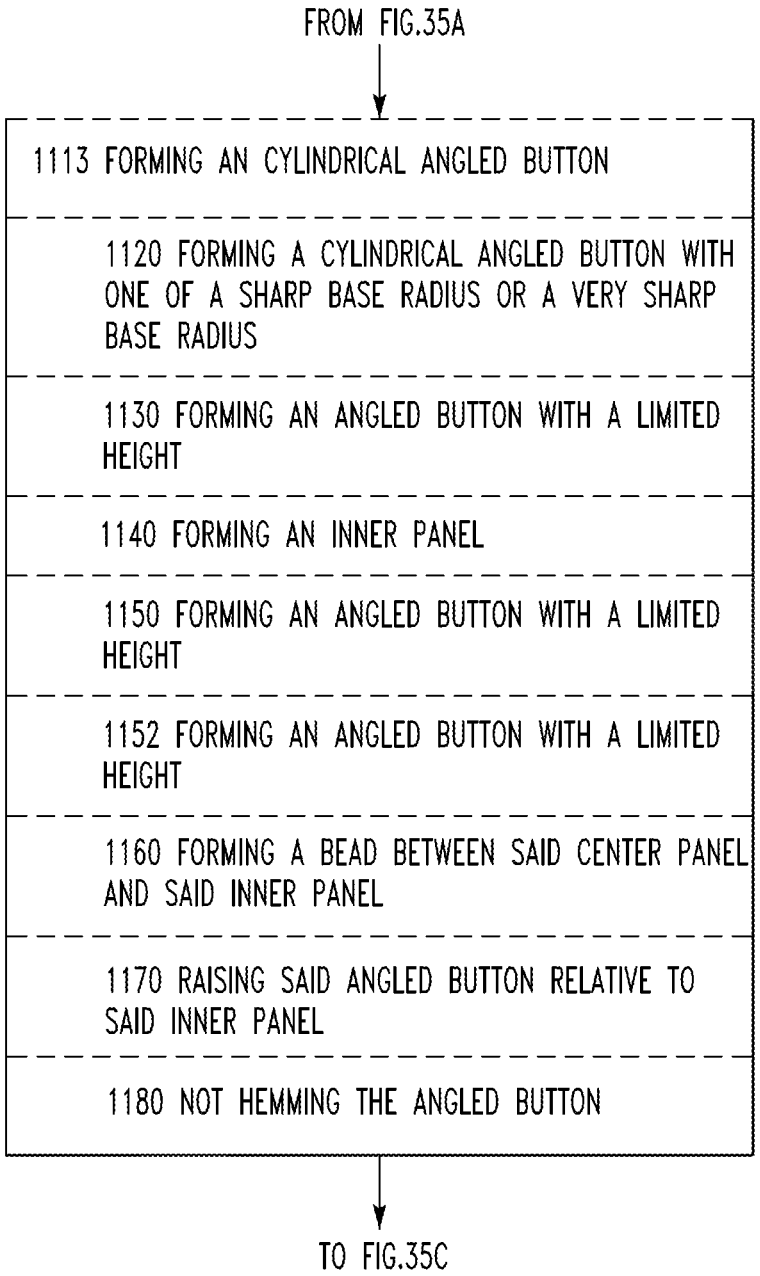
Figure 35C:
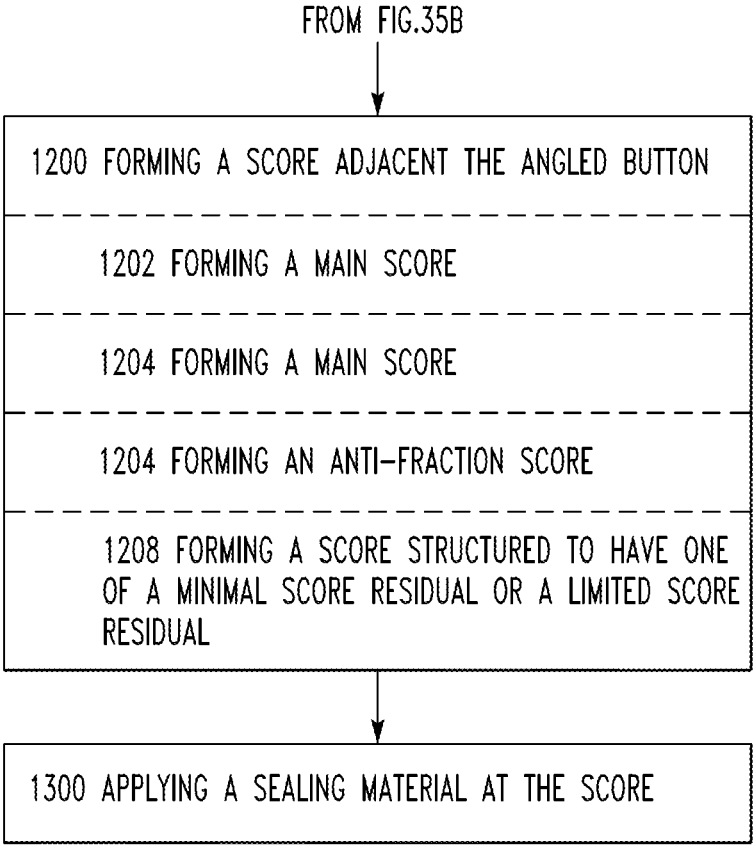

In the shown exemplary embodiment, and as shown in FIGS. 34-34D, the first shifted material line station 702 is a lance station 704 structured to lance the blank. The lance station 704 includes an upper tooling 722 and a lower tooling 724. In an exemplary embodiment, the upper tooling 722 includes an outer punch 723 and the lower tooling 724 includes an outer anvil 725 and an inner anvil 726. The outer anvil 725 extends about the inner anvil 726. The outer punch 723 has a forming surface 730 disposed at a first radius from the center of the blank. As shown, and in an exemplary embodiment, the outer punch forming surface 730 includes a substantially planar first surface as well as a substantially planar second surface that is generally perpendicular to the first surface. As used herein, the surfaces of the inner components 710 and the outer components 712 that contact the blank are the "forming surface(s)." Thus, characteristics (size, shape, etc.) of a "forming surface" depend upon the blank and the configuration of the blank during a specific forming operation. The outer anvil 725, as shown, also includes a forming surface 732. The outer anvil forming surface 732 is also generally planar, i.e., the outer anvil forming surface 732 generally defines a plane. Similarly, the inner anvil 726 includes a forming surface 734. The inner anvil forming surface 734 is also generally planar, i.e., the inner anvil forming surface 734 generally defines a plane.

Further, an inner edge 740 of the outer punch forming surface 730 is disposed at a first radius from the station centerline. The outer anvil 725 has a second edge 742 disposed at a second radius from the station centerline. The second radius is greater than the first radius, but not substantially greater. The inner anvil 726 has a third edge 744 disposed at a third radius from the station centerline. The third radius is smaller than the first radius, but not substantially smaller. It is noted that, in this configuration, there is a gap between the outer anvil 725 and the inner anvil 726.

The outer components 712 (in this embodiment, the outer punch 723 and the outer anvil 725) are structured to, and do, move relative to the inner components 710 (in this embodiment, the inner anvil 726) between a first forming position, wherein the lower tooling forming surfaces, i.e., the outer anvil forming surface 732 and the inner anvil forming surface 734 are generally parallel, and, a second forming position, wherein the lower tooling forming surfaces, i.e., the outer anvil forming surface 732 is shifted relative to the inner anvil forming surface 734. As used herein, the verb "shifted" means moved in a direction generally perpendicular to the plane of the blank or the plane of the container closure body 12. That is, the shifting of the outer anvil forming surface 732 relative to the inner anvil forming surface 734 occurs as the outer components 712 move from the first forming position to the second forming position. Further, as the outer components 712 move from the first position to the second position, a shifted material line 30 is formed in the blank.

That is, in operation, the outer punch 723 and the outer anvil 725 move toward each other and engage the blank. In one embodiment the outer punch 723 and the outer anvil 725 "clamp" the blank. As used herein, "clamp" means to secure a material, e.g., a blank, in a substantially fixed position so as not to permit the material to move (e.g., slide) or flow in at least one direction. Thus, as employed herein, a material that is "clamped" is secured in a substantially fixed position so as not to permit the material to move (e.g., slide) or flow in at least one direction, for example, the clamped material cannot move/flow between the outer punch 723 and the outer anvil 725. In another embodiment, the outer punch 723 and the outer anvil 725 "progressively clamp" the blank. As used herein, to "progressively clamp" means to secure a material in a substantially fixed position while initially allowing material to move (e.g., slide) or flow in at least one direction through the "progressively clamped" area. As the force of the engagement increases, the amount of material that moves/flows through the "progressively clamped" area decreases until the amount is negligible. Thus, as employed herein, a material that is "progressively clamped" is secured in a substantially fixed position while allowing some material flow after initially being "progressively clamped" and wherein the force of the engagement increases so as to permit only a negligible amount of material to move/flow through the "progressively clamped" area.

After the blank is engaged, clamped, or progressively clamped, and because in the embodiment shown the second portion 34 (or the tear panel 24) has a positive shift, the inner anvil 726 moves toward the upper tooling 722. As shown in FIG. 34B this action creates the shifted material line 30 which, in this embodiment, is a lance line 100. Thus, the inner anvil 726 moves a distance toward the upper tooling 722 sufficient to separate the first portion 32 from the second portion 34. Generally, the forming component(s) that forms the shifted material line 30 moves a distance sufficient to create a negligible shift, a minimal shift, a moderate shift, a maximum shift, or a spaced shift at the shifted material line 30. These distances are, as used herein, a "negligible distance," a "minimal distance," a "moderate distance," a "maximum distance," or a "spaced distance," respectively. In the exemplary embodiment shown, to form a lance line 100, the inner anvil 726 moves a distance sufficient to create a spaced shift at the shifted material line 30.

The lance station 704 described above is structured to, and does, create a lance line 100 in the blank. Other shifted material line stations 700 are structured to, and do, form one of a relief line, a shear line, a lance line, or a mingled line. That is, for example, a scoring station 560 combined with, or following a shifted material line station 700, would be a shifted material line station 700 structured to form a relief line. That is in this embodiment, a scoring station 560 would be a relief score station structured to form a score at the shifted material line 30.

The method of forming a venting assembly, as shown in FIGS. 35A-35D, includes the following. Providing 1000 a generally planar metal blank, the blank including a product side 14 and a consumer side 16, the blank having an initial thickness, forming 1100 an angled button 600, forming 1200 a score adjacent the angled button 600, and applying 1300 a sealing material at the score. The sealing material is, in an exemplary embodiment, a plastic or poly material such as, but not limited to, Plastisol.

Providing 1000 a generally planar metal blank, in an exemplary embodiment, includes providing 1002 a blank including a chime line and an offset, generally planar center panel, the center panel offset in a first direction.

In an exemplary embodiment, forming 1100 an angled button includes a number of the following. Forming 1102 a bubble, the bubble including a center, forming 1104 the bubble to be a flattened button, the flattened button having a center, wherein the flattened button center is offset from the bubble center. Forming 1106 a first bubble, wherein the first bubble has a dome radius between about 0.770 and 0.790 inch, and, a base radius between about 0.180 and 0.200 inch, and, forming 1108 the first bubble into a second bubble wherein the second bubble has a dome radius between about 0.520 and 0.540, and, a base radius between about 0.070 and 0.090 inch. Forming 1110 the second bubble into a flattened button includes forming 1112 the flattened button into an angled button. In an exemplary embodiment, forming 1110 the second bubble into a flattened button includes forming 1111 a cylindrical flattened button. Similarly, in an exemplary embodiment, forming 1112 the flattened button into an angled button includes forming 1113 a cylindrical angled button. Forming 1113 a cylindrical angled button includes forming 1120 a cylindrical angled button with one of a sharp base radius or a very sharp base radius as well as forming 1130 an angled button with a limited height. There is also the forming 1140 of an inner panel, wherein the inner panel is offset in the first direction a greater distance from the chime line than a blank's center panel, forming 1150 an angled button with a limited height, wherein the button does not extend above the chime line, and forming 1152 an angled button with a limited height, wherein the button does not extend above a blank's center panel. Further, there is forming 1160 a bead between the center panel and the inner panel, and, raising 1170 the angled button relative to the inner panel. That is, as used herein, "raising" means forming an offset in a direction opposite a prior offset. In an exemplary embodiment, the method includes not hemming 1180 the angled button. That is, as used herein, "not hemming" is a negative recitation wherein the angled button 600 is not hemmed.

In an exemplary embodiment, forming 1200 a score adjacent the angled button, in an exemplary embodiment, includes forming 1202 a main score, the main score disposed one of a limited distance or a very limited distance from the cylindrical angled button base radius. Further, forming 1200 a score adjacent the angled button, in an exemplary embodiment, includes forming 1204 a main score, the main score disposed a first distance from the cylindrical angled button base radius, and, forming 1206 an anti-fracture score, the anti-fracture score having one of a limited spacing from the main score or a very limited spacing from the main score, as well as forming 1208 a score structured to have one of a minimal score residual or a limited score residual.

Further, using the press assembly 510 described above, and as shown in FIG. 35D, a method of forming a container closure 10 as described above includes providing 1400 a generally planar metal blank, the blank including a product side 14 and a consumer side 16, the blank having an initial thickness, and, forming 1402 a shifted material line defining a container opening. In an exemplary embodiment, forming a shifted material line 1402 includes applying 1410 a sealing material at the shifted material line. Further, in an exemplary embodiment, forming a shifted material line 1402 includes forming 1420 one of a relief line, a shear line, a hidden shear line, a lance line, or a mingled line. Further, in an exemplary embodiment, forming a shifted material line 1402 includes: defining 1450 a tear panel and an end panel in the blank, and moving 1452 the tear panel to one of a positive position, a normal position, a negative position, or a mingled position.

The container closure 10, the shifted material line 30, as well as each embodiment thereof, the press assembly 510, the shifted material line forming station 700, and the disclosed method solve the problems stated above.

Figure 36A:
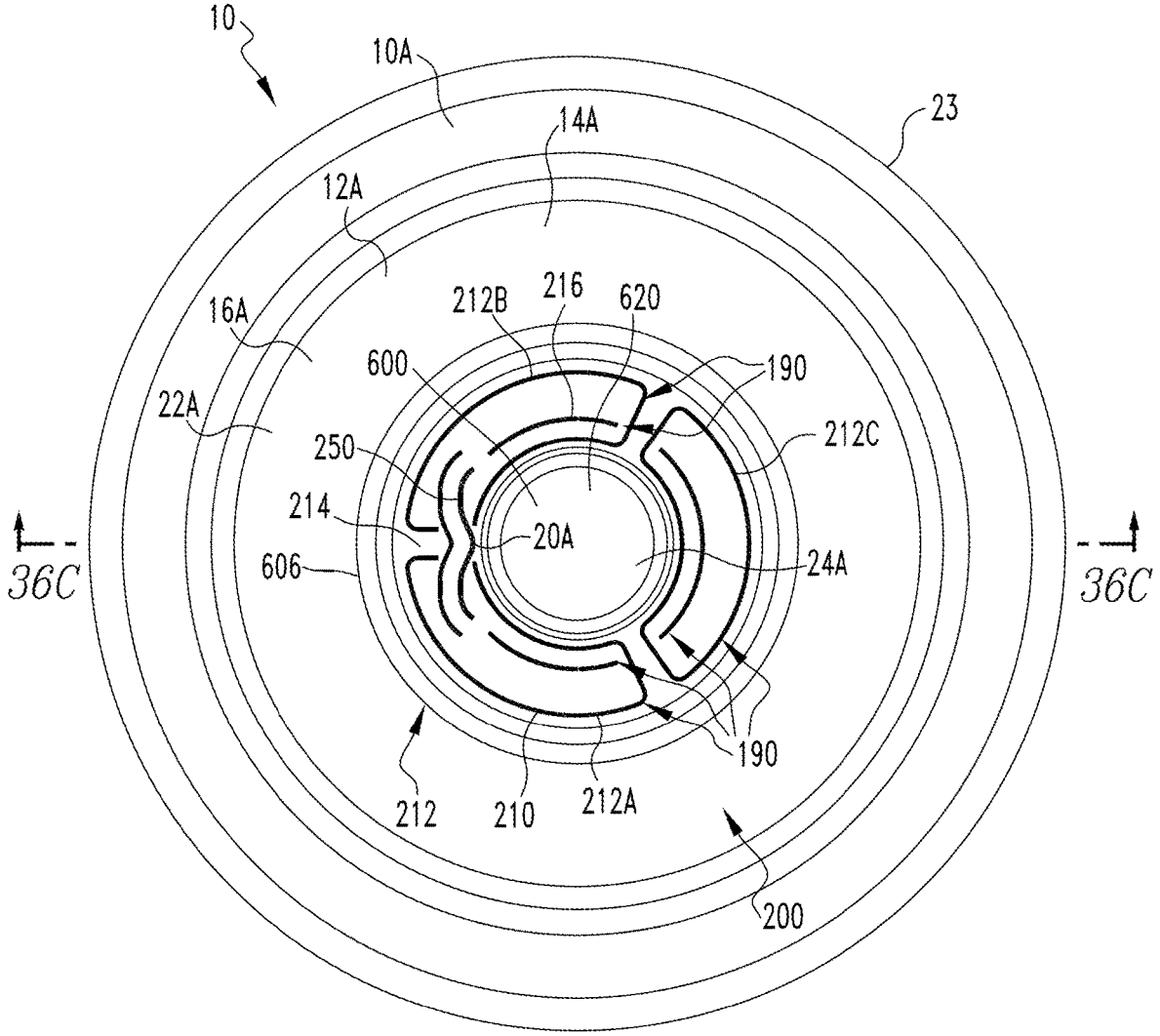
FIG. 36A is a top view of a lid including a limited container opening and a force concentrating construction.
Figure 36B:
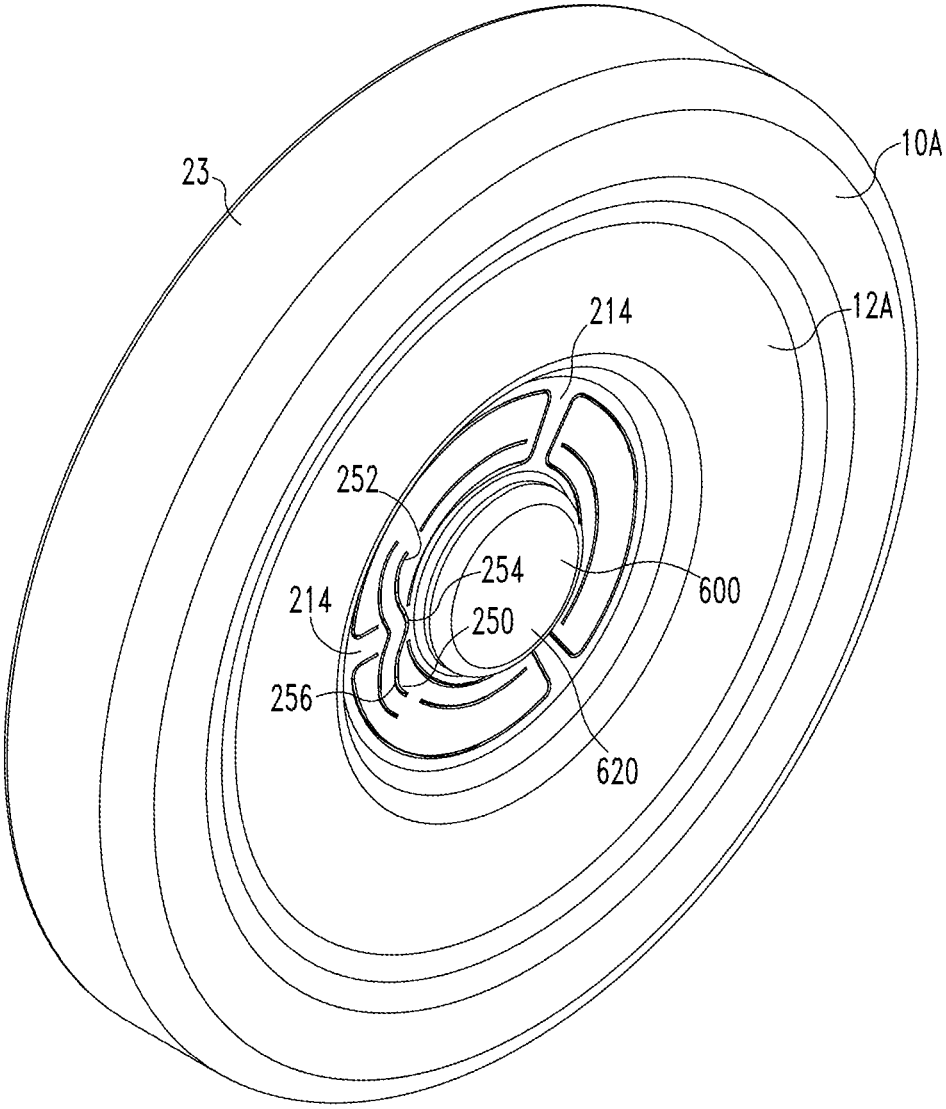
FIG. 36B is an isometric view of the lid in FIG. 36A.
Figure 36C:
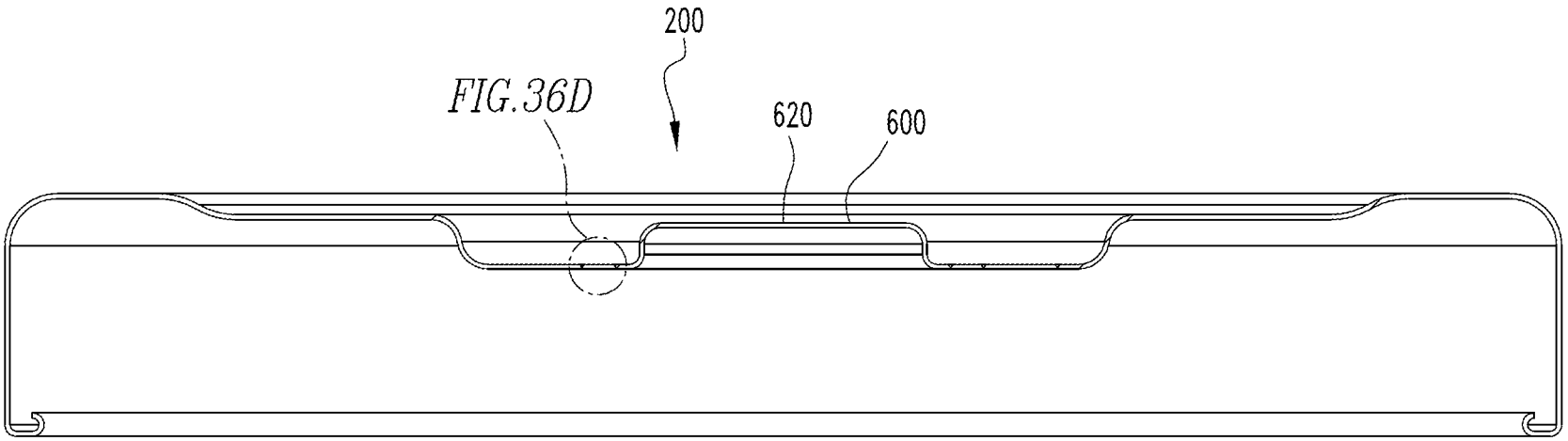
FIG. 36C is cross-sectional side view of the lid in FIG. 36A.
Figure 36D:
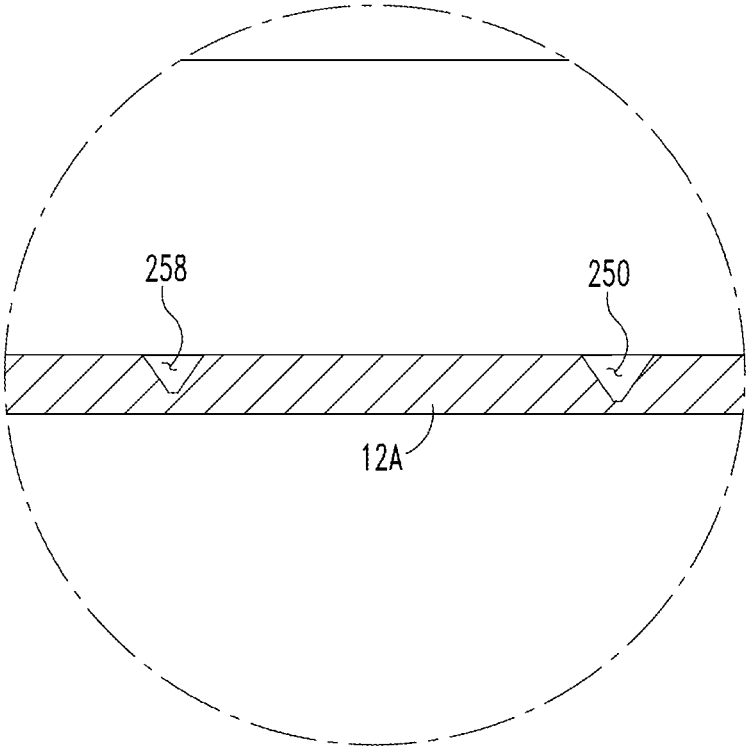
FIG. 36D is a detail cross-sectional view of the scores in FIG. 36C.
Figure 36E:
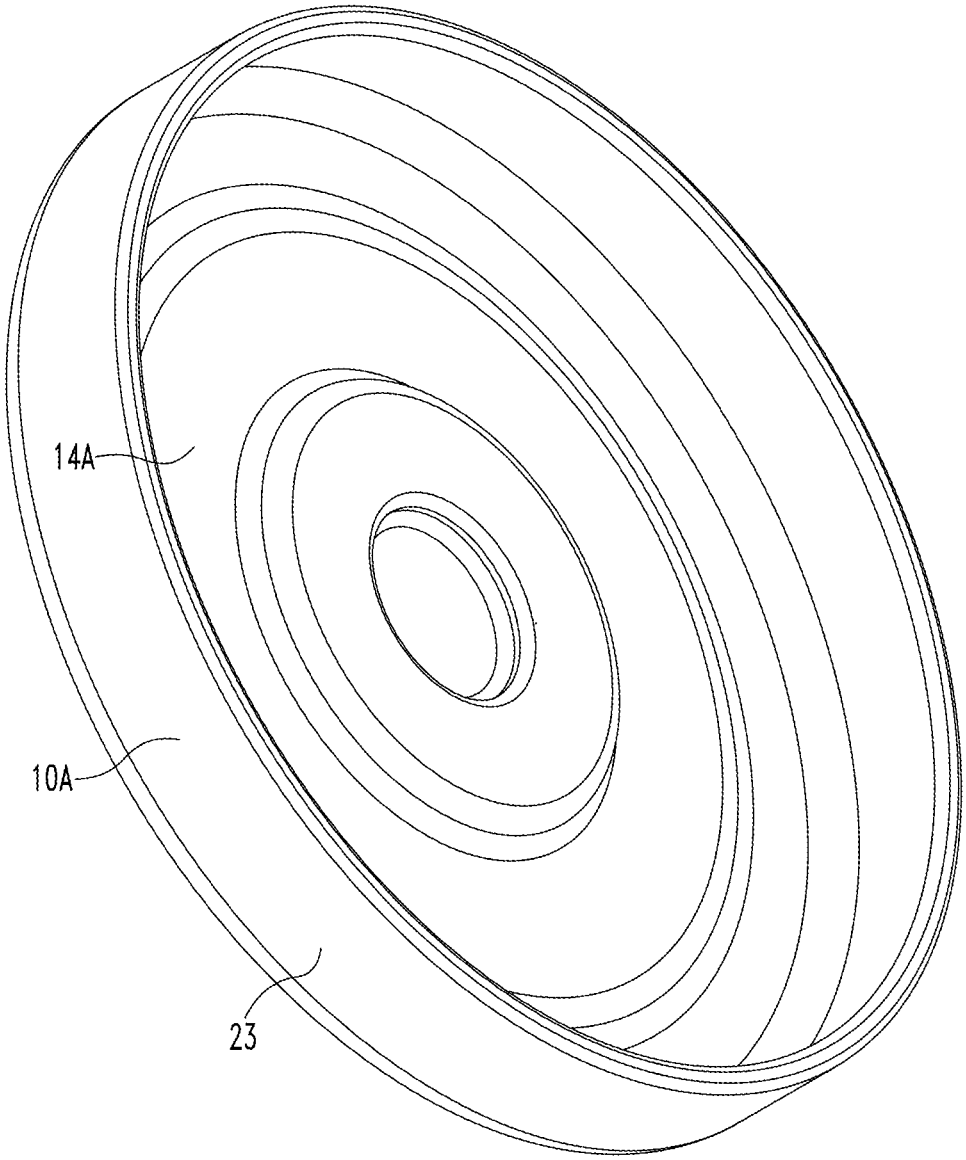
FIG. 36E is another isometric view of the lid in FIG. 36A.

In another exemplary embodiment, shown in FIGS. 36-36N, the container closure is a lid 10A that includes a generally planar body 12A having a product side 14A and a customer side 16A. As used herein, a "lid" 10A is a container closure 10 that is structured to be, and is, removably coupled to a can body or jar (neither shown). It is understood that, as used herein, the terms "container closure" and "lid" are equivalent. In an exemplary embodiment, the lid 10A includes a depending sidewall with interior threads (neither shown). The jar includes an upper opening with exterior threads. The lid 10A interior threads are structured to, and do, engage the jar exterior threads. When the lid 10A is coupled to the jar, an enclosed space is defined. As is known, a product disposed in the jar's enclosed space can be heated, e.g., for sterilization. When the jar cools, a vacuum or partial vacuum is created in the jar. The vacuum, or partial vacuum, draws the lid 10A into engagement with the jar upper surface. Stated alternately, the lid 10A is biased against the jar. To loosen the lid 10A, a user must overcome this bias, or, the bias must be eliminated or reduced. As is known, the vacuum can be eliminated by creating an opening in the lid 10A so as to allow atmosphere, or another fluid, into the jar.

Accordingly, a lid 10A includes a body 12A having a product side 14A and a customer side 16A. In an exemplary embodiment, the body is generally circular. The lid body 12A includes an end panel 22A and a tear panel 24A as well as a depending sidewall 23. That is, the depending sidewall 23 extends about the end panel 22A. In an exemplary embodiment, the end panel 22A further includes a centrally disposed button 600, as described above. In this embodiment, the body 12A further defines a limited container opening 20A. As defined above, a limited container opening 20A is defined by a number of score lines 190. As used herein, "score line 190" means a generic score line 190. Such generic score lines 190 can be included in other constructs and can be identified as being part of that construct by another reference number. The score line(s) 190 is/are, in one embodiment, a shifted material score line 90 as described above. In another embodiment, the score line(s) 190 is/are a traditional score line as opposed to a shifted material score line 90. That is, as used herein, a "score line" is an area of a container closure body, such as lid body 12A, wherein the body has been thinned by scoring at least one surface of the body 12A. It is understood that when a score line 190 is acted upon with sufficient pressure, the body 12A separates at the score line 190 thereby creating the opening 20A. That is, the end panel 22A and a tear panel 24A separate at the opening 20A. Thus, as used herein, an "opening" includes a potential opening, or not yet formed opening, defined by a score line.

In this embodiment, the number of score lines 190 are disposed adjacent and/or about the button 600. Thus, the button 600 is the tear panel 24A. It is understood that because the opening is a limited container opening 20A, the button 600/tear panel 24A does not move significantly relative to the end panel 22A. That is, the button 600/tear panel 24A only needs to move just enough to create the limited container opening 20A. Further, it is understood that the button 600 is structured to be pressed by a user. Thus, the button 600 defines an actuation location 620. That is, the lid body 12A includes an actuation location 620.

In an exemplary embodiment, the score line(s) 190 is/are part of a force concentrating construction 200. In an exemplary embodiment, the force concentrating construction 200 includes a force directing score pattern 210 and a force focusing score 250. In one embodiment, as shown, the force directing score pattern 210 includes a plurality of circular trapezoids 212 disposed about the button 600. As used herein, when a "force directing score pattern 210 "includes" an identified pattern or shape, it means that a number of score lines 190 form the identified shape or pattern. Thus, in this embodiment, the force directing score pattern 210 includes score lines 190 disposed in the shapes of circular trapezoids 212. Stated alternately, the circular trapezoids 212 are score lines 190 disposed in the specified shape.

As shown in FIGS. 36A-36E, and in an exemplary embodiment, there are three circular trapezoids 212A, 212B, 212C disposed about the button 600. This is an exemplary embodiment and in other embodiments, the plurality of circular trapezoids 212 includes one of three circular trapezoids 212, four circular trapezoids 212, five circular trapezoids 212, six circular trapezoids 212, seven circular trapezoids 212 or eight circular trapezoids 212. As shown, in an exemplary embodiment, the circular trapezoids 212 extend substantially about the button 600. In another embodiment, not shown, the circular trapezoids 212 do not extend about the button 600. That is, for example, two circular trapezoids 212 which each extend over an arc of about ninety degrees are disposed adjacent the button 600. It is understood that to be a force directing score pattern 210, the two circular trapezoids 212 are spaced so as to form a link 214, discussed below.

In the embodiment shown, each circular trapezoid 212 extends over an arc of slightly less than 120 degrees. Further, the circular trapezoids 212 are spaced from each other along their radial sides. In this configuration, the spaces between the circular trapezoids 212 define links 214. In an exemplary embodiment, the links are between about 0.020 inch and 0.200 inch, or are about 0.05 inch in width, i.e., the distance between the radial sides of the circular trapezoids 212. Further, as shown, the circular trapezoids 212 include one circular trapezoid 212C that has a contiguous perimeter while the other two circular trapezoids, a first circular trapezoid 212A and a second circular trapezoid 212B, have a broken perimeter. Each circular trapezoid 212 also includes an inner score line 216. That is, each inner score line 216 is a score line 190 disposed within the perimeter of one of the circular trapezoids 212. In an exemplary embodiment, the inner score lines 216 are generally curvilinear and/or arcuate. In an exemplary embodiment, the force directing score pattern 210 is disposed on the offset tier 606 disposed about the button 600.

When the button 600 is actuated, i.e., pressed, the force is transferred through the button 600 and into the offset tier 606. The force(s) in the offset tier 606 are directed to the links 214. That is, the force is concentrated on the links 214. As the force is concentrated at a specific location, less force is required to separate the end panel 22A and a tear panel 24A at the score line 190 disposed at a link 214. This solves the problems stated above.

Further, in this embodiment, the force concentrating construction 200 includes a force focusing score 250. The force focusing score 250 includes a first arcuate portion 252, a generally arcuate nose 254, and a second arcuate portion 256. The first arcuate portion 252 and the second arcuate portion 256 form a general arc that is an "overall generally straight curvilinear line" as defined above. The nose 254 is disposed between, and is contiguous with, the first arcuate portion 252 and the second arcuate portion 256. The nose 254 is the curvilinear incongruous medial portion that, when associated with an overall generally straight curvilinear line, defines a force focusing score 250. That is, the shape of the score 190 shown in FIGS. 36A and 36B as a force focusing score 250 meets the definition of a "force focusing score" used herein. That is, a score 190 in this configuration focuses a force applied thereto at the nose 254. Thus, less force is required to open a force focusing score 250 relative to scores 190 of other shapes such as, but not limited to, a generally curvilinear score. In this configuration, the end panel 22A and the tear panel 24A separate at least at the nose 254 thereby opening the limited container opening 20A.

The nose 254 is disposed adjacent the perimeter of the button 600. In an exemplary embodiment, the nose 254 is disposed within one of 0.010 inch, 0.020 inch, 0.025 inch, 0.30 inch or 0.35 inch of the perimeter of the button 600. As shown, and in an exemplary embodiment, the force focusing score 250 extends across a link 214 and into two of the circular trapezoids 212A, 212B. That is, the force focusing score 250 extends through the gap in the perimeter of the circular trapezoids 212A, 212B so that the first arcuate portion 252 is disposed within the first circular trapezoid 212A, and, the second arcuate portion 256 is disposed within the second circular trapezoid 212B. In this configuration, and for the reasons noted above, the force applied by a user is concentrated on the link 214 focused on the nose 254. As such, less force is required to separate the score 190 at the nose 254. Further, when a force is applied to the button 600, the end panel 22A and the tear panel 24A separate at the nose 254 forming the limited container opening 20A. The limited container opening 20A allows atmosphere to enter the enclosed space of the jar and reduces the force of engagement between the lid 12A and the jar. This solves the problems stated above.

In an exemplary embodiment, force concentrating construction 200 also includes a number of anti-fracture scores 258. Each anti-fracture score 258 is disposed adjacent to an associated force focusing score 250. In an exemplary embodiment, each anti-fracture score 258 has a shape that generally corresponds to the shape of the associated force focusing score 250.

In an exemplary embodiment, each score 190 in the force directing score pattern 210 has a residual. As is known, and as used herein, the "residual" is the thickness of the material at the score 190 following scoring operations. As is known, and in an exemplary embodiment, the anti-fracture scores 258, have greater residual than the scores 190 of the force directing score pattern 210 and the force focusing score 250. As shown, the anti-fracture scores 258 are about 0.001 inch less deep than the force directing score pattern 210 and the force focusing score 250. That is, the residual of the anti-fracture scores 258 is about 0.001 inch thicker than the residual of the force directing score pattern 210 and the force focusing score 250.

Figure 39A:
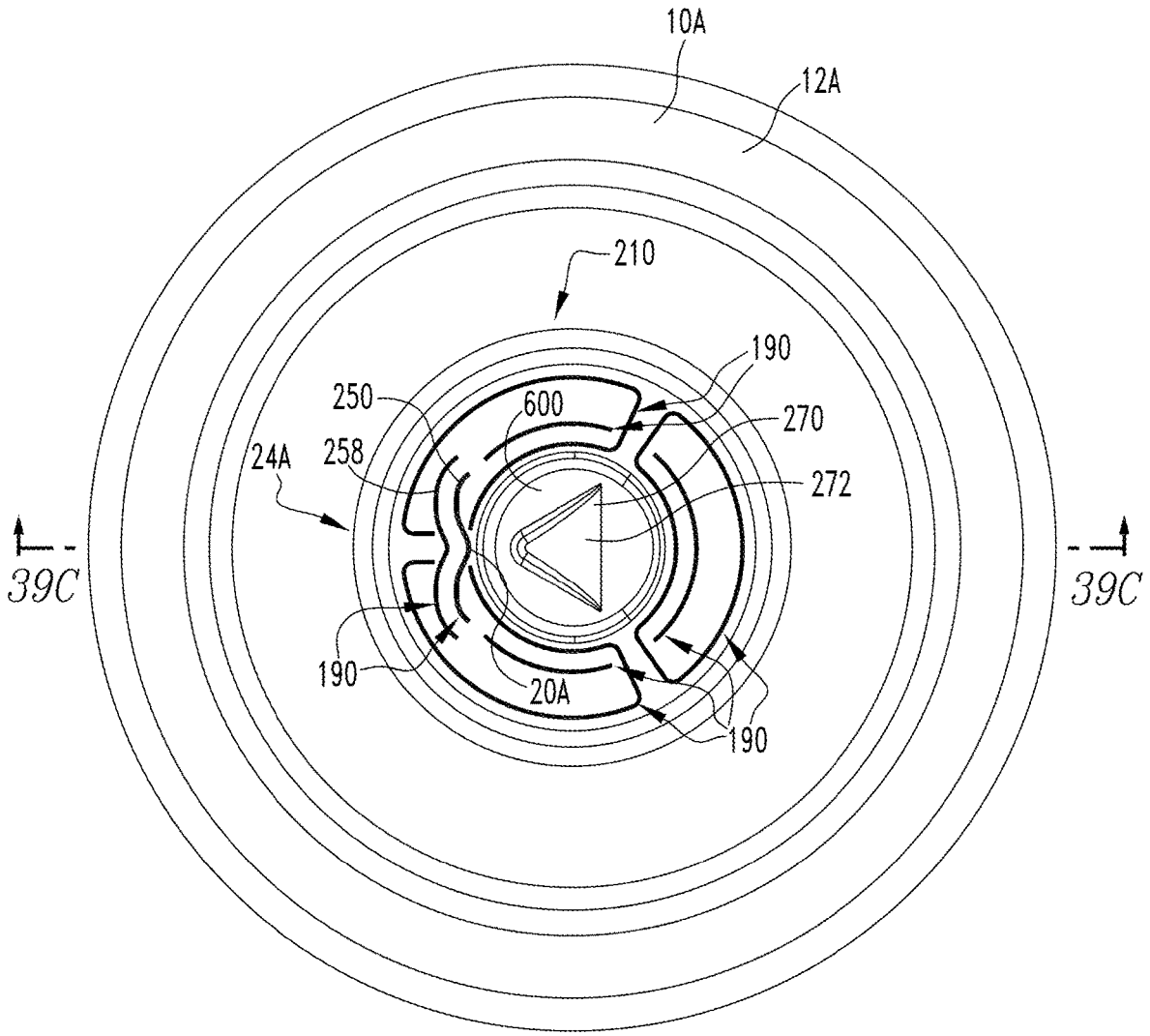
FIG. 39A is a top view of a lid including a limited container opening and a force concentrating construction.
Figure 39B:
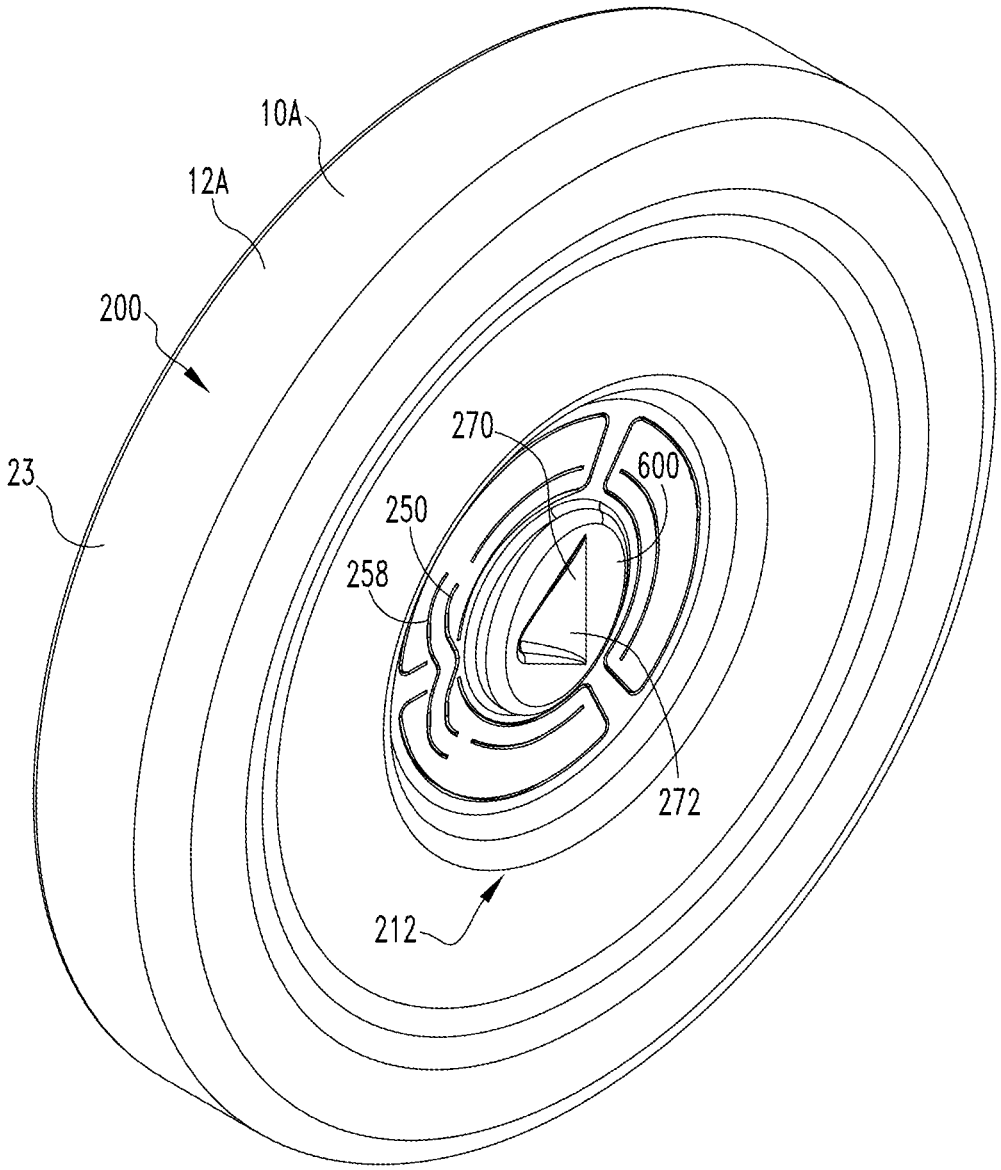
FIG. 39B is an isometric view of the lid in FIG. 39A.
Figure 39C:
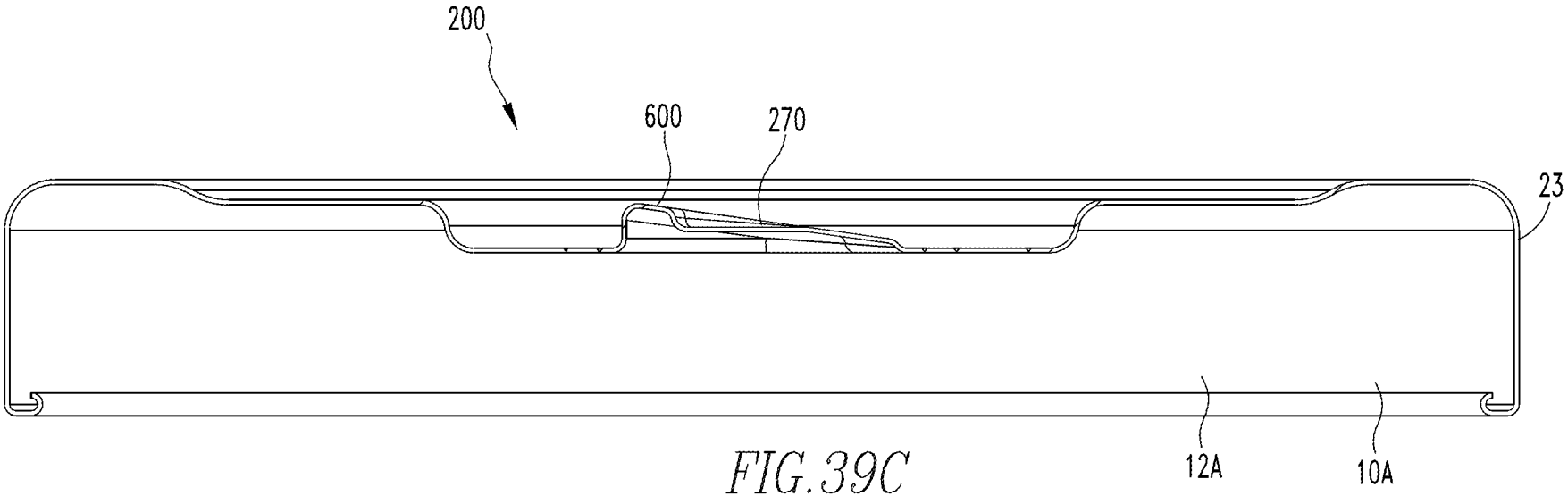
FIG. 39C is cross-sectional side view of the lid in FIG. 39A.
Figure 39D:
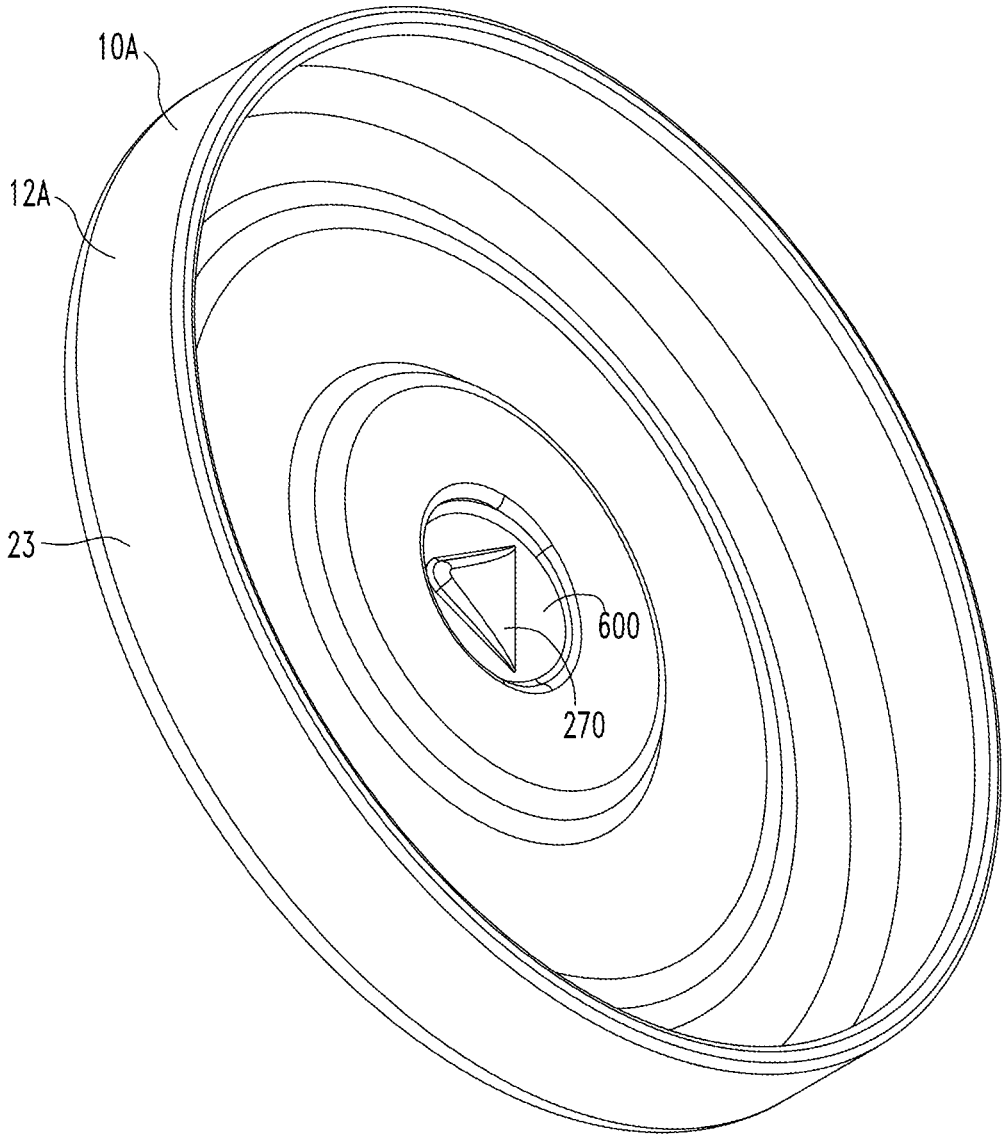
FIG. 39D is another isometric view of the lid in FIG. 39A.
Figure 40A:
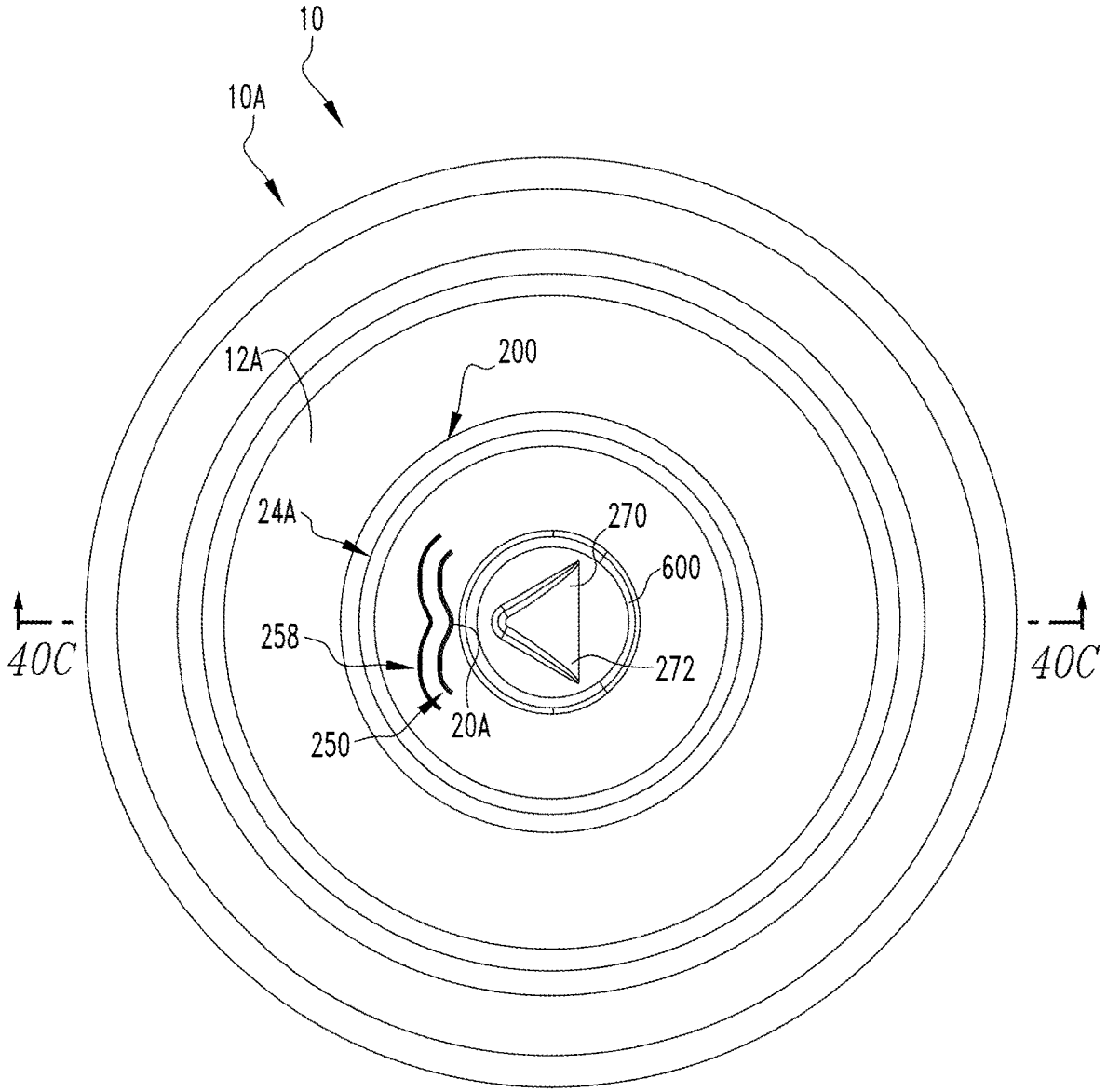
FIG. 40A is a top view of a lid including a limited container opening and a force concentrating construction.
Figure 40B:
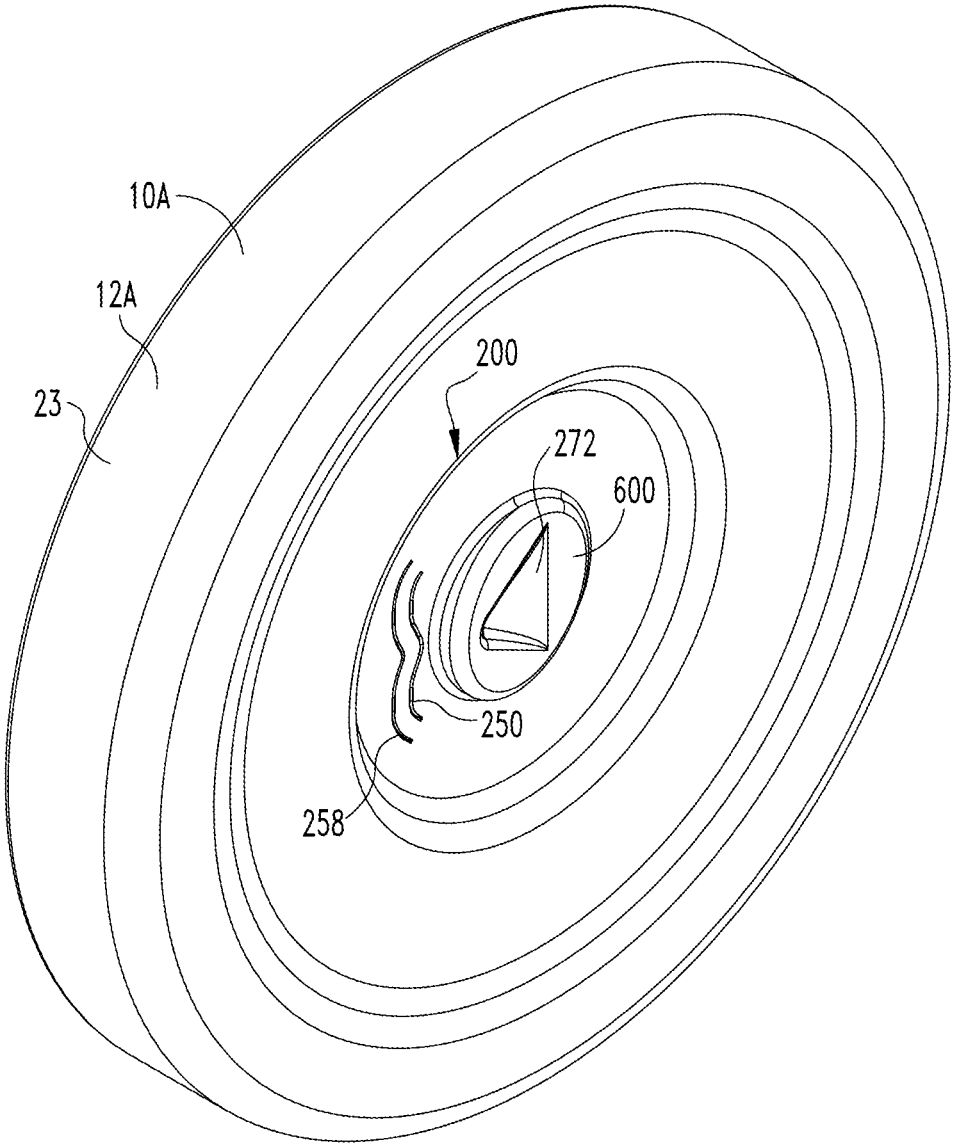
FIG. 40B is an isometric view of the lid in FIG. 40A.
Figure 40C:
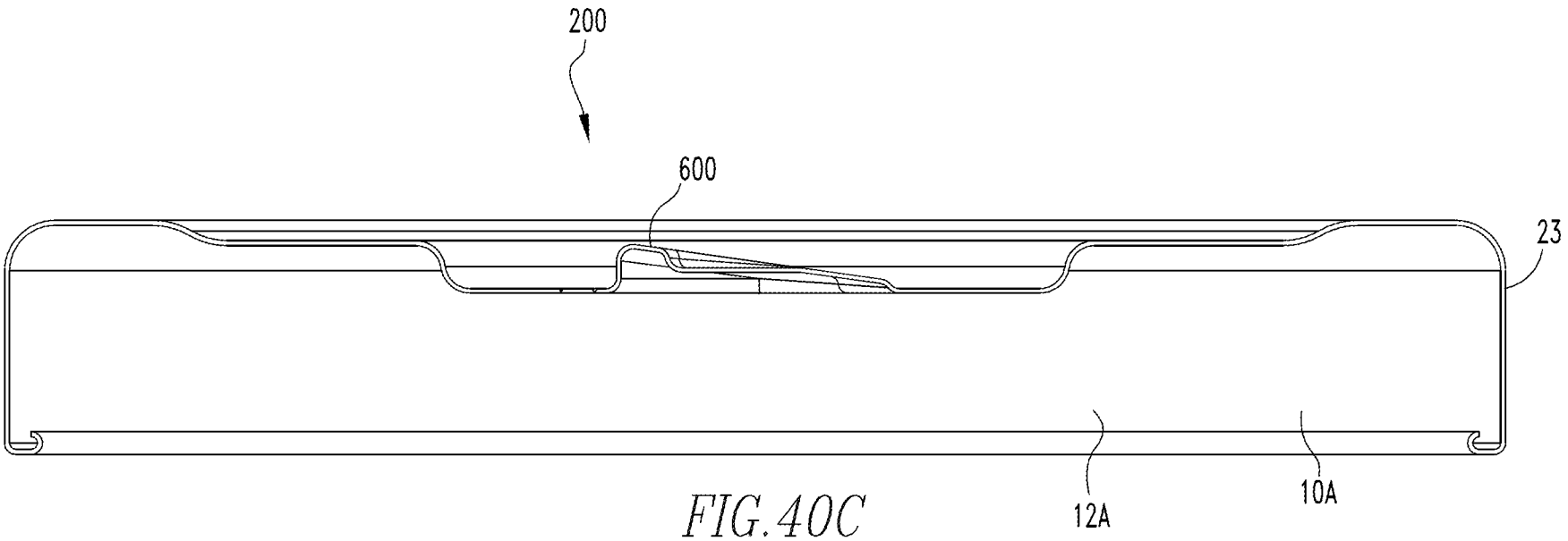
FIG. 40C is cross-sectional side view of the lid in FIG. 40A.
Figure 40D:
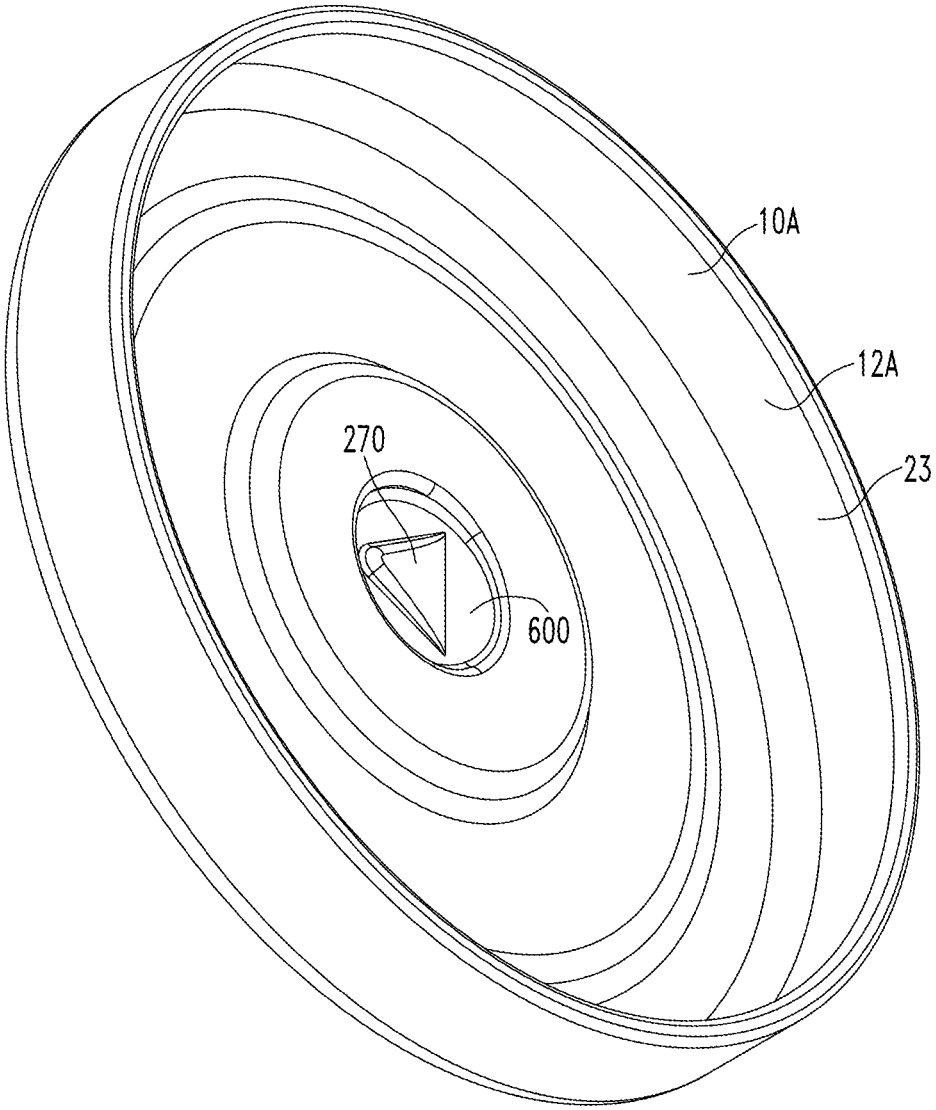
FIG. 40D is another isometric view of the lid in FIG. 40A.

In an exemplary embodiment, shown in FIGS. 39A and 40A, discussed below, the button 600 includes a force application indicia 270. A force application indicia 270 is structured to, and does, indicate a more effective location whereat a force is applied. In an exemplary embodiment, the force application indicia 270 is a pointed shape 272 that is embossed (raised upwardly) or debossed (indented) in a generally planar upper surface of the button 600. One raised or indented point of the pointed shape 272 is disposed adjacent, or immediately adjacent, the link 214 upon which the force focusing score 250 is disposed. Alternatively, the force application indicia 270 is a hemisphere, or similar shape, embossed or debossed in the generally planar upper surface of the button 600 adjacent, or immediately adjacent, the link 214 upon which the force focusing score 250 is disposed. Further, the force application indicia 270 is a marking (not shown) applied to the button 600 such as printed mark, a painted mark, a decal, or similar construct.

Figure 37A:
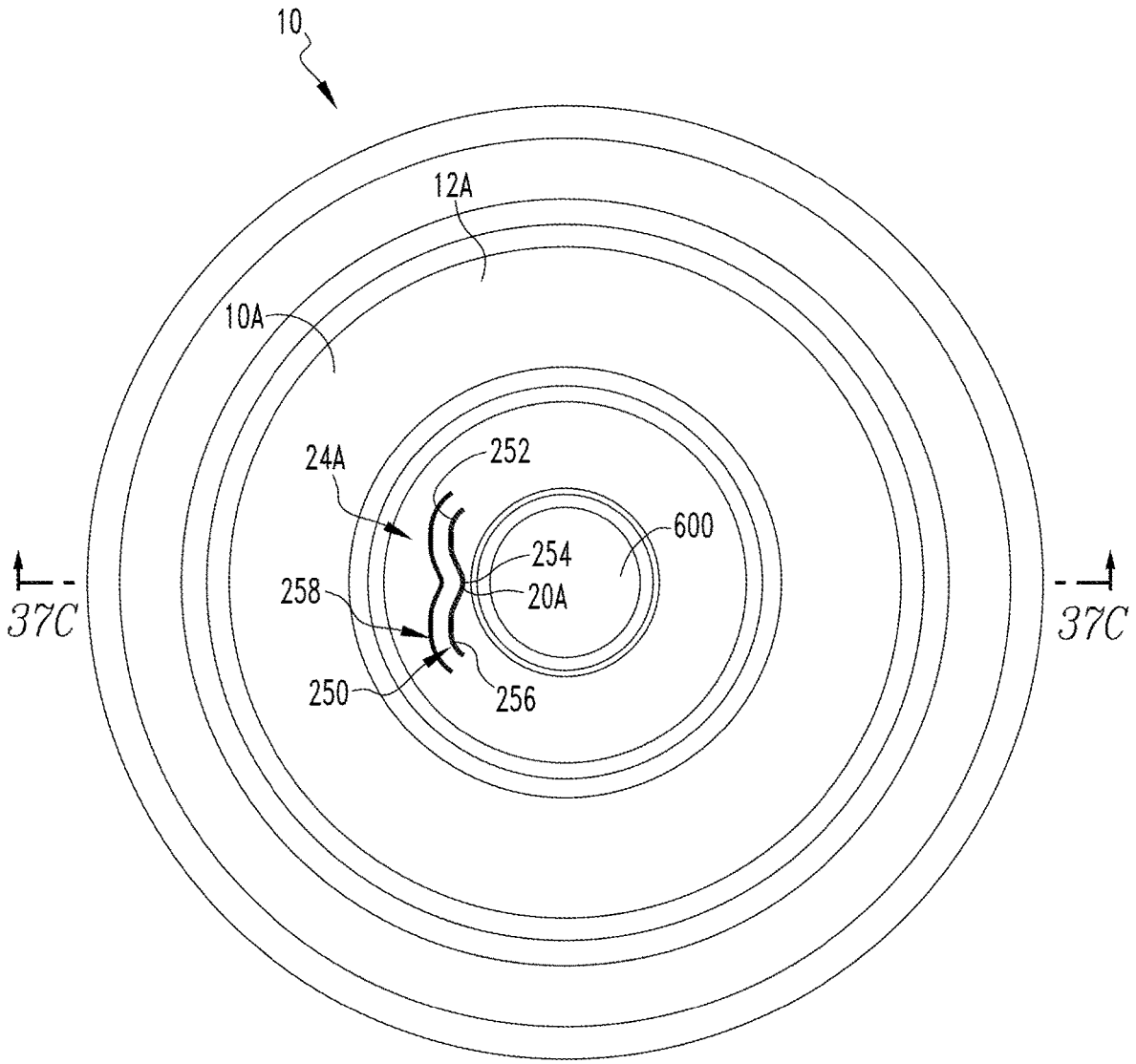
FIG. 37A is a top view of a lid including a limited container opening and a force concentrating construction.
Figure 37B:
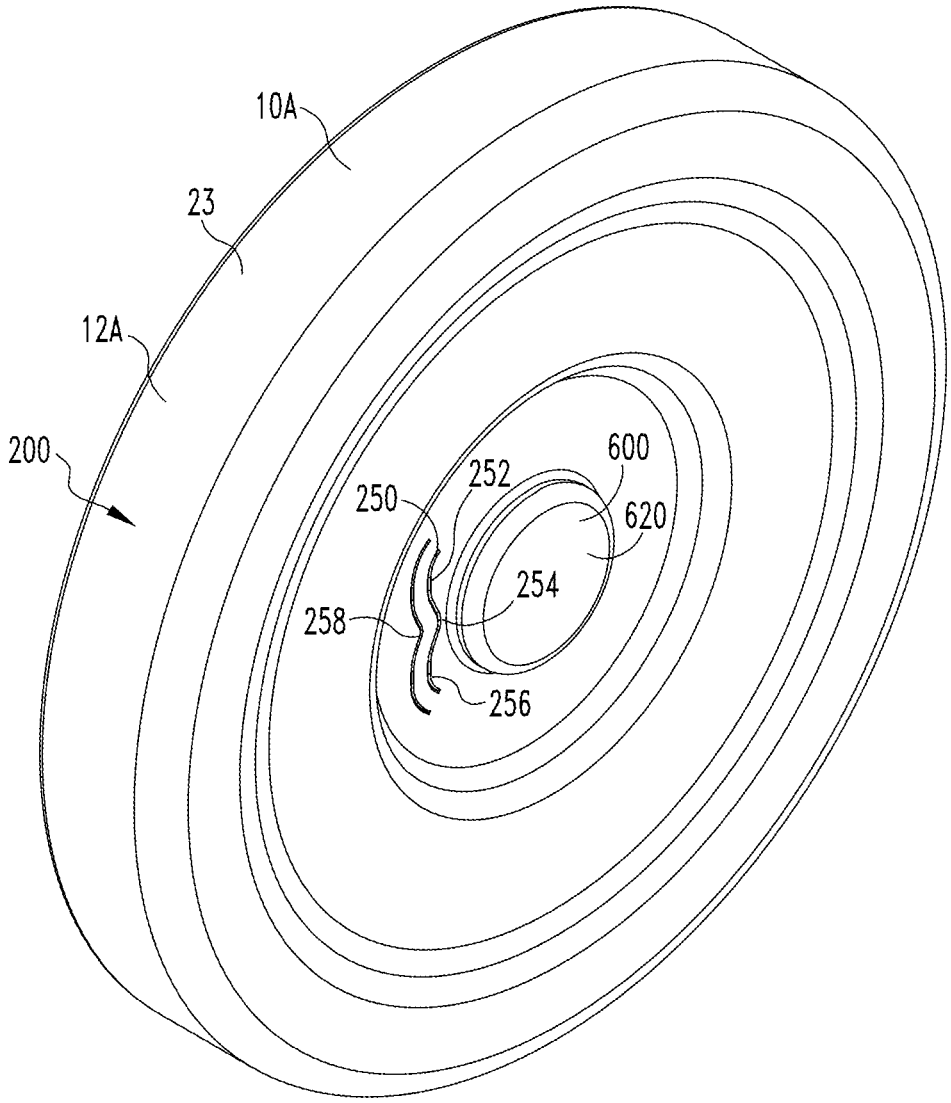
FIG. 37B is an isometric view of the lid in FIG. 37A.
Figure 37C:
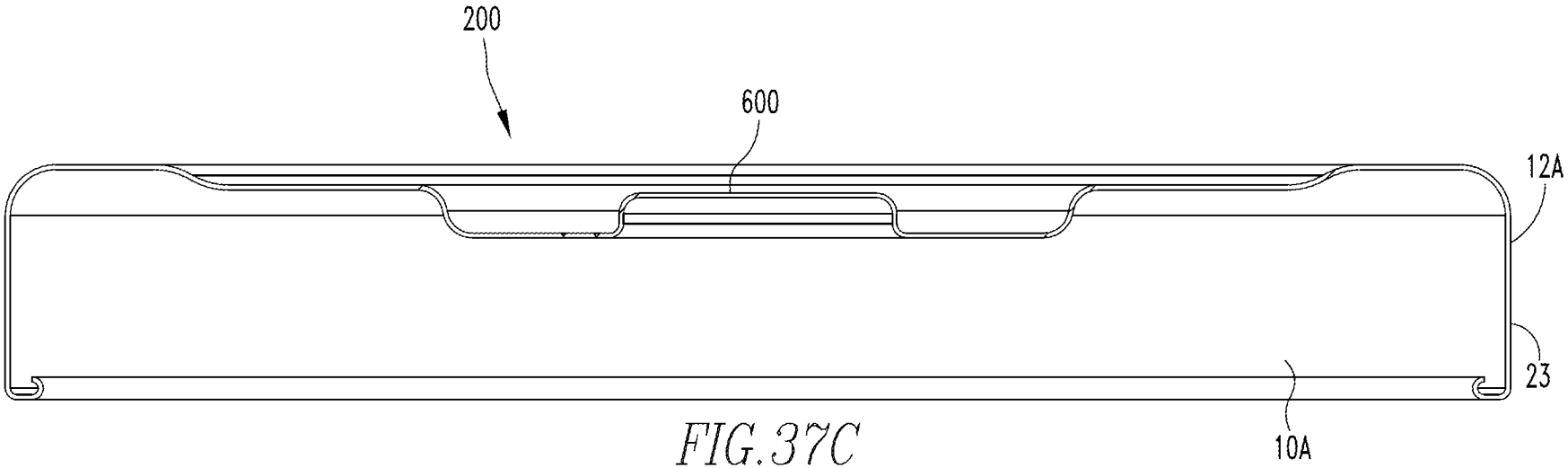
FIG. 37C is cross-sectional side view of the lid in FIG. 37A.
Figure 38A:
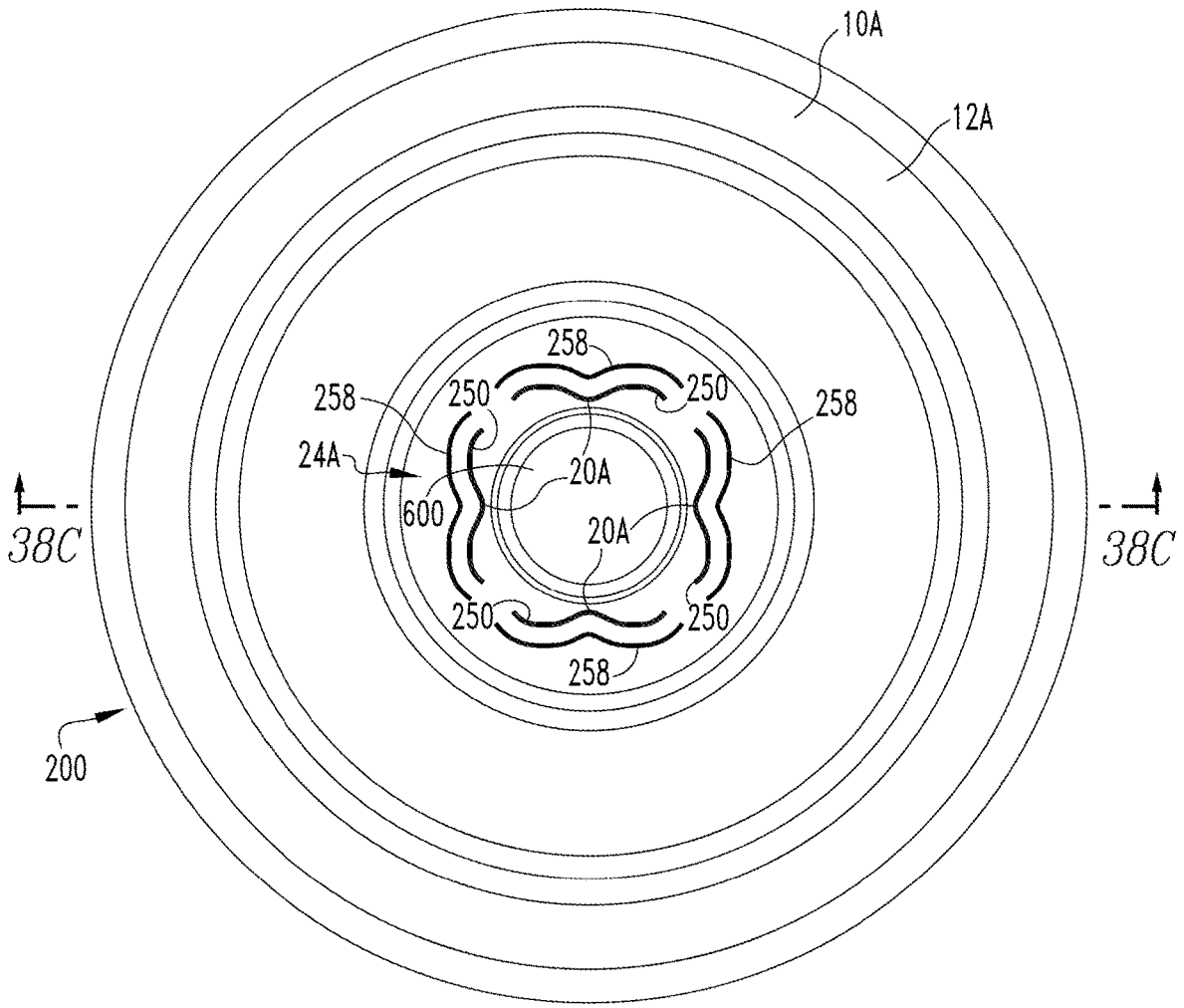
FIG. 38A is a top view of a lid including a limited container opening and a force concentrating construction.
Figure 38B:
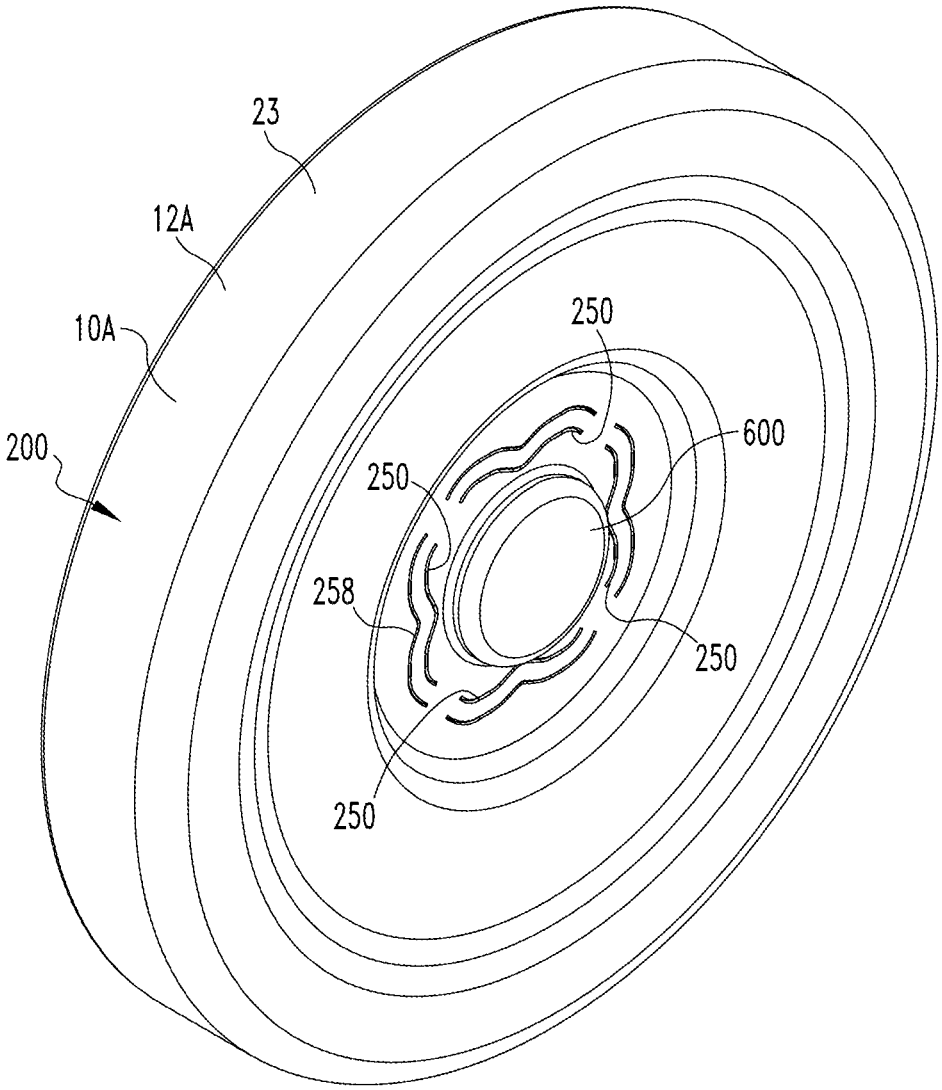
FIG. 38B is an isometric view of the lid in FIG. 38A.
Figure 38C:
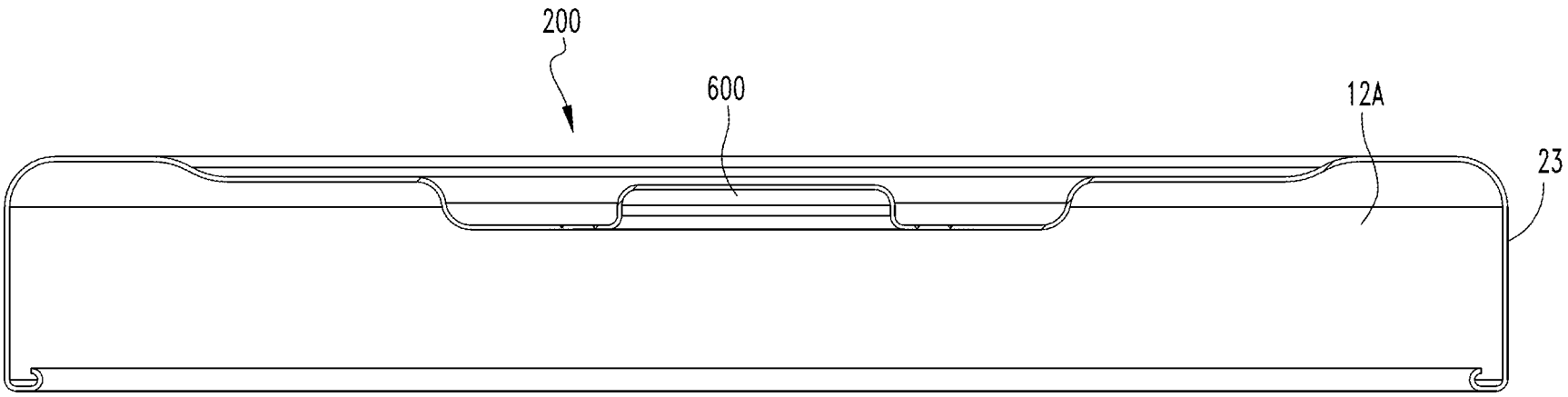
FIG. 38C is a side view of the lid in FIG. 38A.

Variations of the configuration of the force concentrating construction 200 are shown in FIGS. 37A-37E, 38A-38C, 39A-39D, and 40A-40C. For example, in FIGS. 37A and 37B the force concentrating construction 200 includes only the force focusing score 250 and an associated anti-fracture score 258 as described above. In FIGS. 38A and 38B, the force concentrating construction 200 includes four force focusing scores 250 disposed about the button 600. Further, as shown and in an exemplary embodiment, the four force focusing scores 250 are disposed so that the noses 254 thereof are disposed about ninety degrees apart about the perimeter of the button 600. It is understood that four force focusing scores 250 are examples and any number of force focusing scores 250 can be disposed about the button 600.

It is understood that a press assembly 510, as discussed above, includes a number of scoring stations 560 structured to form the scores 190 that are part of the force concentrating construction 200. Further, the scoring stations 560 include scoring blades (not shown) coupled to the upper tooling 522, as described above.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A method of forming a container closure comprising:

providing a generally planar metal blank having a product side and a customer side;

forming said generally planar metal blank into a container closure body including a limited container opening and an actuation location;

forming a force concentrating construction disposed adjacent said limited container opening;

forming said force concentrating construction to include a force directing score pattern;

forming said actuation location to be a raised button;

forming said force directing score pattern to include a plurality of circular trapezoids disposed about said button; and forming said plurality of circular trapezoids to be spaced from each other along adjacent radial sides.

2. The method of claim 1 wherein said plurality of circular trapezoids includes one of three circular trapezoids, four circular trapezoids, five circular trapezoids, six circular trapezoids, seven circular trapezoids or eight circular trapezoids.

3. The method of claim 1 wherein each circular trapezoid includes an inner score line, said inner score line disposed within the circular trapezoid.

4. A method of forming a container closure comprising:

providing a generally planar metal blank having a product side and a customer side;

forming said generally planar metal blank into a container closure body including a limited container opening and an actuation location;

forming a force concentrating construction disposed adjacent said limited container opening;

forming said force concentrating construction to include a number of force focusing scores;

forming said actuation location to be a raised button;

forming each said force focusing score to include a first arcuate portion, a generally arcuate nose, and a second arcuate portion, said nose disposed between, and contiguous with, said first arcuate portion and said second arcuate portion, wherein each said nose disposed adjacent the perimeter of said button; and forming said force concentrating construction to include a number of anti-fracture scores, wherein each said anti-fracture score corresponds to one of a portion of an associated force focusing score.

5. The method of claim 4 further comprising forming each said nose to be disposed within one of 0.010 inch, 0.020 inch, 0.025 inch, 0.30 inch or 0.35 inch of the perimeter of said button.

6. The method of claim 4 wherein said number of force focusing scores includes one of a single force focusing score or four force focusing scores.

7. The method of claim 4 further comprising:

forming said button to include a force application indicia; and forming said force application indicia to be disposed adjacent a force focusing score nose.

8. A method of forming a container closure comprising:

providing a generally planar metal blank having a product side and a customer side;

forming said generally planar metal blank into a container closure body including a limited container opening and an actuation location;

forming a force concentrating construction disposed adjacent said limited container opening;

forming said force concentrating construction to include a number of force focusing scores;

wherein said force concentrating construction includes a force directing score pattern;

forming said actuation location to be a raised button; and forming said force directing score pattern to include a plurality of circular trapezoids disposed about said button, wherein said plurality of circular trapezoids includes a first circular trapezoid and a second circular trapezoid, and wherein said plurality of circular trapezoids are spaced from each other along adjacent radial sides.

9. The method of claim 8 further comprising:

forming said force focusing score to include a first arcuate portion, a generally arcuate nose, and a second arcuate portion, said nose disposed between, and contiguous with, said first arcuate portion and said second arcuate portion, wherein said nose is disposed on a link of said force concentrating construction, wherein said first arcuate portion is generally disposed within said first circular trapezoid, and wherein said second arcuate portion is generally disposed within said second circular trapezoid.

10. A method of forming a container closure comprising:

providing a generally planar metal blank having a product side and a customer side;

forming said generally planar metal blank into a container closure body including a limited container opening and an actuation location;

forming a force concentrating construction disposed adjacent said limited container opening;

forming said force concentrating construction to include a number of force focusing scores;

wherein said force concentrating construction includes a force directing score pattern; and forming each said force concentrating construction to include an anti-fracture score, wherein each said anti-fracture score corresponding to one of a portion of an associated force focusing score.

* * * * *